US005764253A

United States Patent [19]

Uchikata et al.

[11] Patent Number: 5,764,253

[45] Date of Patent: Jun. 9, 1998

[54] INK JET RECORDING APPARATUS PROVIDED WITH MEANS FOR CALCULATING WASTE INK AMOUNT, AND INFORMATION PROCESSING SYSTEM PROVIDED WITH SUCH AN INK JET RECORDING APPARATUS

[75] Inventors: Yoshio Uchikata; Kazuya Iwata, both of Yokohama, Japan

[73] Assignee: Canon Kabushiki Kaisha, Tokyo, Japan

[21] Appl. No.: 689,134

[22] Filed: Jul. 30, 1996

Related U.S. Application Data

[63] Continuation of Ser. No. 183,402, Jan. 19, 1994, abandoned.

[30] Foreign Application Priority Data

Jan. 19, 1993 [JP] Japan ..... 5-006923
Jan. 19, 1993 [JP] Japan ..... 5-007052

[51] Int. Cl.[6] ..... B41J 2/165

[52] U.S. Cl. ..... 347/23; 347/36

[58] Field of Search ..... 347/5, 7, 19, 23, 347/30, 36, 86

[56] References Cited

U.S. PATENT DOCUMENTS 4,965,596 10/1990 Nagoshi et al. ..... 347/36
5,170,186 12/1992 Shimamura et al. ..... 347/23
5,172,140 12/1992 Hirabayashi et al. ..... 347/36
5,245,362 9/1993 Iwata et al. ..... 347/23

FOREIGN PATENT DOCUMENTS 0427202 5/1991 European Pat. Off. .
0480473 4/1992 European Pat. Off. .
0494694 7/1992 European Pat. Off. .
0540174 9/1992 European Pat. Off. .
1-202455 8/1989 Japan ..... 347/36

*Primary Examiner*—John E. Barlow, Jr.
*Attorney, Agent, or Firm*—Fitzpatrick, Cella, Harper & Scinto

[57] ABSTRACT

In an ink jet recovery apparatus, a recovery operation of the recording head is performed by exhausting ink from the recording head. The recording apparatus has a waste ink storage tank to store the ink exhausted in the recovery operation. The amount of waste ink currently stored in the waste ink storage tank is calculated in accordance with the amount of ink exhausted up to the present, the elapsed time since the last recovery operation, and the amount of ink exhausted in the current recovery operation. The amount of ink stored in the waste ink storage tank can thus be accurately monitored, so that waste ink is not allowed to flow out of the storage tank. Users can be informed of overflow of the waste ink and thereby prompted to exchange the tank; space required for the tank can thus be reduced.

30 Claims, 41 Drawing Sheets

| |
|---|
| FIG. 31A |
| FIG. 31B |

η TABLE

| TIME (HOUR/DAY) | EVAPORATION COEFFICIENT η (%) |
|---|---|
| 0 HOUR | 100 |
| ⋮ | ⋮ |
| 12 HOUR | 97 |
| ⋮ | ⋮ |
| 24 HOUR | 95 |
| ⋮ | ⋮ |
| 2 DAY | 90 |
| ⋮ | ⋮ |
| 30 DAY | 21 |
| ⋮ | ⋮ |
| 60 DAY | 4 |

INK JET RECORDING APPARATUS PROVIDED WITH MEANS FOR CALCULATING WASTE INK AMOUNT, AND INFORMATION PROCESSING SYSTEM PROVIDED WITH SUCH AN INK JET RECORDING APPARATUS

This application is a continuation of application Ser. No. 08/183,402 filed Jan. 19, 1994, now abandoned.

BACKGROUND OF THE INVENTION

1. Field of the Invention

The present invention relates to an ink jet recording apparatus serving as an output for a copying machine, a facsimile apparatus, a computer, a word processor, and other such complex equipment and apparatus. More particularly, the invention relates to an ink jet recording apparatus having a waste ink storage for storing waste ink to be exhausted, and an information processing system provided with such an apparatus.

2. Related Background Art

As one of most widely used modes of information processing systems, there is known a system in which an ink jet recording apparatus (hereinafter, referred to as ink jet printer occasionally) is connected to a so-called personal computer. While confirming information represented on the screen of a display, a user of a personal computer system operates keys and others to issue instructions for the execution of information processing. The processing results of the system are then recorded by the above-mentioned printer or represented on the screen of the display.

A conventional system of the kind often provides such that only recording data, recording control data, and others, which are required for the printer to execute its recording operation, are transferred to or received from the elements constituting the system, a printer, and a personal computer serving as a host apparatus, for example. The data needed for the printer to execute the operations other than the reception or transfer of such data are inputted mainly on the printer side.

As an example, the instructions for discharge recovery processes inherent in an ink jet recording apparatus are often issued by the operation of the keys on the printer side dedicated to executing such processes. Also, when these operations are automatically executed by the printer, they are usually executed by the printer alone independent of the host apparatus.

In this respect, in addition to the typical process of the above-mentioned discharge recovery, an ink jet printer has various processes to be executed along its recording operation such as the control of ink storage in an ink tank and the process of exchanging ink tanks, the control of a waste ink tank which stores the waste ink to be exhausted by the above-mentioned discharge recovery process, and also, the processes and some others required for exchanging the recording heads.

When the ink jet printer having its unique processes as above is connected as one of structural elements to an information processing system equipped with a computer as its host apparatus, the user of the system may find it convenient sometimes to utilize such systems for the execution of the above-mentioned processes as a whole.

Also, it is possible for an ink jet recording apparatus to discharge ink from the finely processed ink discharge ports of the recording head for recording as desired. However, since the ink discharged from such a recording head contains the component which easily evaporates, the ink tends to adhere to the discharge port surface of the recording head when the recording head is not in use for a long time or even during recording, and then, the ink is dried or it clogs the discharge ports. If such takes place, the discharge direction is caused to vary; the ink discharge is disabled; or the quality of recorded image is lowered. In order to avoid the occurrence of a situation of the kind, the so-called cleaning and predischarge are operated among some other means.

The waste ink which is exhausted by the cleaning and predischarge is transferred to a waste ink storage by means of a built-in device including a pumping mechanism, which is called a recovery system unit. Now, since the waste ink contains a considerable amount of a volatile component, some reduction of volume can be anticipated because of its drying, but the non-volatile component of the wasted ink is gradually accumulated in the storage. Accordingly, the volume of the storage is conventionally set at an estimated amount of wasted ink to be exhausted on the standard condition of use predicated by a designer, plus some margin to such an estimated amount thus designed.

Also, in consideration of a possibility that the ink is exhausted in an amount which may exceed the margin set for the estimated storage, the structural arrangement is devised for the apparatus so that the waste ink which may overflow from the waste ink storage or the recovery system unit does not reach a power-supply, or an electric circuit unit as well.

According to the conventional method, no countermeasure is prearranged sufficiently for any possible occasion that the waste ink is exhausted more than the value set by the designer. As a result, only after the ink has exuded to the exterior of the apparatus, the user comes to know that the storage of the waste ink has arrived at its limit. Until then, a considerable amount of ink runs to each of the parts in the apparatus. Therefore, maintenance required by a user may require complicated tasks in cleaning the ink which has flown out. Moreover, in practice, an unfavorable problem is encountered in not only the recording apparatus itself, but the apparatus in which the recording apparatus is incorporated is damaged to an extent where its restoration becomes almost impossible.

Also, it may bring about a further disadvantage that once the ink has exuded from the exterior of the apparatus, and the user does not come to notice it for a long time, any furniture, floor carpet, and other items surrounding the recording apparatus are all stained.

SUMMARY OF THE INVENTION

The present invention is designed with an intention to solve the above-mentioned problems. It is an object of the invention to provide an ink jet recording apparatus which enables the user to exchange ink tanks or recording heads appropriately, and enables appropriate processes to be executed along with such an operation (or enables an appropriate management) for control of the ink tank, and also, to provide an information processing system with such an apparatus.

It is another object of the present invention to avoid any overflow from the waste ink storage which stores the waste ink to be exhausted, and to prevent an overflow of ink from producing any adverse effect on the reliability of the recording apparatus.

In order to achieve the above-mentioned objects, the present invention, which uses a recording head to discharge ink and records on a recording medium by discharging ink from the aforesaid recording head, is at the same time provided with recovery means for operating the recovery of the recording head by exhausting ink from the aforesaid recording head; memory means for holding in memory the amount of wasted ink stored in the waste ink storage means, which serves as means for calculating waste ink amount in an ink jet recording apparatus having the waste ink storage means for storing the ink which is exhausted from the recovery means; and time measuring means for measuring a time which has elapsed since the last recovery operation of the aforesaid recovery means, wherein the amount of the waste ink currently stored in the aforesaid waste ink storage means is calculated in accordance with the amount of exhaust which has been made up to the present by the recovery means, the elapsed time measured by the aforesaid time measuring means since the last recovery operation, and the amount of ink exhausted by the current recovery operation of the recovery means.

Also, according to the present invention, an ink jet recording apparatus, which uses a recording head for discharging ink to record on a recording medium by discharging ink from the aforesaid recording head, comprises recovery means for recovering the discharge of the recording head by exhausting ink from the recording head; waste ink storage means for storing ink exhausted by the recovery means; and waste ink amount calculating means for calculating the amount of ink stored by the waste ink storage means up to the present in accordance with the amount of exhaust which has been made up to the present by the aforesaid recovery means, and the time which has elapsed up to the present since the start of exhaust by the aforesaid recovery means.

Also, according to the present invention, an ink jet recording method, which uses a recording head for discharging ink therefrom to record on a recording medium, comprises the steps of recovering the discharge of the recording head by exhausting ink from the recording head; storing in waste ink storage means the ink which is exhausted in the aforesaid step of recovering; and calculating the amount of waste ink currently stored in the aforesaid waste ink storage means.

Also, according to the present invention, an ink jet recording apparatus, which uses a recording head for discharging ink to record on a recording medium by discharging ink from the aforesaid recording head, at the same time, being provided with recovery means for maintaining and recovering the state of ink discharge, comprises counting means for counting the number of the recovery operations executed by the aforesaid recovering means; and memory means for holding in memory the number of recovery operations counted by the aforesaid counting means.

DETAILED DESCRIPTION OF THE PREFERRED EMBODIMENTS

Hereinafter, with reference to the accompanying drawings, the descriptions will be made of the embodiments according to the present invention.

(First Embodiment)

Figure 1:
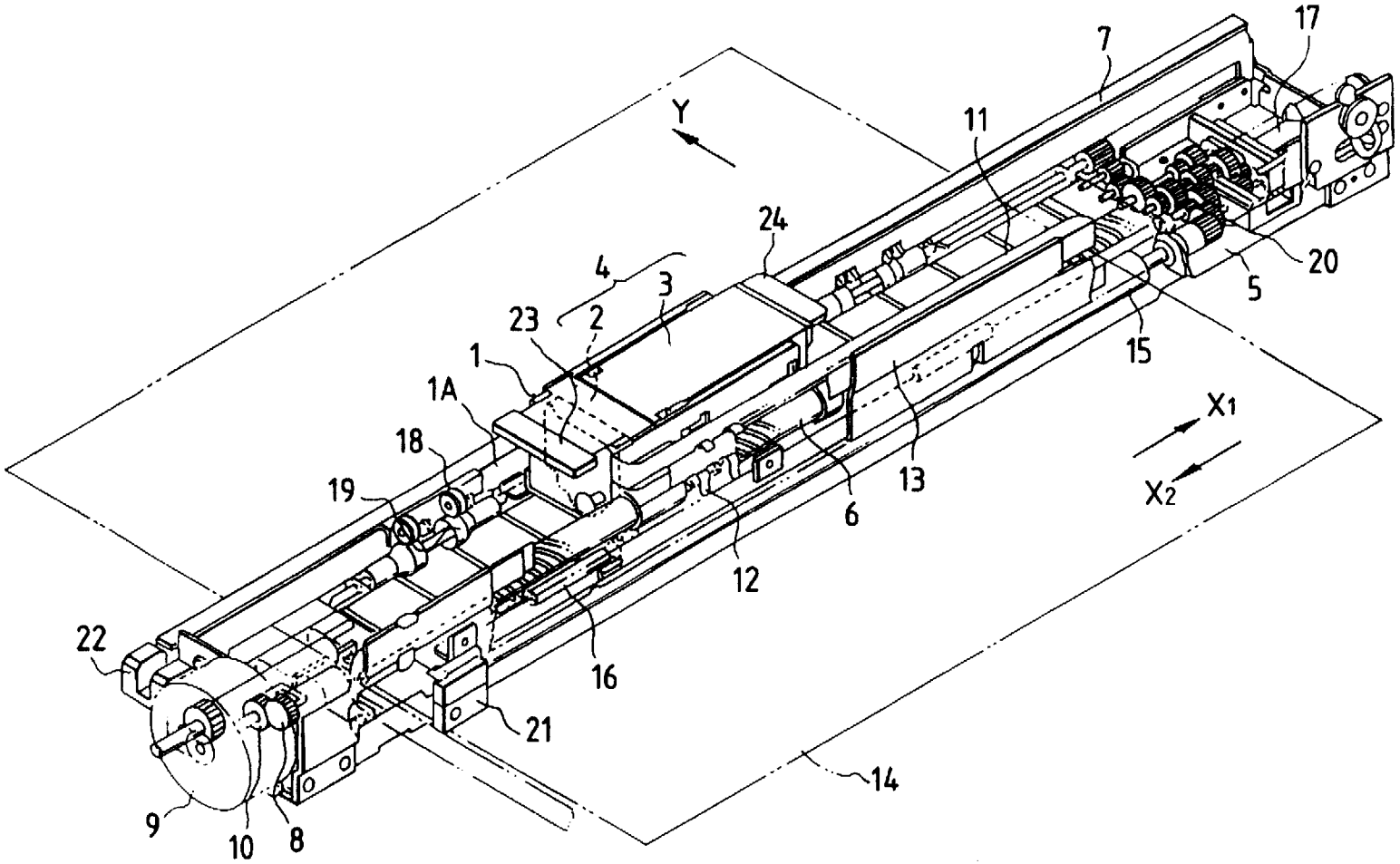
FIG. 1 is a perspective view showing an embodiment of an ink jet recording apparatus according to the present invention.

FIG. 1 is a perspective view showing an ink jet recording apparatus according to an embodiment of the present invention. In FIG. 1, a recording head 2 and an ink tank 3, which constitute recording means, are coupled to a head cartridge 4. This cartridge is mounted on a carrier 1. The one end of the carrier 1 on the recording head 2 side is fitted slidably to the lead screw 6 in its axial direction, which is rotatively supported by the chassis 5, a frame of the apparatus. On the other end of the carrier 1, a guide which is not shown is arranged. In parallel to the axial direction of the lead screw 6, this guide is fitted slidably into the guide rail 7 formed on the chassis 5. A structure is arranged so that while keeping the posture constantly, the carrier 1 can reciprocate in the axial direction of the lead screw 6 as it rotates.

In other words, as shown in FIG. 1, the lead screw gear 8 fixed to the left-side end of the lead screw 6 engages with the pinion gear 10 which is fixed to the output shaft of a carrier motor 9, and further, a lead pin (not shown) mounted on the carrier 1 is fitted into the guiding thread (not shown) formed spirally on the lead screw 6 at a given pitch. Therefore, when the carrier motor 9 is driven to rotate regularly or reversely, the lead screw 6 rotates accordingly, thus enabling the carrier 1 to reciprocate.

A reference numeral 11 designates a flexible cable which transmits printing signals from an electric circuit, which will be described later, to the recording head 2. The flexible cable is positioned and held by a flexible cable holder 12 at a pinch roller flame 13.

In synchronism with the reciprocal traveling (scan) of the above-mentioned carrier 1, ink is discharged from the recording head 2, hence recording on a recording material 14 for a one-line portion. In other words, the recording head 2 comprises fine liquid discharge ports (orifices); liquid passages, and energy activating units arranged on a part of each of the passages; and energy generating means which generates energy acting on liquid (also, referred to as ink) in each of the energy activating units. By utilizing the energy thus generated by this means, the ink droplets are discharged from the above-mentioned orifices.

As an energy generating means of the kind, there are the one which uses electromechanical transducers such as piezoelectric elements; the one which discharges liquid droplets by the activation resulting from the heat generated by the irradiation of electromagnetic wave such as laser; or the one which gives heat to liquid by electrothermal transducers having heat generating resistors, among some others.

Of these energy generating means, a recording head of a type which discharges liquid by the utilization of thermal energy makes it possible to execute a high resolution recording because the above-mentioned liquid discharge ports can be arranged in a high density. Particularly, the recording head which uses the electrothermal transducers as means for generating energy facilitates fabricating it compactly, and at the same time, makes it possible to fully utilize the advantages of the IC technologies and micro processing techniques, whose progress and reliability have been enhanced remarkably in the semiconductor field in recent years, for an easy attainment of a highly densified assembly of the recording head at a low cost of fabrication.

When a one-line recording is made by the scan of the carrier 1, a recording material 14, such as a recording sheet, is fed for one-line portion for the next recording. The feeding of the recording material 14 is executed by a pair of rotational elements, a feed roller 15 and a pinch roller 16 which abuts on it, and a pair of rotational elements, an exhaust roller 19 and a spur 18 which abuts on it.

To describe this more specifically, the recording material 14 having a recording surface of which faces the discharging port surface of the recording head 2 is caused to abut on the feed roller 15 by means of the pinch roller 16, and then, conveyed to the recording position as required by driving a feed motor 17 to rotate the feed roller 15 appropriately. After the completion of recording, the recording material 14 is caused to abut on the exhaust roller 19 by means of the spur 18, thus being exhausted outside the apparatus by the rotation of the exhaust roller 19.

The aforesaid feed roller 15 and exhaust roller 19 are driven by the feed motor 17. The transmission of such driving force is made by a train of speed reduction gears 20.

A reference numeral 21 designates a sheet sensor to detect the presence or absence of the recording material 14, and 22, a home position sensor formed by photointerrupters, which is installed on the carrier 1, and by the interception and interception release by the shielding board 1A traveling together with the carrier, it is possible to detect the presence of the carrier 1 at the home position. In the present embodiment, the home position is located on the left-hand side on FIG. 1.

Figure 2:
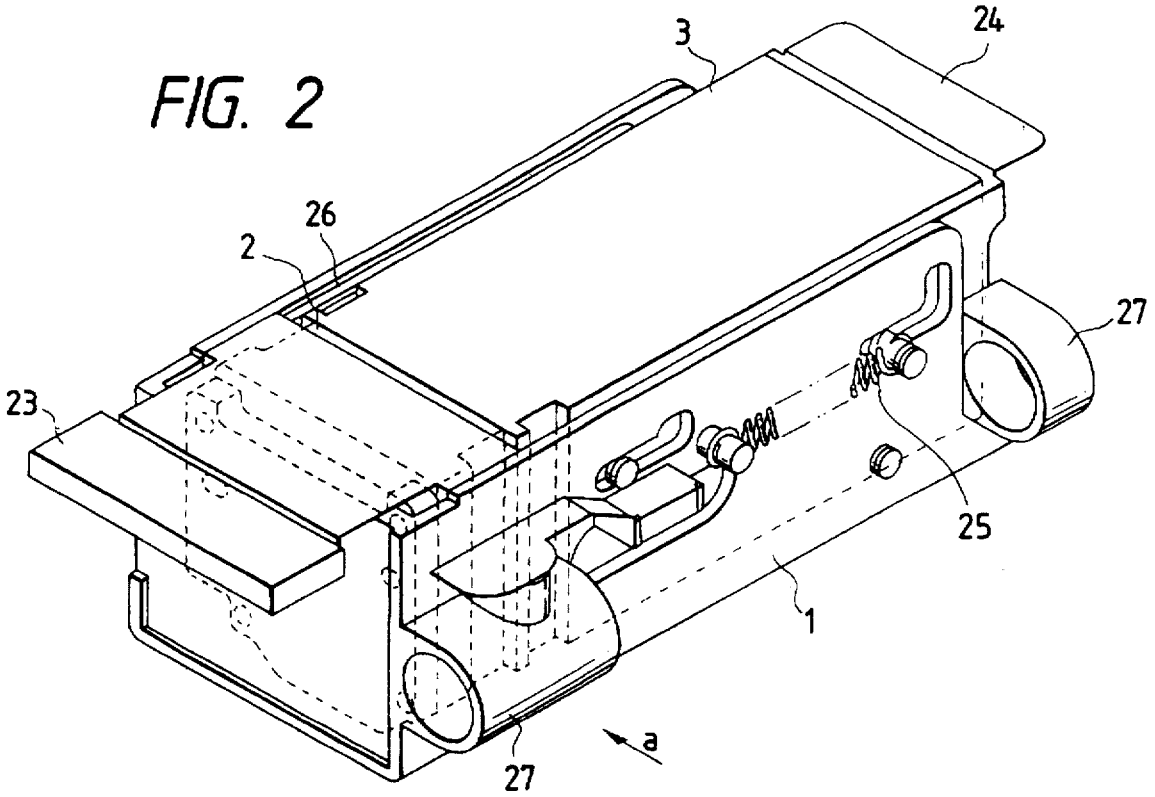
FIG. 2 is a perspective view showing the carrier unit of an ink jet recording apparatus according to the present invention.

FIG. 2 is a perspective view showing the head cartridge unit and carrier unit of the ink jet recording apparatus shown in FIG. 1. In FIG. 2, a reference numeral 23 designates a head lever to hole or release the recording head 2; 24, an ink tank lever with which to perform the attachment or detachment of the ink tank 3; 25, a head holder spring to keep the carrier 1 fixed to the recording head 2; 26, a tank case to hold the ink tank 3; and 27, a coupler to enable the carrier 1 to be fitted to the lead screw 6. With these parts, the head cartridge unit and carrier unit are structured for a recording apparatus.

The recording head 2 comprises a base board. On the base boared there are formed a plurality of electrothermal transducers to generate thermal energy utilized for ink discharge, and the driving circuit to drive the transducers. Then the recording head is fabricated by laminating, on such a base board, the discharge ports and liquid passages corresponding to each of the above-mentioned electrothermal transducers; and further, a ceiling to form a common liquid chamber conductively connected to each of the liquid passages. Furthermore, an electrical contact is provided for giving signals from the recording apparatus main body to the aforesaid driving circuit. Also, it may be desirable to arrange a sensor in the recording head 2 to detect the state of the recording head from the recording apparatus main body.

More specifically, there can be provided a temperature sensor to detect the temperatures in the vicinity of the aforesaid electrothermal transducers, an ink detecting sensor to detect the exhaustion of ink in the aforesaid common liquid chamber for lack of ink supply, or a sensor for identifying the kind of head for specifying the kind of head cartridge when the different kinds of ink in the ink tank and the recording heads are used by exchanging them, among other sensors. By arranging the recording apparatus main body so that it can detect the signals from these sensors, the printing condition can be optimized by controlling the signals to be applied to the electrothermal transducers.

The recording head thus structured is mounted on the recording apparatus in such a manner that the surface having the arrangement of the discharge ports faces the recording medium.

Now, the description will be made of a method for mechanically and electrically connecting the recording head 2 to the carrier 1 when exchanging recording heads or the head cartridges having a recording head and an ink tank coupled to each of them.

Figure 3:
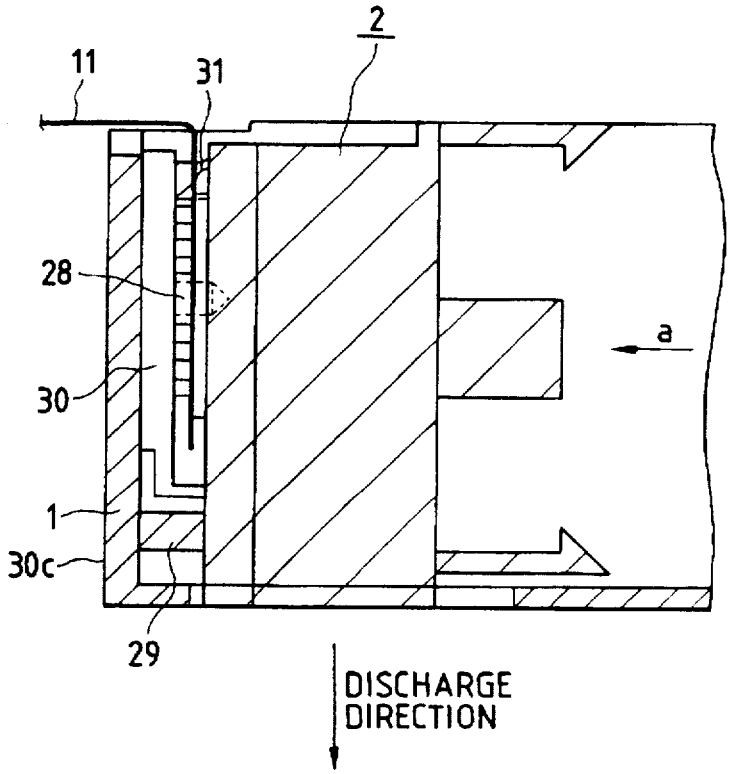
FIG. 3 is an enlarged partial view showing the above-mentioned carrier unit.
Figure 4:
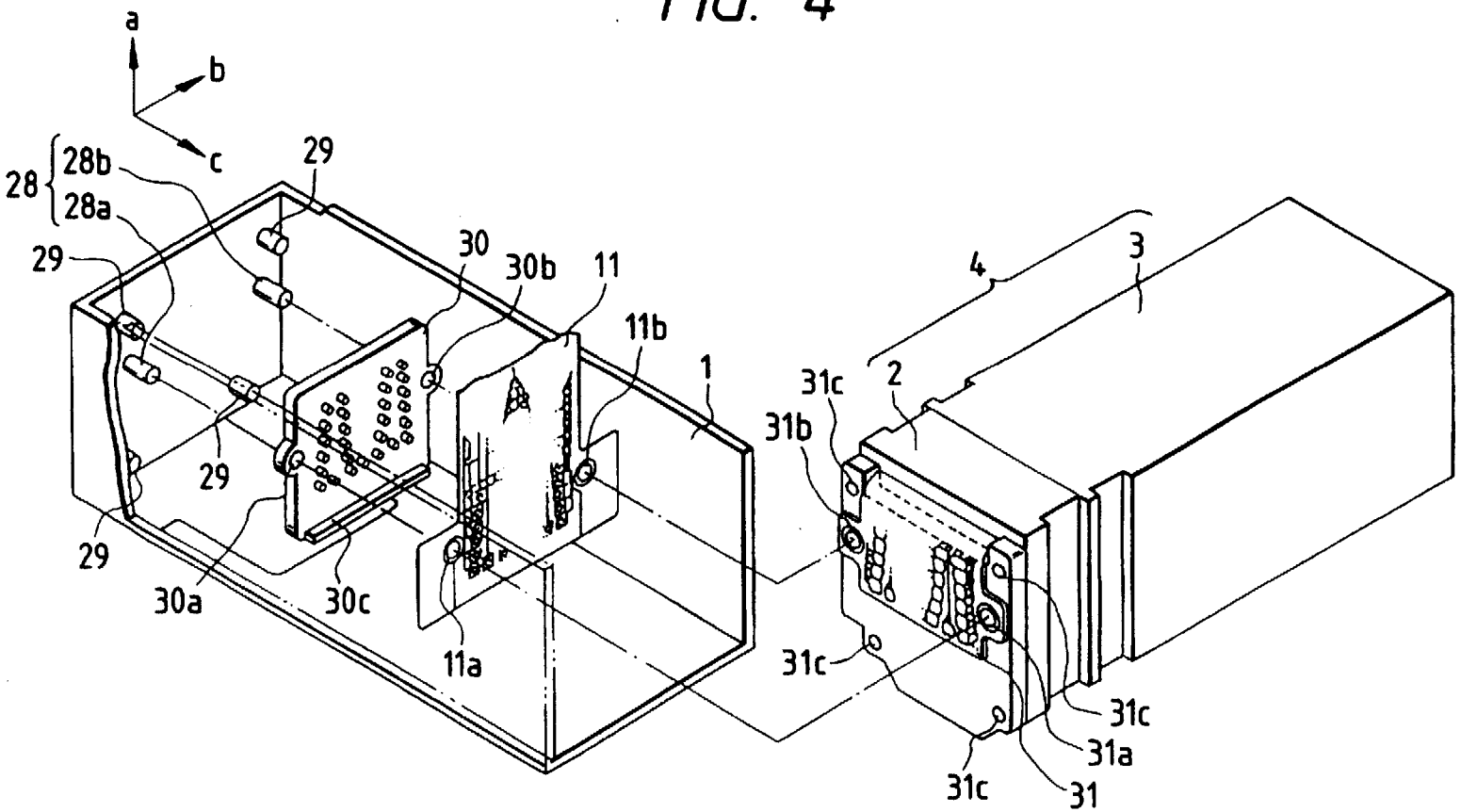
FIG. 4 is a perspective view showing a coupling method for the above-mentioned carrier unit and a head cartridge unit.

FIG. 3 is a cross-sectional view showing the connecting portion of the recording head 2 to the carrier 1 observed in the direction indicated by an arrow a in FIG. 2. FIG. 4 is a partially cut off perspective view illustrating the order of installation.

In FIG. 3 and FIG. 4, a reference numeral 28 designates the positioning pins fixed to the carrier 1, which engage with the holes provided for the recording head 2 in order to set its position in the directions indicated by arrows a and b in FIG. 4; 29, the stoppers fixed to the carrier 1 likewise, which receive the recording head 2 being pressed in the direction indicated by an arrow a in FIG. 3; 11, a flexible cable to electrically connect the recording apparatus main body and the recording head 2; 11*a* and 11*b*, the positioning holes which are provided for the flexible cable 11, respectively; 30, a flexible cable pad sandwiched between the flexible cable 11 and carrier 1 to support the flexible cable 11 resiliently; 30*a* and 30*b*, the positioning holes provided for the flexible cable pad 30, respectively; 30*c*, an ink barrier which blocks any ingression of ink into the contact unit; 31, the head contact unit provided for the recording head 2, which is connected to the heater (electrothermal transducer) unit in the recording head 2; 31*a* and 31*b*, the positioning holes provided for the head contact unit 31, respectively; and 31*c*, the stopper abutting parts where the ends of stoppers 29 abut upon, respectively.

The recording head 2 is pressed in the direction indicated by the arrow a in FIG. 3 by the biasing force of the head holder spring 25 shown in FIG. 2 through a lever which is not shown. Its position is uniformly set by the coupling of the positioning pins 28 and the holes provided for the recording head 2, and the intervention of the stoppers 29. In this way, the recording head 2 and carrier 1 are mechanically connected.

Also, there are provided a plurality of electrical contacts in the facing positions at the ends of the head contact unit 31 provided for the recording head 2 and the flexible cable 11. By pressing them with a given pressure, the recording apparatus main body and the recording head 2 are electrically connected. At this juncture, it is necessary to press a plurality of the electrical contacts at a time for connection. Thus the flexible cable pad 30 made of a resilient material is provided for the pressing section in order to press them evenly for connection. As the material for the flexible cable pad 30, a silicon rubber is used, for example. A plurality of extrusions are formed in the positions corresponding to those of the foregoing electrical contacts. With this arrangement, it is made possible to concentrate the stress of the pressure on the contacts. Also, it may be possible to configure the aforesaid electrical contacts provided for the flexible cable 11 in the form of extrusions so that the stress created by the pressure is concentrated still more to assure the connection reliably.

Also, it is arranged to make the reaction force to be generated by the pressure on the electrical contacts far less than the force of the head holder spring 25 which depresses the recording head 2. Therefore, there is no possibility that the recording head 2 is displaced due to the reaction force of the flexible cable pad 30.

Also, there is a need for positioning the carrier 1, flexible cable pad 30, flexible cable 11, head contact unit 31, and head cartridge 4 accurately to each other in order to assure electrical connection and obtain a good recording quality. With this in view, the arrangement is made as given below.

In other words, the two positioning pins 28 on the carrier 1 serve as fiducial points, one of the positioning pins 28*a* fits in the positioning holes 30*a*, 11*a*, and 31*a* through each of them, and the other one of the positioning pins 28*b* fits in the positioning holes 30*b*, 11*b*, and 31*b* likewise so that the positions are set in the directions indicated by the arrows a and b in FIG. 4.

Further, by exerting a pressure so that the end faces of the stoppers 29 abut on the stopper abutting parts 31*c* of the head contact unit 31 in the direction indicated by the arrow a in FIG. 3, the position of the recording head 2 is accurately set in the direction indicated by the arrow c in FIG. 4.

Figure 5:
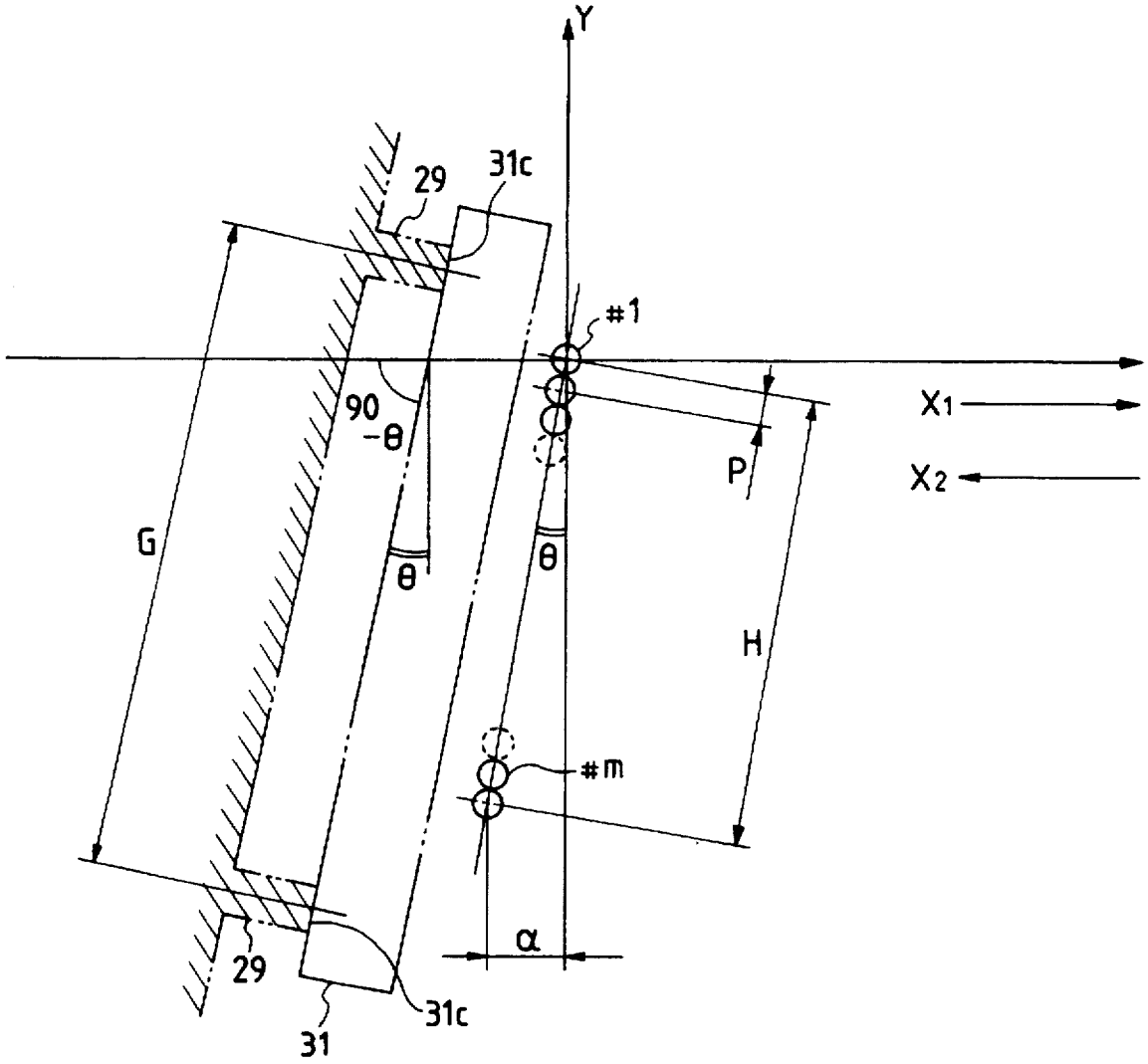
FIG. 5 is a view schematically showing a method for positioning the above-mentioned carrier unit and head cartridge unit.

Also, as shown in FIG. 5, the stoppers 29 are formed with a given inclination θ to the traveling directions X1 and X2 of the carrier 1. It is thus arranged that when the carrier 1 is positioned on the recording head 2, the nozzles (discharge ports or orifices) #1 to #m arranged at given pitches P on the recording head 2 are inclined by a given amount d against the length H of the nozzle arrangement. Also, in order to maintain the precision of the above-mentioned given amount d, the intervals G between the stoppers 29 are provided sufficiently with respect to the length H of the nozzle arrangement.

Now, the description will be made of the structure and the electric circuit of an information processing apparatus in which the ink jet recording apparatus described above is incorporated.

Figure 6:
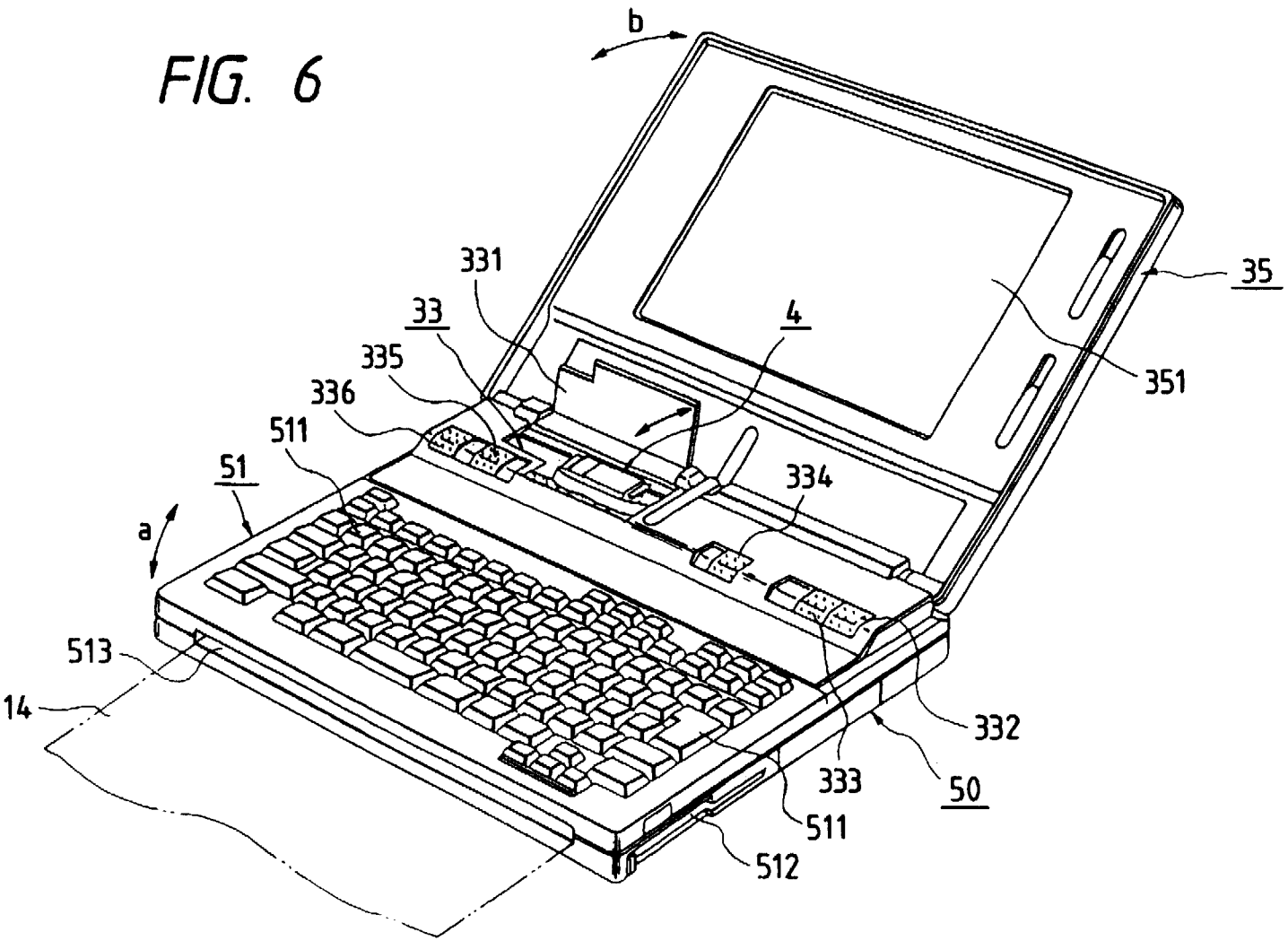
FIG. 6 is a perspective view showing an information processing apparatus in which an ink jet recording apparatus of the present invention is incorporated.

FIG. 6 is a perspective view schematically showing the external appearance of the information processing apparatus 50 in which the recording apparatus according to the present embodiment is incorporated. The information processing apparatus exemplified here is the so-called personal computer, and is a handy type which is integrally provided with the above-mentioned ink jet recording apparatus. In FIG. 6, a reference numeral 33 designates a printer unit comprising the ink jet recording apparatus described above; 51, a key board unit provided with keys 511 to input numerals, letters, and other characters as well as keys 512 to issue various instructions; and 35, a display to represent processed information, which is provided with a display screen 351.

In the printer unit 33, a window 331 is made of a transparent plastic. Through this window 331, the movement of the head cartridge 4 and others can be observed. The window 331 is arranged to be opened or closed for the ink tank exchange and other operations. Also, the keys 332 and 333, and others are arranged to give instructions independently for the recovery process, the recording sheet feeding in the printer unit, and other printer operations. In the lower part of the key board 51, an aperture 512 is arranged for floppy disc insertion or withdrawal.

The display 35 is provided rotatively in the direction indicated by an arrow b in FIG. 6 so that it can be folded to become an integrated body together with the key board 51 when the apparatus is carried around. Also, the key board 51 is arranged rotatively in the direction indicated by an arrow a in FIG. 6 when a recording sheet 14 and others are set for the printer unit 33.

Figure 7:
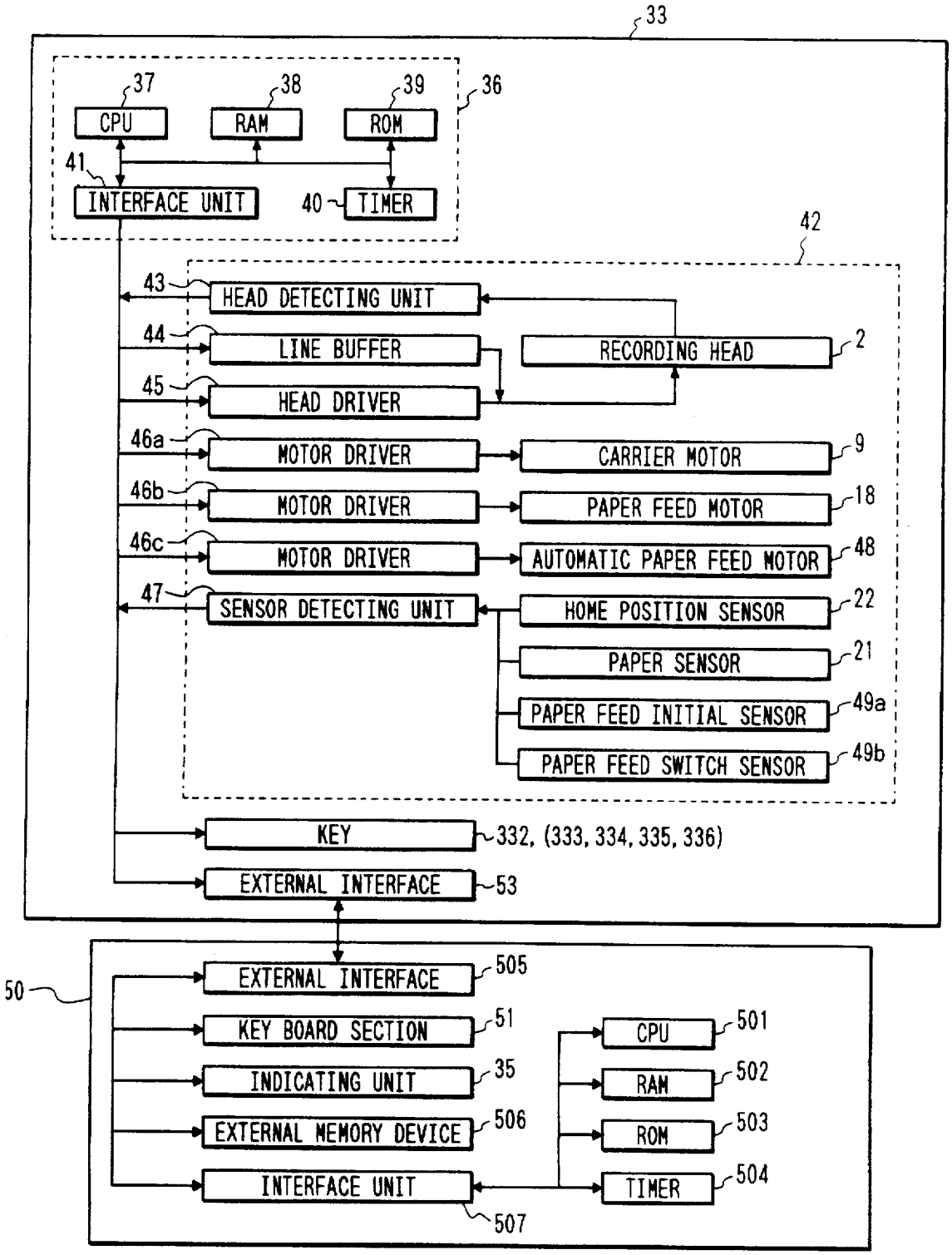
FIG. 7 is a block diagram showing the structure of a control circuit for the above-mentioned information processing apparatus.

FIG. 7 is a block diagram showing the structure of the control circuits for the above-mentioned information processing apparatus 50 and the printer unit 33.

At first, the printer unit 33 will be described. In FIG. 7, a reference numeral 36 designates a controller to execute the main control; 37, a CPU of a microcomputer mode, for example, to execute the process procedures on the printer side which will be described later; 38, a RAM for providing a work area, and others for the above-mentioned process; 39, a ROM for storing the program prepared for the above-mentioned process procedures; 40, a timer for producing a timing required for the recording operation in the printer unit 33, which has worked out an execution cycle of the CPU 37; and 41, an interface unit to connect the signals from the CPU 37 and the host apparatus.

Also, a reference numeral 42 designates a driver for the printer unit 33; 43, a head detection unit to detect the information of the recording head, such as the output value of each of the various sensors which detect the presence, absence or kind of the recording head 2, and the temperatures of the recording head 2, and the output etc. of sensors to detect the presence or absence of ink in the ink tank 3; 44, a line buffer for storing the recording data for the recording head 2; 45, a head driver to supply the driving signals and electric power to the recording head 2; 46*a*, 46*b*, and 46*c*, motor drivers for supplying the signals and electric power required to drive the carrier motor 9, spur 18, and motor 48 for automatic sheet feeding, respectively; and 47, a sensor detection unit to detect the sensor outputs of the home position sensor 22, sheet sensor 21, sheet feeding initial sensor 49*a*, sheet switching sensor 49*b* among others.

Now, in the information processing apparatus serving as the host apparatus, a CPU 501 is provided for executing the processes on the host side. A ROM 503 stores the process procedures for them and font data as well. Also, a RAM 502 has an area in which to develop text data and image data in addition to its work area.

The CPU 501 executes given representations on the screen of the display 35 while transmitting signals to or receiving them from the printer unit 33.

Further, a reference numeral 506 designates an external memory device such as an FDD, HDD, and RAM card, and 505, an external interface for communicating with other information processing apparatuses or for controlling the peripheral devices by connecting them directly to the inner bus, for example.

In this respect, although not included in the block diagram shown in FIG. 7, there is in addition a power-supply unit which supplies power to the above-mentioned control circuit. For this unit, the following is usable, for example: a rechargeable battery, disposable cells, or an AC adapter for the power-supply which is applicable when the information processing apparatus is used with its main body being in a fixed condition.

With the control circuit structured as described above, the printer unit (recording apparatus) records on a recording material (sheet) 14. Here, using a timing chart shown in FIG. 8, the discharge control of the recording head will be described briefly.

Figure 8:
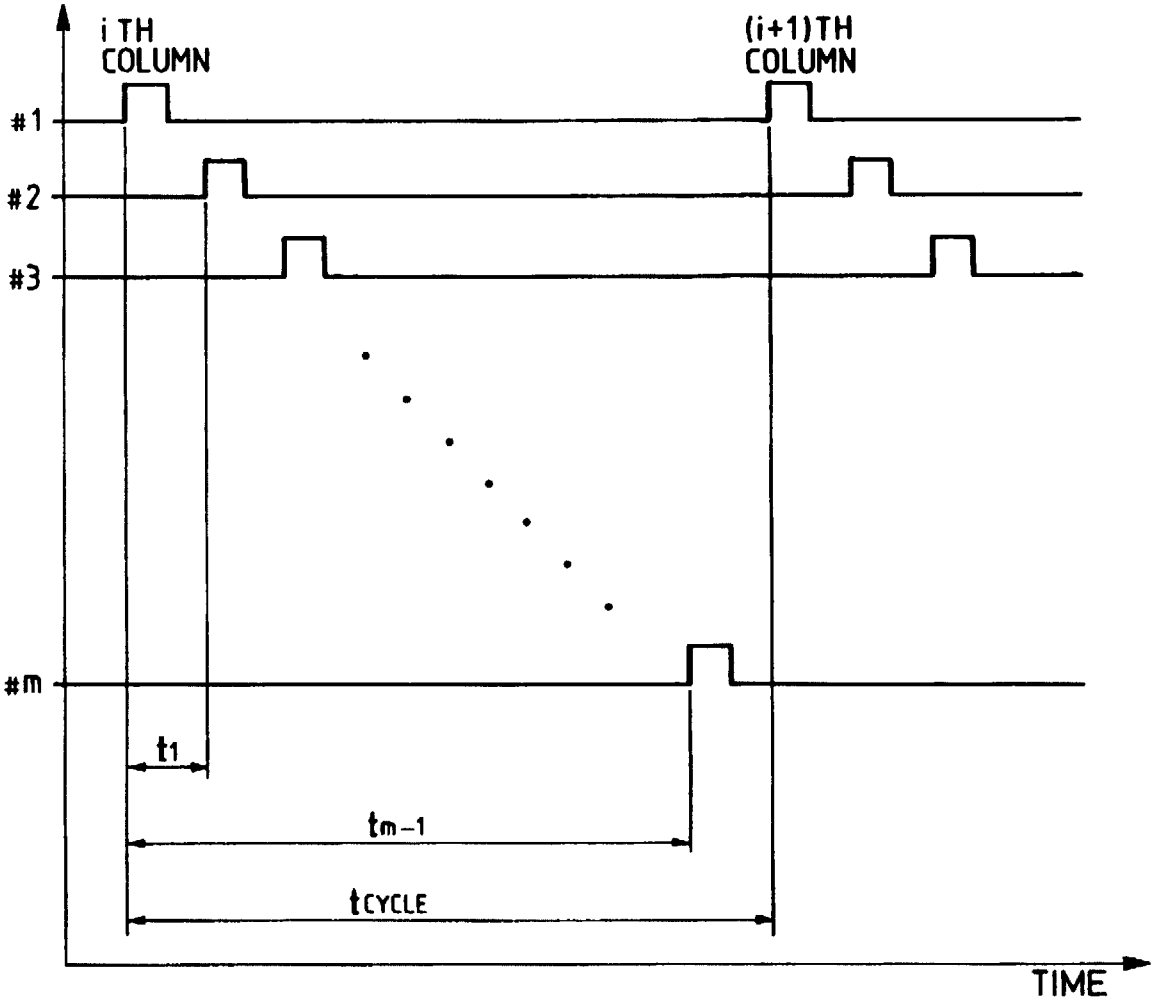
FIG. 8 is a timing chart showing the timing of the ink discharge of a recording head according to an embodiment.

FIG. 8 is a timing chart when ink is being discharged from the recording head 2 while the carrier 1 is driven to scan in the direction X1 (see FIG. 1 and FIG. 5).

The ink discharge is executed from the nozzles #1 to #m of the recording head 2 in that order. Here, the time differential between the nozzles #1 and #2 is represented by a reference mark t1; the time differential between the nozzles #1 and #m, by $t_{m-1}$; and the discharge cycle of the same nozzle, by $t_{cycle}$. Usually, it is desirable to make constant the time differential of discharges between adjacent nozzles. In other words, $t_{m-1}=(m-1)\times t_1$. Here, by executing discharges in condition that $t_{m-1}=d\times t_{cycle}/R$ while the carrier 1 is driven to scan in the direction X1 at a speed of $R/t_{cycle}$, the inclination d of the nozzles (see FIG. 5) and the time differential $t_{m-1}$ of the nozzle discharges is offset to make recording without any inclination possible.

Hereinafter, with reference to FIG. 9 to FIG. 12, the description will be made of the exchanges of recording heads and ink tanks in an ink jet recording apparatus.

Figure 9:
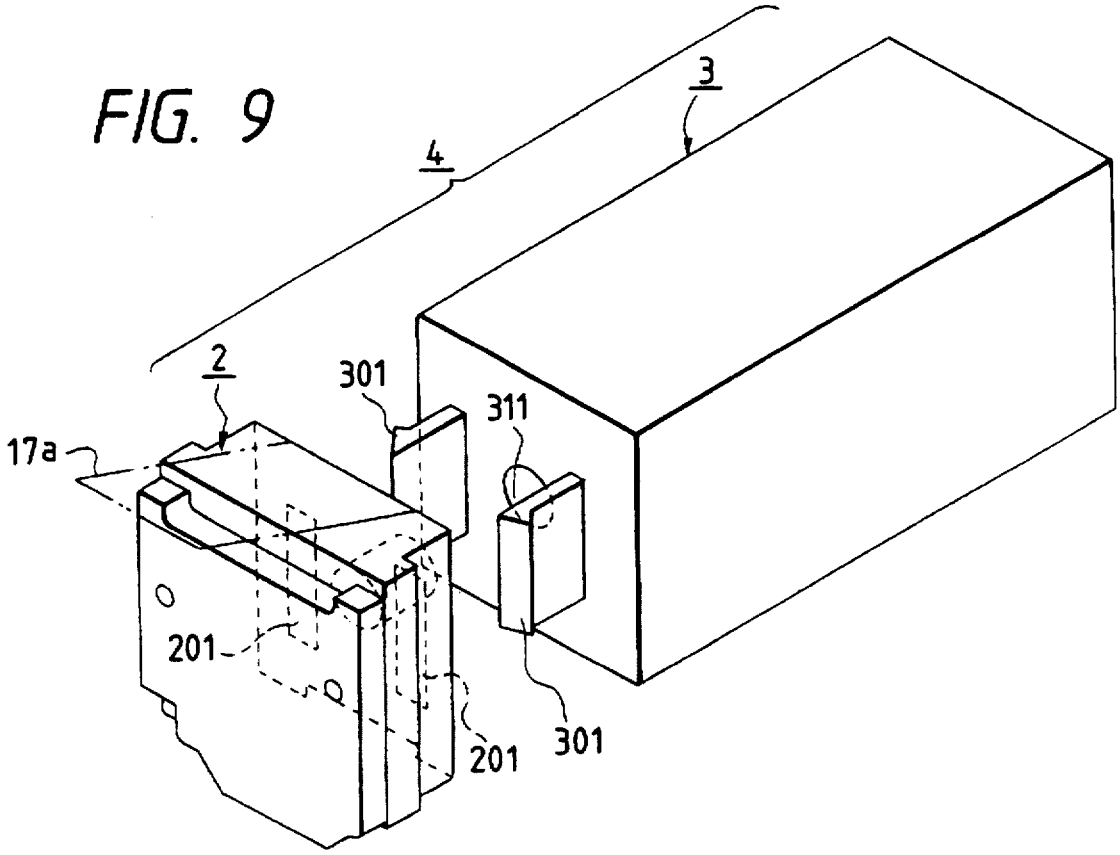
FIG. 9 is a perspective view illustrating the coupling of the recording head and ink tank in a head cartridge according to an embodiment.

FIG. 9 is a perspective view schematically showing the above-mentioned recording head and ink tank.

In FIG. 9, coupling nails 301 are arranged on the ink tank 3 side, and coupling nail guiding holes 201 are arranged on the recording head 2 side each in a position opposite to each of the coupling nails 301. A reference numeral 17 designates a head tab which is arranged to facilitate the withdrawing operation when the carrier is removed from the recording head 2. For the ink tank 3, no ink tank guiding groove is provided.

Figure 10:
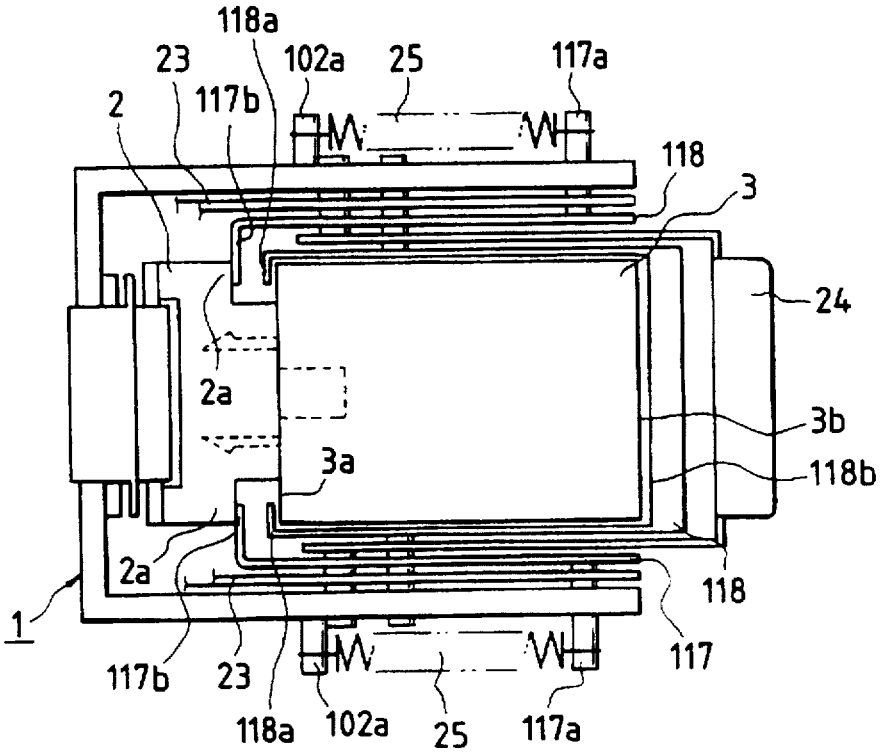
FIG. 10 is a upper plan view illustrating the coupling of the recording head and ink tank in the head cartridge according to an embodiment.

FIG. 10 is a plan view schematically showing the upper parts of the head cartridge unit and carrier unit when using the recording head and ink tank shown in FIG. 9.

In FIG. 10, a reference numeral 1 designates the carrier which is driven to scan while holding the recording head 2 and ink tank 3; 23, a head lever for holding the recording head 2, which is also used for its attachment and detachment; 24, an ink tank lever used for the attachment and detachment of the ink tank 3; and 117, a head holder for giving a bias to the recording head 2. Between the shaft 117*a* of the head holder and the shaft 102*a* of the carrier, head pressure springs 25 are tensioned. The biasing force of the head pressure springs 25 is transferred to the pressure holding parts 2*a* of the recording head through the pressing parts 117*b* of the head holder 117. Here, a reference numeral 118 designates the ink tank holder which is operated by an ink tank lever 24 to act on the ink tank to enable the ink tank to move. This holder comprises a front end action part 118*a* which acts on the ink tank end 3*a* on the recording head side, and a rear end action part 118*b* which acts on the ink tank end 3*b* on the opposite side of the recording head.

Now, the description will be made of the procedures of the recording head exchange.

Figure 11:
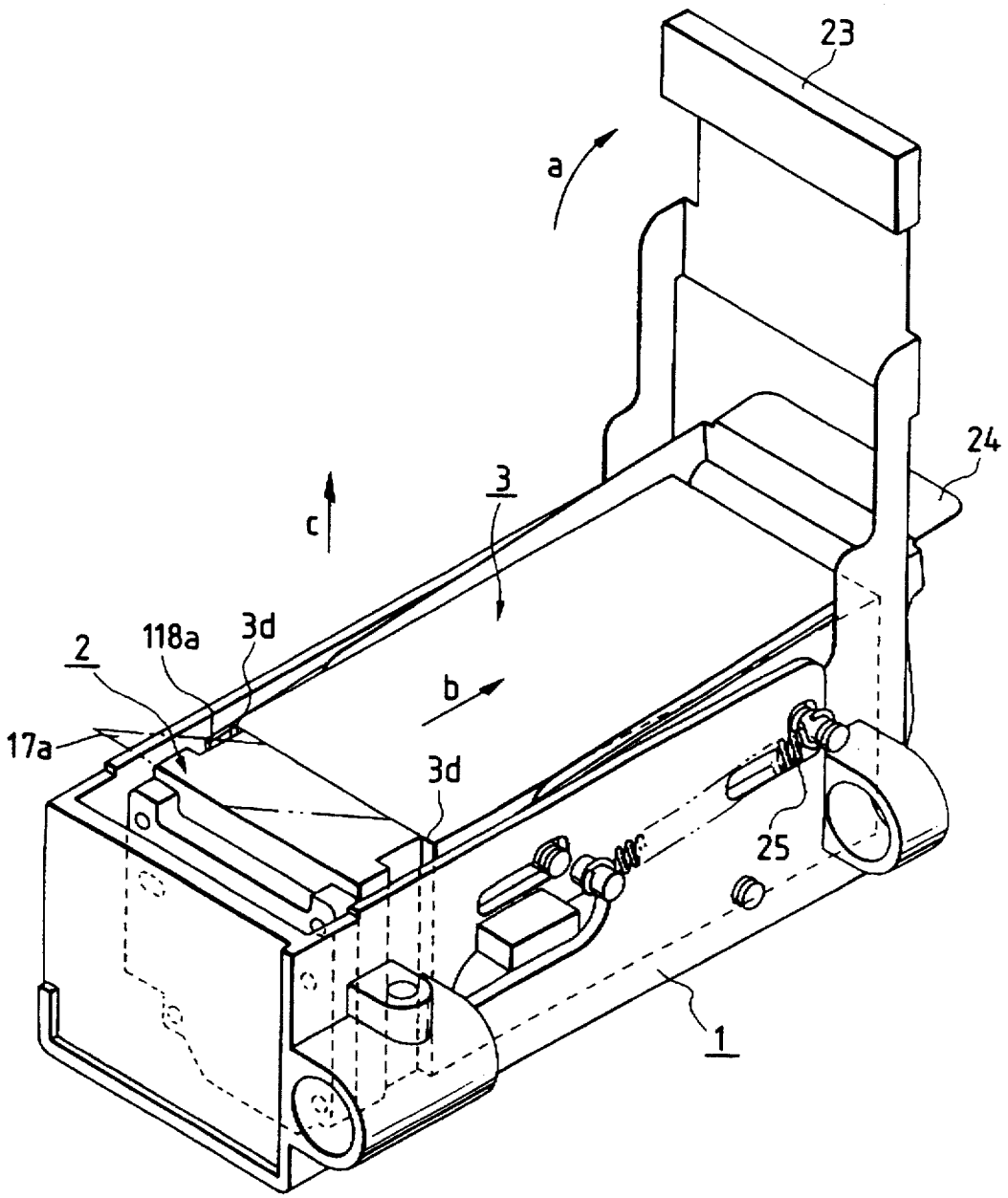
FIG. 11 and FIG. 12 are perspective views illustrating the attachment and detachment of the recording head and ink tank according to an embodiment.

FIG. 11 is a perspective view illustrating a case in which the recording head and ink tank shown in FIG. 9 are integrally removed from the carrier 1.

In this case, the head lever 23 is rotated in the direction a to stand it up in the current position as shown in FIG. 11. Then, by means of a cam provided for the head lever 23, the head holder (not shown) is caused to move in the direction b in FIG. 11 thereby to release the pressure to the recording head 2 exerted by the head pressing springs 25 which press the recording head 2 through the head holder. Also, the head lever 23 causes the ink tank holder 118 to move in the direction b. At this juncture, since the front end action part 118*a* of the ink tank holder 118 moves while being coupled to the end 3*a* of the ink tank 3 on the recording head side, the recording head 2 and ink tank 3 shift together in the direction b in FIG. 11. In this state, the recording head 2 and ink tank 3 can shift together in the direction c in FIG. 11. As a result, by picking up the head tab 17*a* provide for the recording head 2, it is possible to remove them from the carrier, thus enabling the carrier to be in an off-carrier state. Also, by the operation to be carried out in the reverse order, it is possible to connect the recording head 2 and ink tank 3, and hold them in the carrier 1.

Now, the procedures of ink tank exchange will be described.

Figure 12:
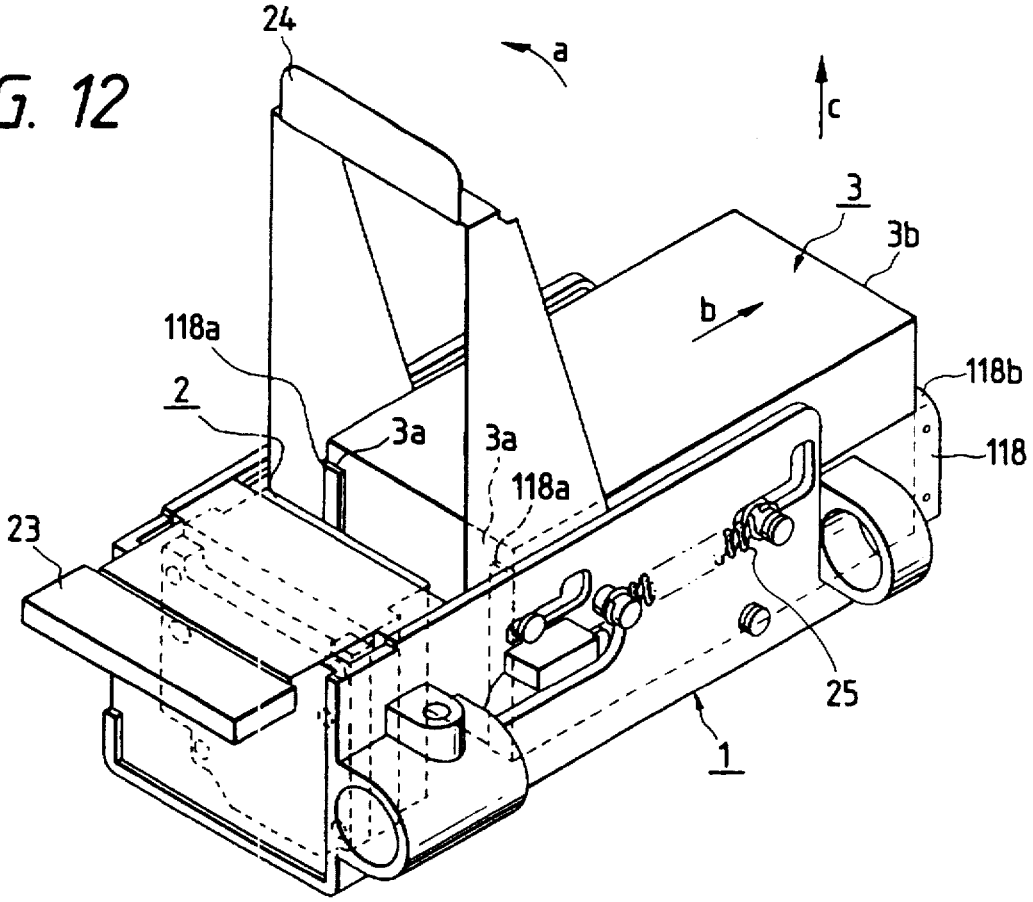

FIG. 12 is a perspective view illustrating a case that the recording head and ink tank are separated on the carrier shown in FIG. 9.

In this case, the tank lever 24 is rotated in the direction a to a given position shown in FIG. 12. Then, although the cam provided for the tank lever 24 causes the ink tank holder 118 in the direction b in FIG. 12, the head holder 117 does not move. Thus, the head pressing springs 25 are still in a state to press the recording head 2. At this juncture, since the front end action part 118*a* of the ink tank holder 118 moves while being coupled to the end 3*a* of the ink tank 3 on the recording head side, the ink tank 3 is allowed to release the engagement with the recording head 2, and to move in the direction b in FIG. 12. In this state, the ink tank 3 can move in the direction c in FIG. 12. Therefore, by raising the ink tank to remove it from the carrier, it is possible to set the carrier In the off-carrier state. On the contrary, by mounting the ink tank 3 on the ink tank holder 118 and rotating the tank lever 24 in the direction opposite to the direction a in FIG. 12, the cam provided for the tank lever 24 enables the ink tank holder 118 to move in the direction opposite to the direction b in FIG. 12. At this juncture, the rear end action part 118*b* of the ink tank holder 118 moves while being coupled to the end 3*b* of the ink tank 3 on the other side of the recording head. As a result, the ink tank 3 moves in the direction opposite to the direction b in FIG. 12 to engage with the recording head 2. With the operation described above, it is possible to connect and hold the ink tank 3.

Hereinafter, with reference to flowcharts shown in FIG. 13 to FIG. 26, the description will be made of the processes in the above-mentioned printer unit 33, namely, an ink jet recording apparatus.

Figure 13:
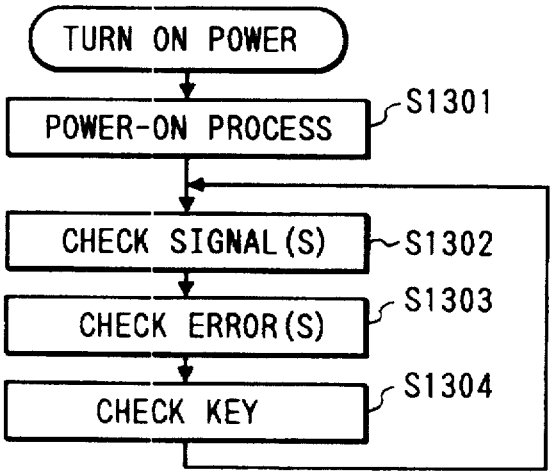
FIGS. 13, 14, 15, 16, 17, 18, 19, 20, 21, 22, 23, 24, 25, and 26 are flowcharts showing the process procedures in an embodiment according to the present invention.

FIG. 13 is a flowchart showing the outline of the processes after the power-supply is turned on for the printer unit 33.

When the power-supply is turned on, a given "power-on" process is executed in step S1301. Then in steps S1302, S1303, and S1304, the processes of "signal check", "error check", and "key check" are executed in that order. As far as the power-supply of the printer unit 33 is turned on, these three processes will be repeated.

Figure 14:
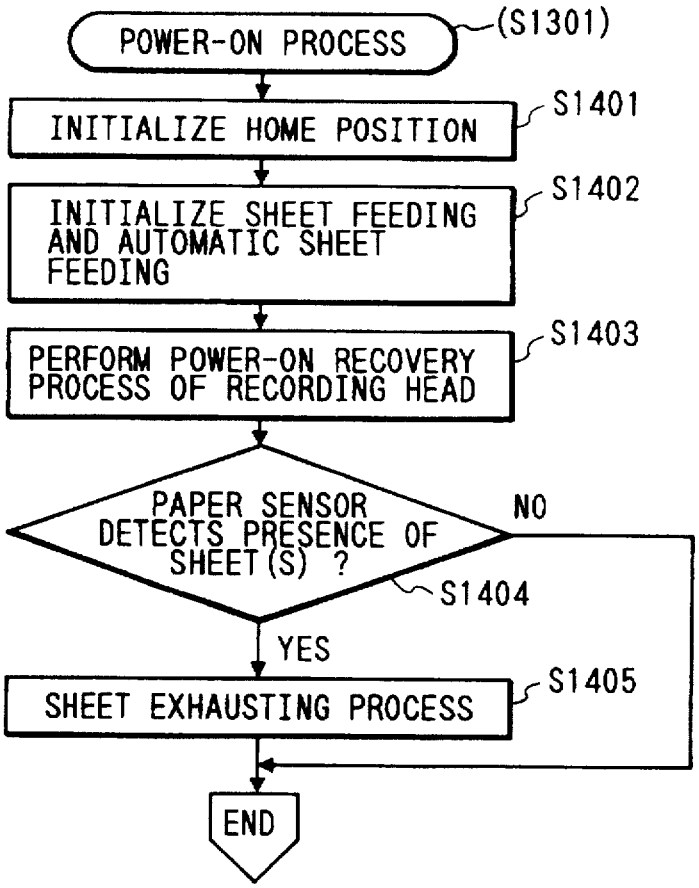

FIG. 14 is a flowchart showing the procedures of the above-mentioned "power-on" process.

When the process is actuated, the carrier 1 travels in step S1401 so that the home position is initialized in accordance with the signal which detects the home position 22. Then, in step S1402, the sheet feeding or the feed amount data and others in the automatic sheet feeding are initialized. In step S1403, the "power-on" recovery for the recording head will be executed. This process is performed in such a manner that the recording head 2 is driven to reach the capping position, and then, after a predischarge, the discharge port surface of the recording head 2 is being wiped while the recording head 2 and a blade move correlatively; hence capping the recording head 2 to complete the process.

In the next step S1404, it is determined whether or not the sheet sensor has detected the presence of a sheet. If affirmative, the recording sheet which still remains on the feeding path is exhausted in step S1405. If negative, the present process procedure will be terminated immediately.

Figure 15:
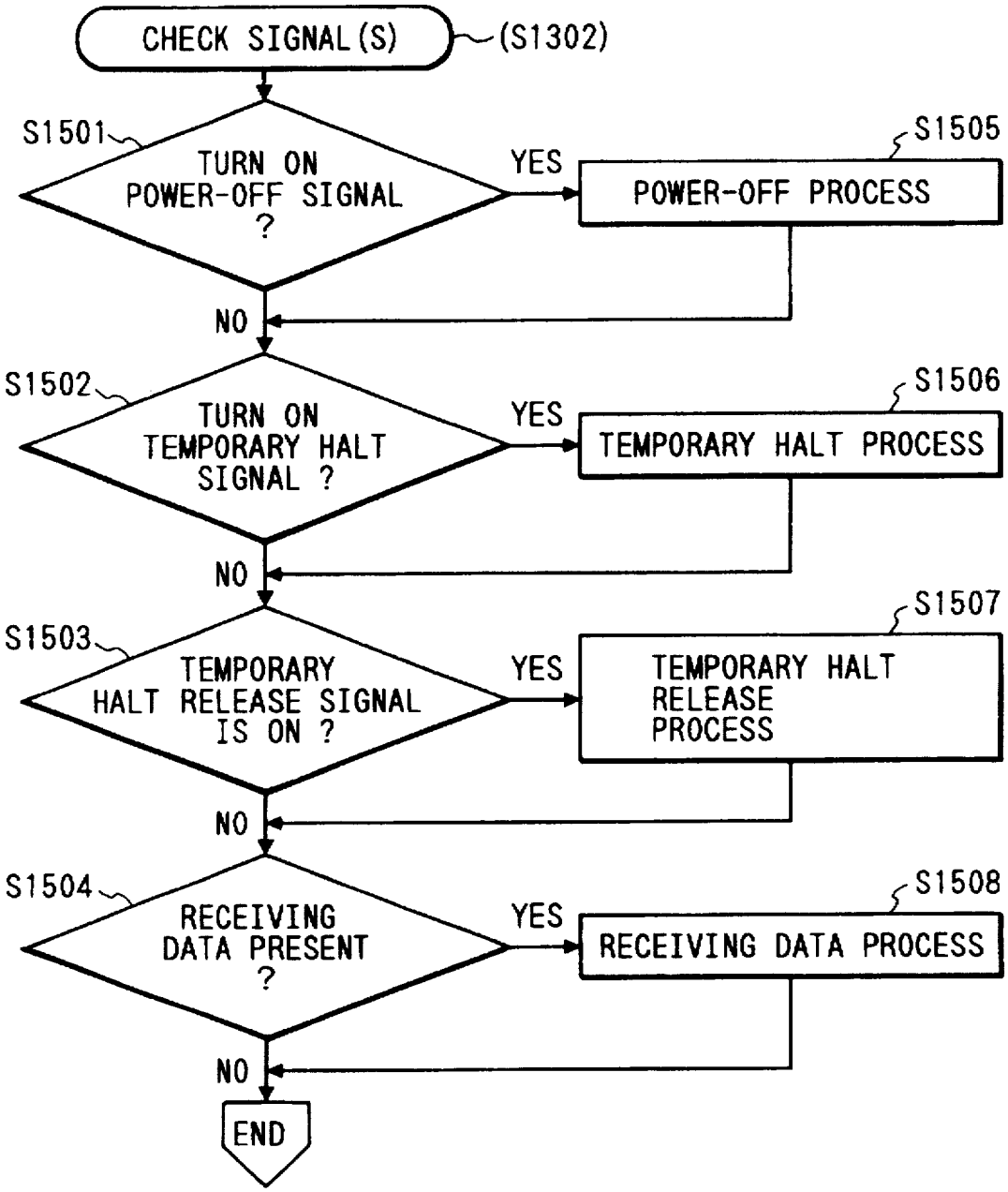

FIG. 15 is a flowchart showing the process procedure of the "signal check" represented in the step S1302 in FIG. 13. In this process procedure, each of the signals received by the printer unit 33 is monitored. Whenever a reception of any signal is detected, the step will be shifted immediately to the execution of a process corresponding to such a signal.

In other words, in steps S1501, S1502, S1503, and S1504, a power-supply off signal for the apparatus, a temporary halt signal of the recording operation, a release signal for the temporary halt signal, and the data received from the host apparatus 50 are monitored, respectively. When each of the signals or data is received, the processes "power-on", "temporary halt", "temporary halt release", and "data reception" are executed in steps S1505, S1506, S1507, and S1508, respectively.

Figure 16:
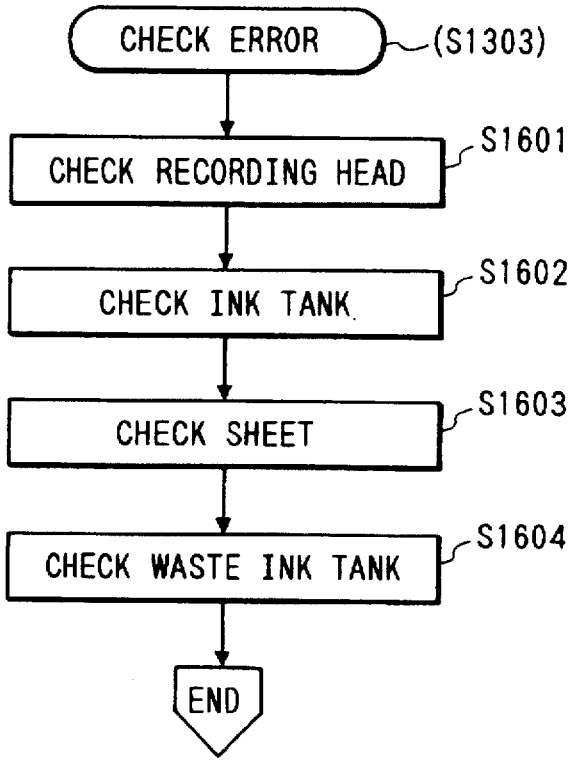

FIG. 16 is a flowchart showing the procedure of "error check" process represented in the step S1303 in FIG. 13. This process procedure is to make the various kinds of check for the recording head, ink tank, recording sheet, and waste ink tank, respectively.

At first, in step S1601, the recording head is checked such as to confirm whether or not the recording head 2 is installed on the carrier 1, and to read out the data such as the kind and discharge characteristics of the recording head installed. In step S1602, the ink tank is checked such as to confirm whether or not the ink tank is installed, to detect the amount of ink remaining in the ink tank, and to identify the kinds of ink. Further in step S1603, the recording sheet is checked as to confirm whether or not the recording sheet is present. Then in step S1604, the amount of waste ink in the waste ink tank is checked, which will be described later.

Figure 17:
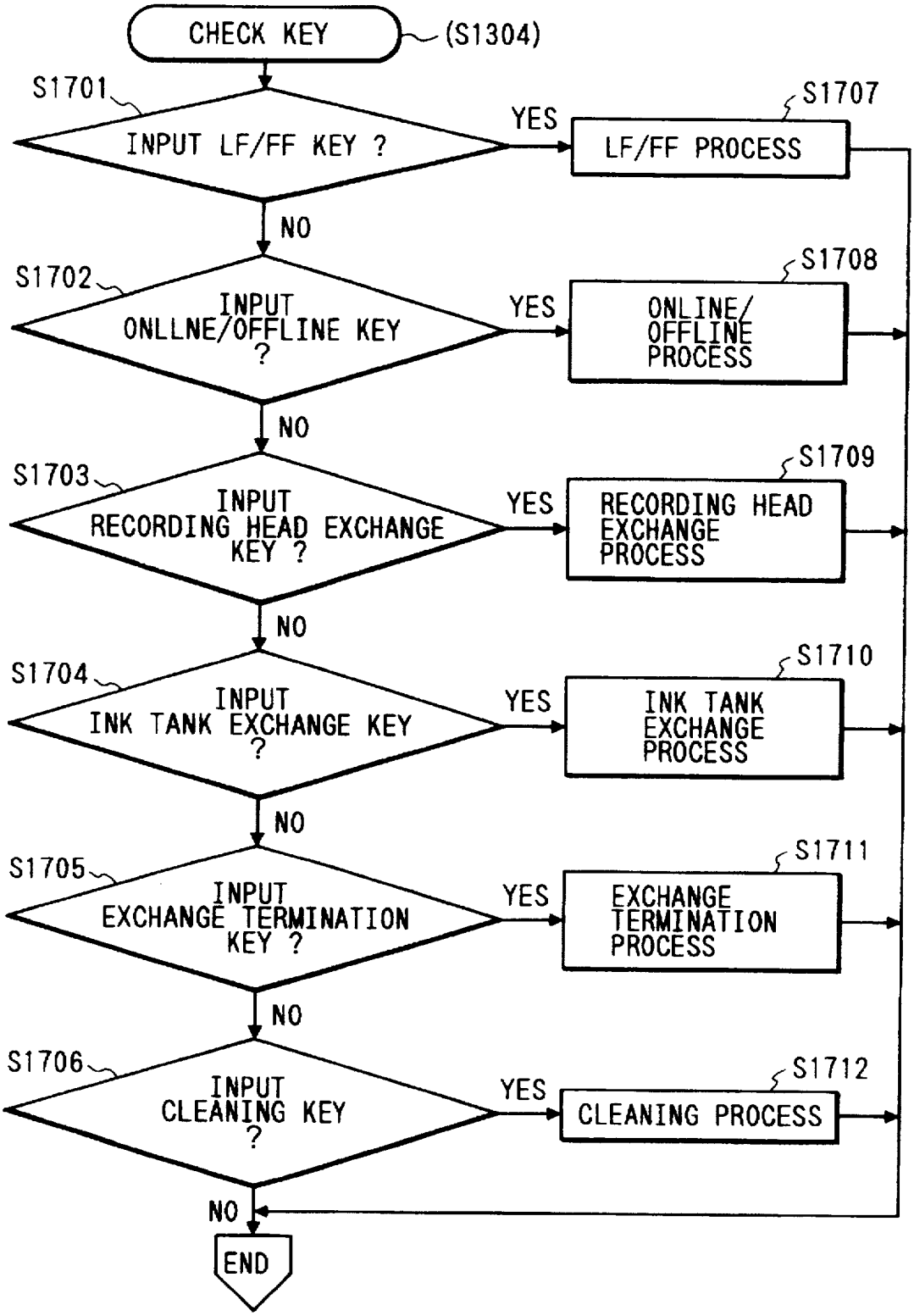

FIG. 17 is a flowchart showing the procedure of "key check" process represented in the step S1304 in FIG. 13. This process procedure is to monitor the key inputs by each of the keys 332 to 336 for various operations of the printer unit 33. When a key input is detected, the step will be shifted immediately to the execution of a process corresponding to the input through that particular key.

In other words, the inputs from the "LF/FF key" for the recording sheet feeding, the "ONLINE/OFFLINE key" for connection to receive signals from the host apparatus 50, the "recording head exchange key", "ink tank exchange key", "exchange completion key", and "cleaning key" are monitored, respectively, in steps S1701, S1702, S1703, S1704, S1705, and S1706. When any one of the key inputs is detected, the process corresponding to such an input will be executed in steps S1707, S1708, S1709, S1710, S1711, and S1712, respectively.

Figure 18:
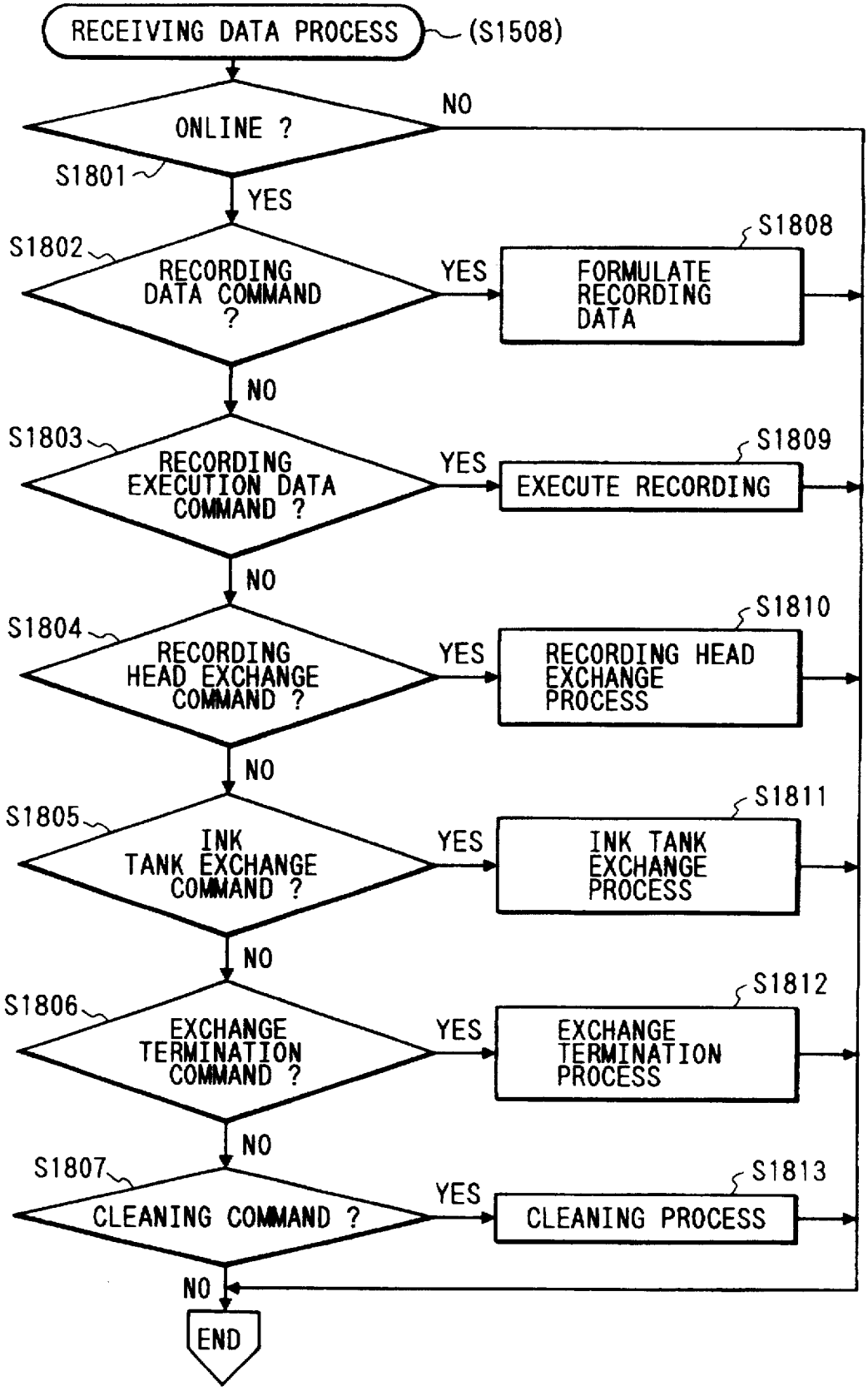

FIG. 18 is a detailed flowchart showing the processes of "receiving data" (represented in the step S1508) of the "signal check process" shown in FIG. 15. This process procedure is actuated only when there is any receiving data from the host apparatus, which, of course, include the recording operation to be executed by the printer unit 33, and the recording head exchange process and others to be executed by the user while observing the display screen 351 of the host apparatus 50, which will be described later.

At first, in step S1801, whether or not the printer unit is on-line state with the host apparatus 50 is determined. If negative, this process procedure is immediately terminated. If affirmative, whether or not the data currently received are command for the formation of recording data is determined in step S1802. If affirmative, data for recording head driving are formed in accordance with the recording data being received from the host apparatus 50.

In the step S1802, if it is found that the received data are not command for the formation of recording data, whether or not the received data are command for the execution of recording is determined in step S1803. If affirmative, the "recording execution process" is carrier out in step S1809. If negative, whether or not the received data are command for the recording head exchange is determined in step S1804. If affirmative, the "recording head exchange process" is carried out in step S1810, which will be described later. If negative, whether or not the current data received are command for the ink tank exchange is determined in step S1805. If affirmative, the "ink tank exchange process" is carried out in step S1811, which will be described later. If negative in the step S1805, whether or not the current data received are command for the exchange completion process is determined in step S1806. If affirmative, the process which will be described later is carried out in step S1812. If negative, whether or not the current data received are command for the cleaning is determined in the last step S1807. If affirmative, the cleaning process is carried out in step S1813. If negative, the present process procedure will be terminated.

Figure 19:
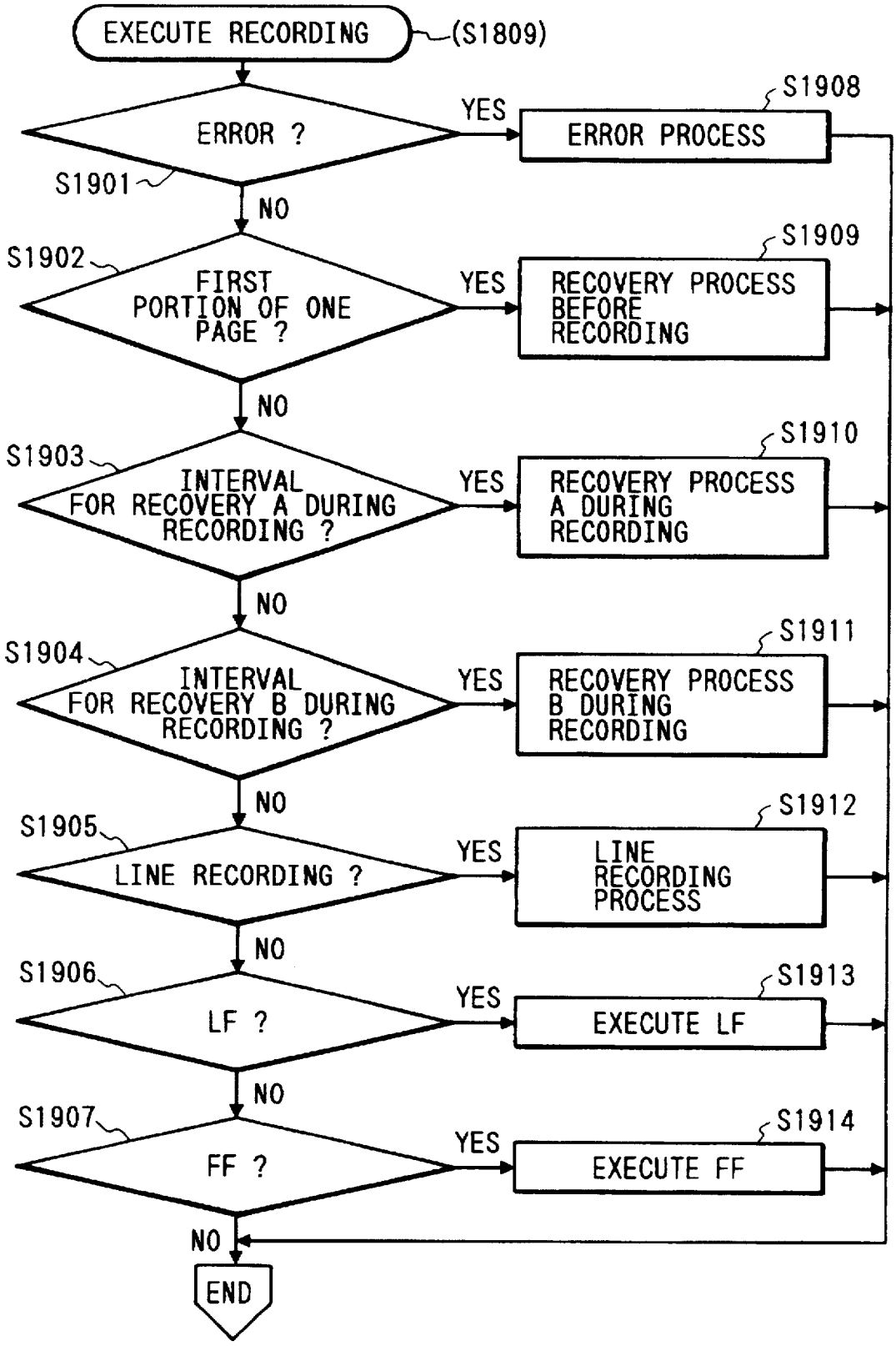

FIG. 19 is a detailed flowchart showing the "recording execution process" (represented in the step S1809) of the processes of "receiving data" shown in FIG. 18.

In the "recording execution process", whether or not any error is detected in each of the processes shown in FIG. 16 is determined in step S1901. If affirmative, a given error process is carried out in step S1908. If negative, whether or not the current recording is for the first portion of one page is determined in step S1902. If affirmative, the "recovery process before recording" is carried out in step S1909, which will be described later. If negative, it is determined in step S1903 whether or not the timing is for the recovery process A which is carried out at given intervals during recording. In the next step S1904, it is determined likewise whether or not the timing is for the recovery process B which differs from the recovery process A timing. If it is found that the timing is for each of the different processes, the discharge recovery for each process is executed in steps S1910 and S1911, respectively. In step S1905, whether or not the condition is good for a one-line recording is determined. If affirmative, the one-line portion will be recorded in step S1911 by discharging ink from the recording head 2 while the carrier 1 is driven to travel.

In step S1906, after the completion of recording or the like for the one-line portion, it is determined whether or not the condition is good enough for feeding the sheet for a portion of one-line width. If affirmative, the sheet is fed for the portion of one-line width in step S1912. Also, in step S1907, after the completion of recording or the like for the one-page portion, whether or not the sheet exhaust is possible is determined. If affirmative, the sheet exhaust will be executed in step S1913.

Figure 20:
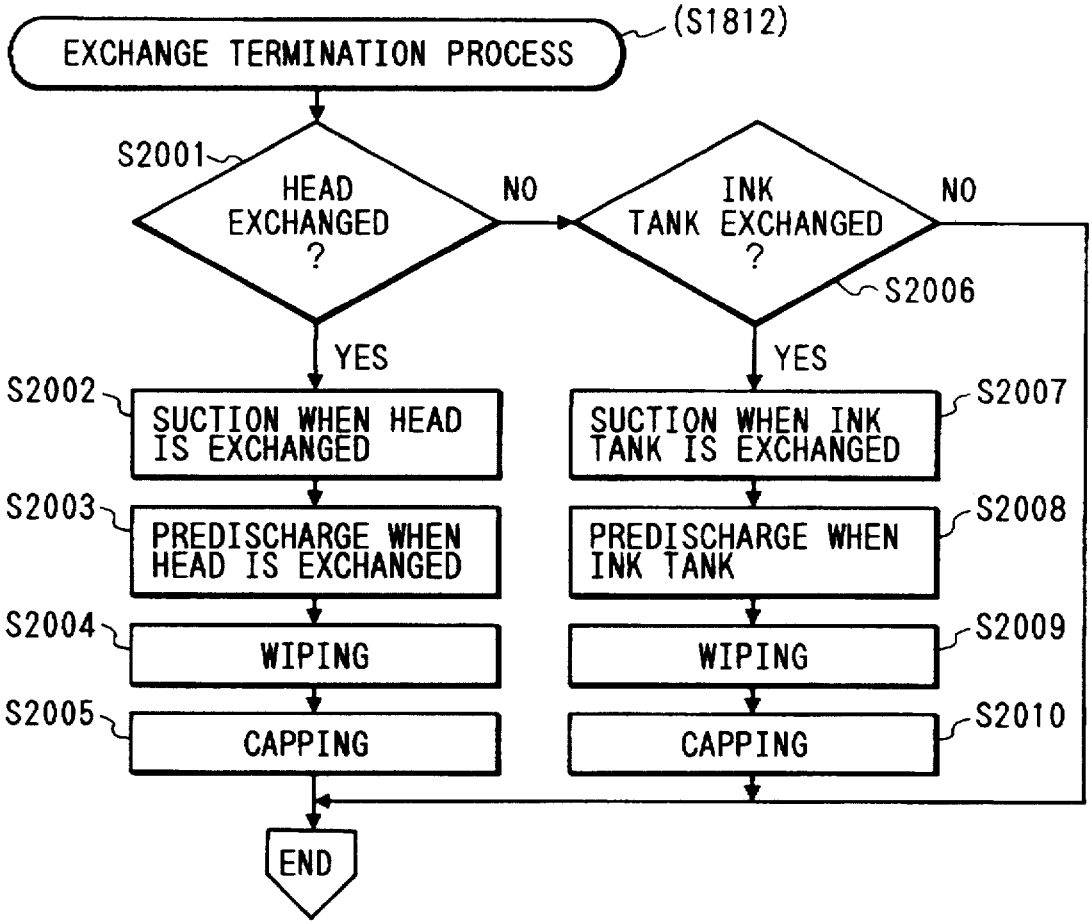

FIG. 20 is a detailed flowchart showing the "exchange termination process" in the processes of "receiving data" shown in FIG. 18. This process procedure is for one of the discharge recovery processes to be executed for the recording head 2 when the recording heads 2 or the ink tanks 3 are exchanged, which is mainly aimed at removing the air bubbles mixed into the ink supply passages and others from the connecting parts at the time of exchange.

In step S2001, whether or not recording heads are exchanged is determined at first. Then, whether or not the recording head is installed is determined according to the current status of the flag. Further, whether or not the waste ink tank overflows is determined from the result of "error check" shown in FIG. 16.

If each of the above-mentioned conditions is satisfied, a series of discharge recovery processes are executed in steps S2002 to S2005. In other words, in the steps S2002 and S2003, the recording head is capped, and the suction is made by a suction pump. After that, the cap is removed, and then, the predischarge is performed. These processes are repeated for several cycles. Then, in the step S2004, the wiping is conducted, and in the step S2005, the capping is provided, hence terminating this process procedure.

In step S2006, if it is determined that the exchanged element is an ink tank 3, the error check as to the installation of the recording head 2 and others is made as in the step S2001, and then, in steps S2007 to S2010, the discharge recovery process is executed likewise. In this process, however, the discharge recovery is slighter than that in the steps S2002 to S2005. In other words, the suction and predischarge are repeated in a smaller number of cycles.

Figure 21:
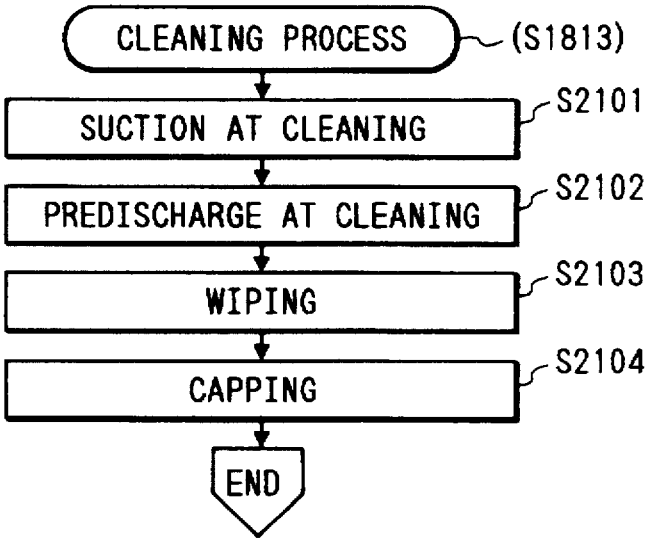

FIG. 21 is a detailed flowchart showing the "cleaning process" (represented in the step S1813) of the processes of "receiving data" shown in FIG. 18.

Also included in this procedure, processes of "suction", "predischarge", and "wiping" are executed in steps S2101 to S2103. The suction and predischarge in the present process are much smaller in terms of quantity than those executed at the time of exchange as described earlier in conjunction with FIG. 20.

Figure 22:
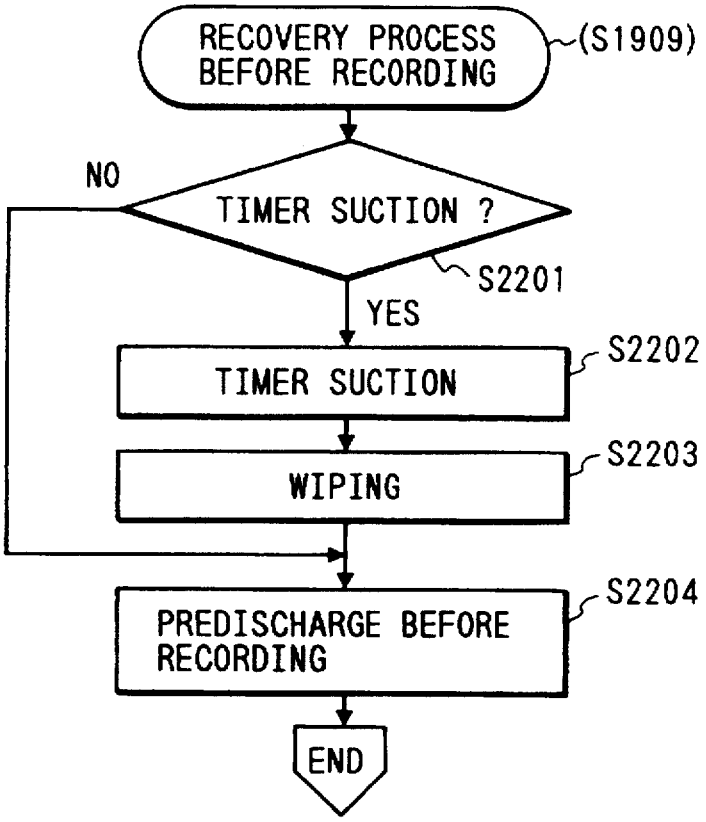

FIG. 22 is a detailed flowchart showing the "recovery process before recording" (represented in the step S1909) of the processes of "recording execution" shown in FIG. 19. At first, in step S2201, it is determined whether or not three days have elapsed since the last suction process (including any suction processes other than the present one). If affirmative, a suction process is executed for a given amount in step S2202. Then, in step S2203, a wiping is performed. These steps are required to remove any causes for a defective discharge because if the recording head is in a state that no ink is discharged for a long time, the ink becomes overly viscous or air bubbles may be mixed in ink.

If it is found that the elapsed time is not more than three days or the timer suction in the step S2203 is completed, a predischarge process before recording is executed in step S2204, thus terminating this process procedure.

Figure 23:
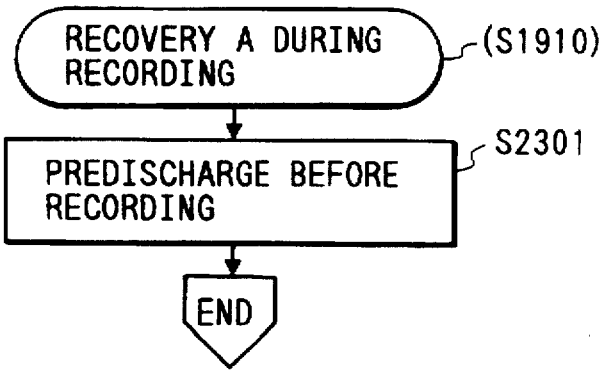
Figure 24:
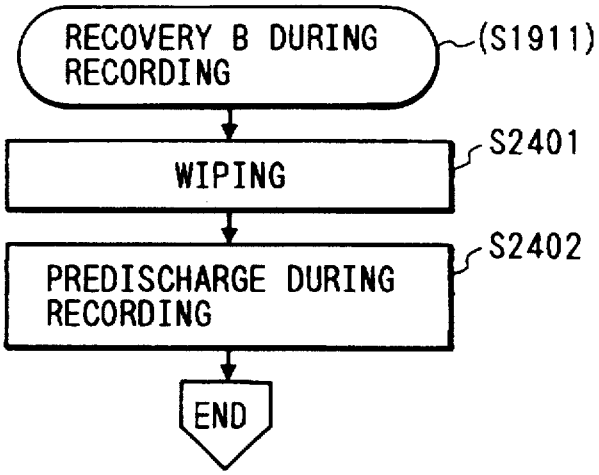

FIG. 23 is a flowchart showing the process (represented in the step S1910) "recording execution" shown in FIG. 19. This process is actuated every 12 seconds after starting a recording, and is arranged to execute a slight predischarge. FIG. 24 is a flowchart showing the "recovery process B during recording" (represented in the step S1911) shown in FIG. 19.

This process is actuated every time after the predischarge of the above-mentioned "recovery A during recording" is conducted five times. Subsequent to a wiping in step S2401, a predischarge during recording is executed in step S2402.

Figure 25:
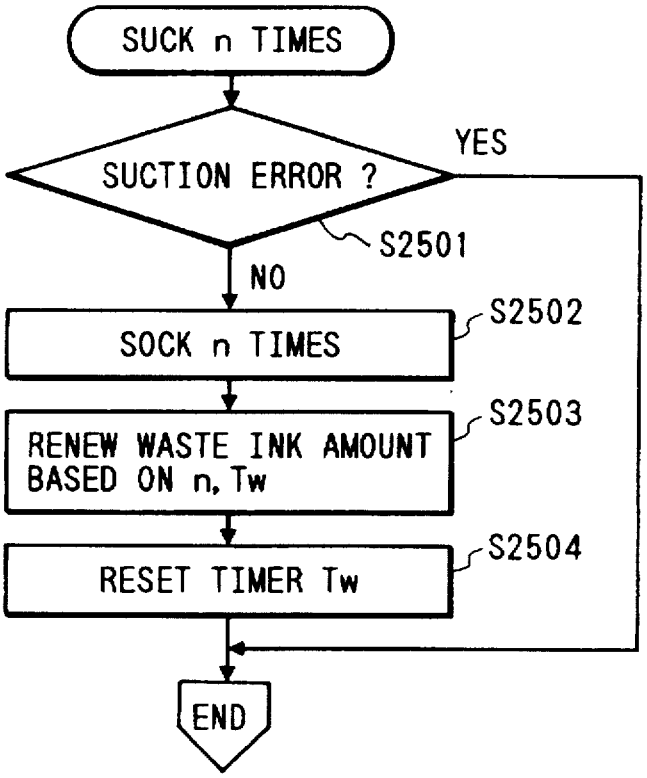
Figure 26:
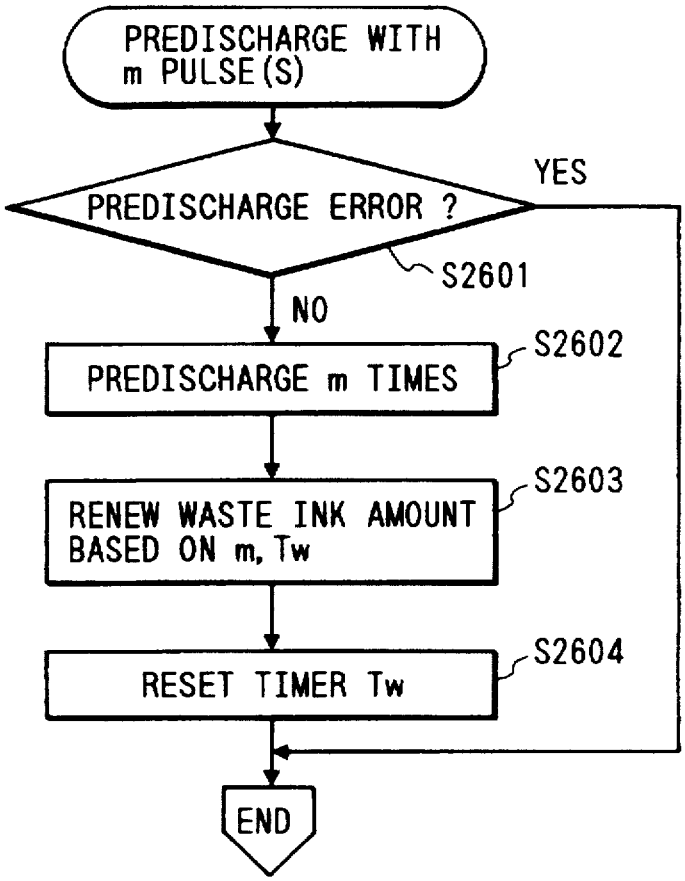

FIG. 25 and FIG. 26 are flowcharts showing further in detail the process procedures of the suction and predischarge to be executed in each of the above-mentioned processes.

When a suction or a predischarge is performed, whether or not a recording head is installed is confirmed in accordance with the error check processes shown in FIG. 16 (step S2501 or S2601). The suction or the predischarge is executed for n times or m times, respectively (step S2502 or step S2602). Then, as described later, the amount of waste ink currently retained in the waste ink tank is calculated in accordance with the amount which will be exhausted form the recording head by the suction or the predischarge, that is, (the suction amount $W_{pump}$ by one-time operation of the suction pump)×n or (the discharge amount $W_{heat}$ by one-time discharge)×m, the amount of waste ink at the time of last calculation, and the elapsed time Tw since then (step S2503 or S2603). In this respect, the required operational expressions will be described later. This calculated value is applied to making the error check on the waste ink tank shown in FIG. 16. At last, the above-mentioned elapsed time is reset (step S2504 or S2604) to terminate each of the processes.

In this respect, it may be possible to measure the amount of exhaust of the suction or predischarge directly by use of a flow meter, a gravimeter, or the like.

Now, the description will be made of an embodiment according to the present invention, in which the processes on the printer unit 33 side, which are described in conjunction with FIG. 13 to FIG. 26, are interlocked with those on the host unit 50 side. The processes thus interlocked enable the user of an information processing apparatus to execute the operation of the head exchange and others relevant to the printer unit operation while observing the information indicated on the display screen 351.

Figure 27:
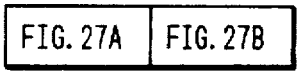
FIG. 27 is comprised of FIGS. 27A and 27B showing flowcharts of the process procedures for the host unit in a printer operation process according to an embodiment.
Figure 27A:
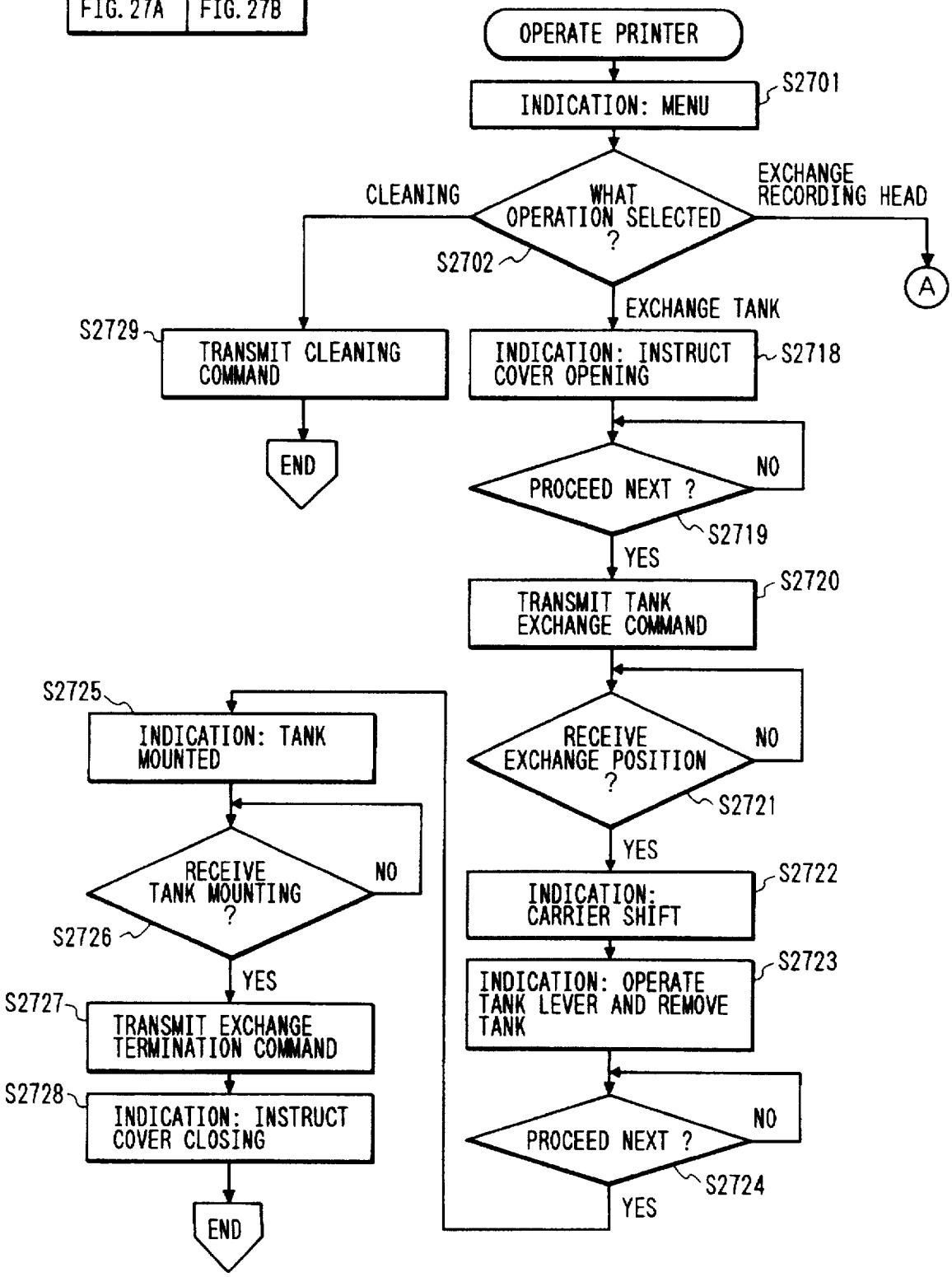
Figure 27B:
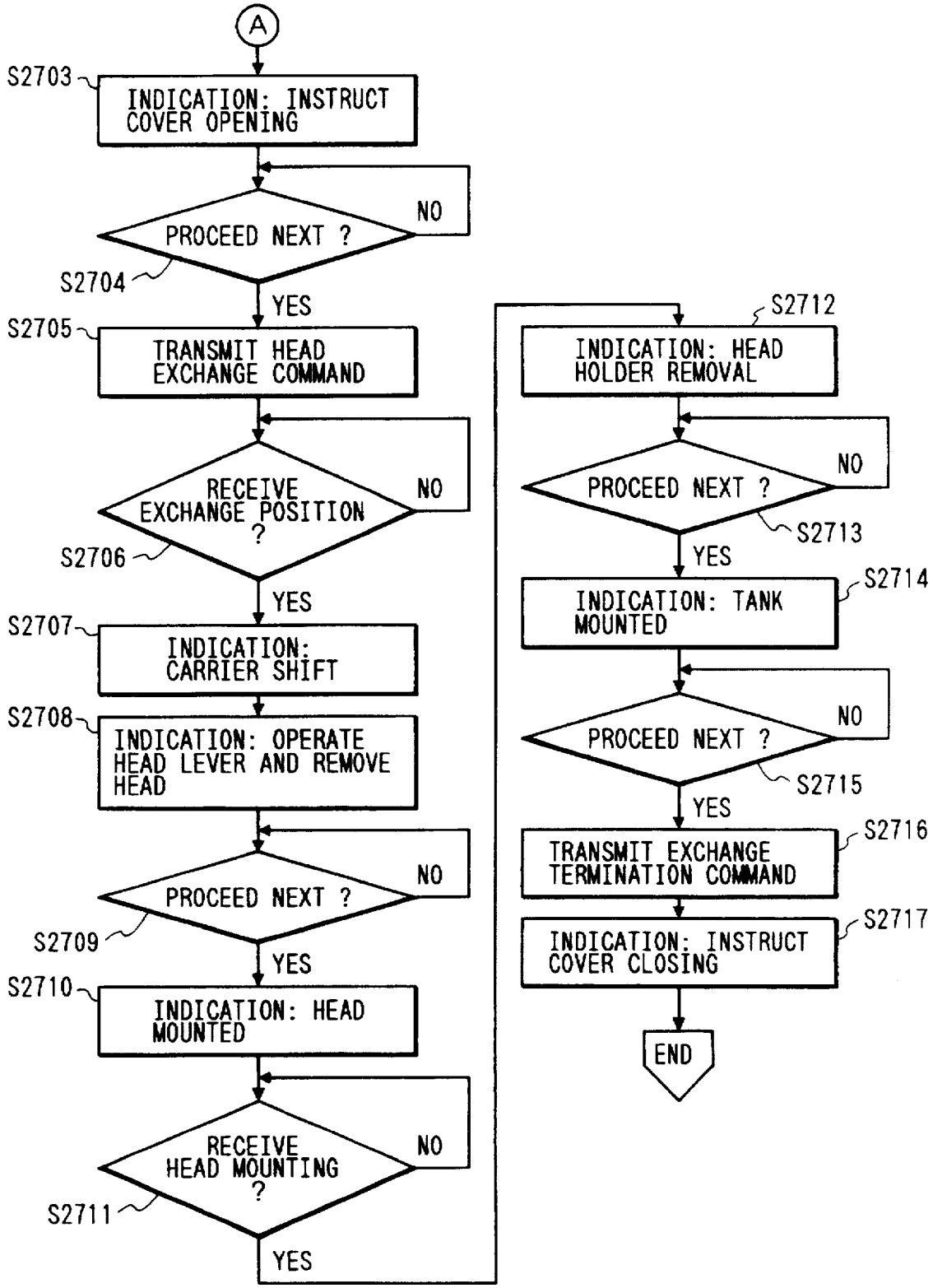
Figure 28:
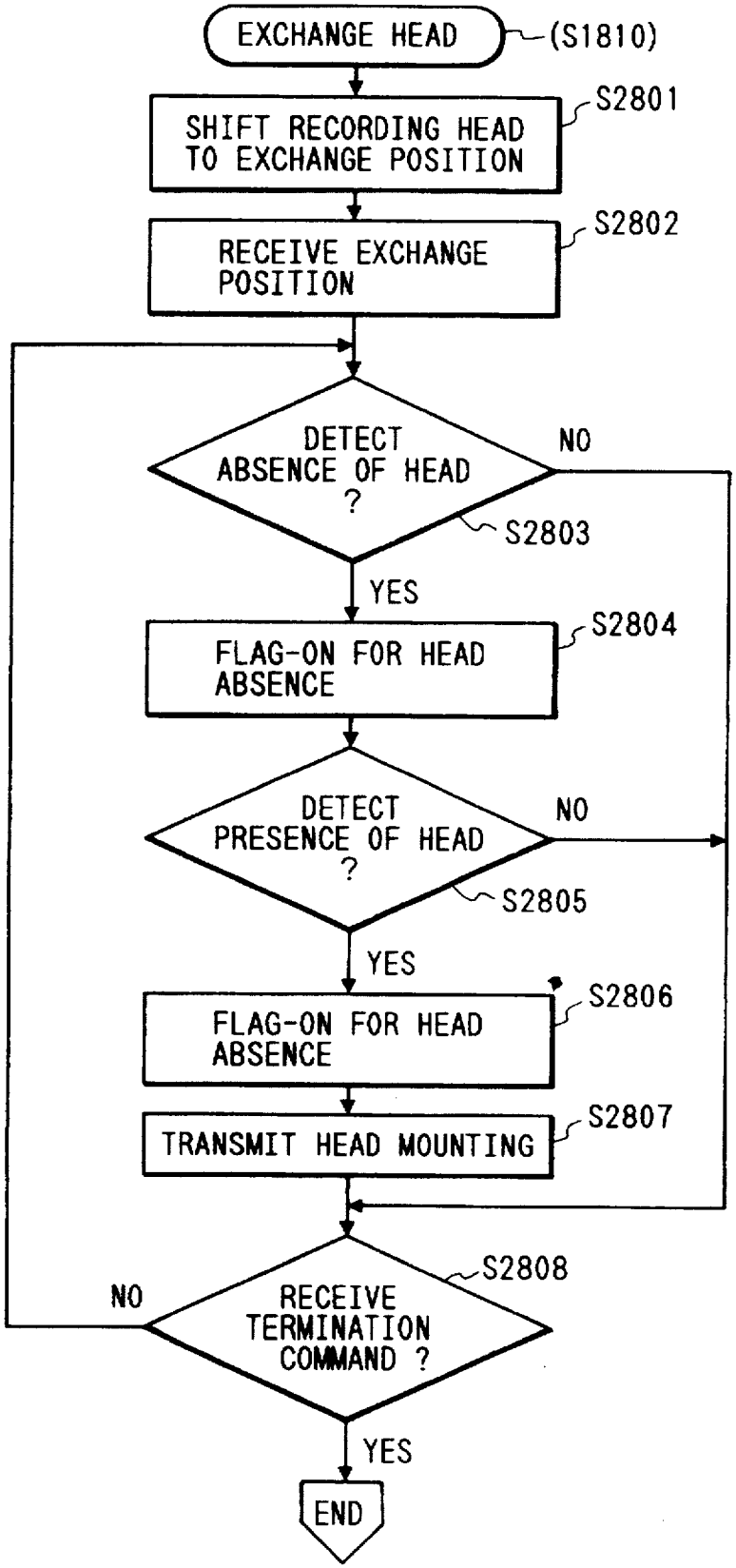
FIG. 28 and FIG. 29 are flowcharts showing the process procedures for the printer unit executing the above-mentioned printer operation process.
Figure 29:
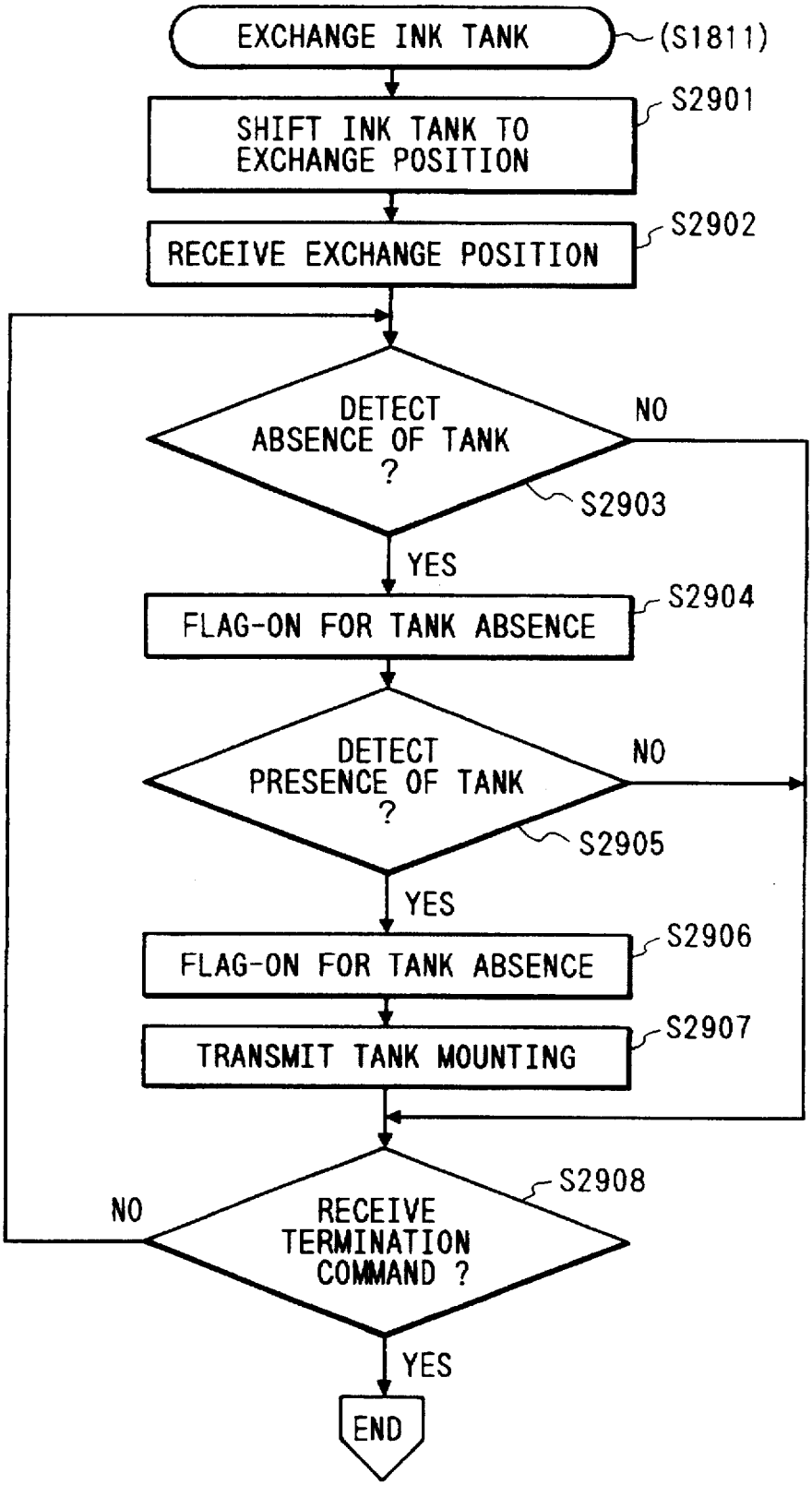

FIGS. 27A and 27B are flowcharts showing the process procedures to be executed in the host unit 50 according to the present embodiment. FIG. 28 and FIG. 29 are flowcharts showing the precess procedures to be executed in the printer unit 33 in response to the process procedures for the host unit. In this respect, the processes for the printer unit 33 represented in FIG. 28 and FIG. 29 may be shown as the "recording head exchange process" (in the step S1810) and the "ink tank exchange process" (in the step S1811) of the processes of "receiving data" shown in FIG. 18, respectively.

When the user of the information processing apparatus of the present embodiment selects the application called "printer operation", the process for the host unit 50 is actuated as shown in FIGS. 27A and 27B. In step S2701, the operational menu is indicated. While observing this indication, the user selects given keys on the keyboard 51, a mouse, or others as desired. In step S2702, the user's selection is recognized, and then, the process will proceed to step S2703 if it is recognized that the "recording head exchange" is selected, for example.

Figure 30:
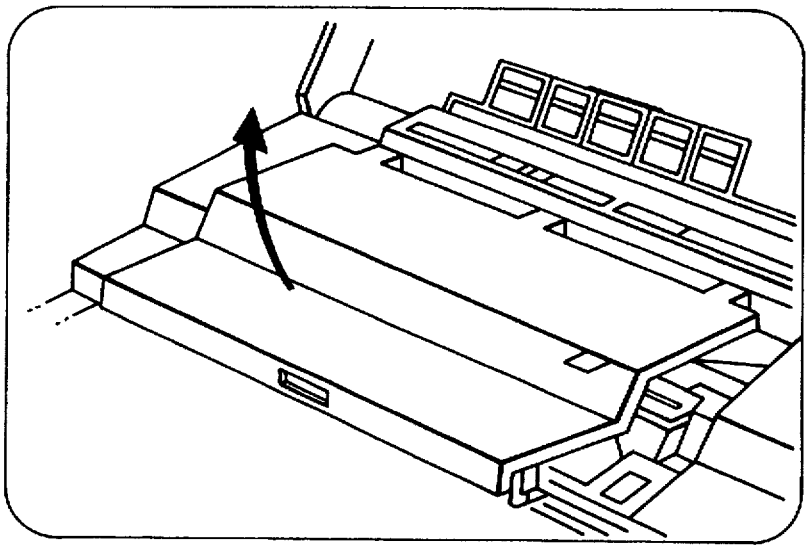
FIG. 30 is a view showing an example of representation in the foregoing printer operation process.

In step S2703, an indication that the cover 331 (window) shown in FIG. 30 should be opened, for example, is displayed on the display screen 351. The user opens the cover 331 accordingly, and then, inputs through a specific key or others that this particular operation is completed. The host unit 50 recognizes this key input or others in step S2704. The process will proceed to the next step S2705 in order to transmit a head exchange command to the printer unit 33.

The printer unit 33 receives this command. The "head exchange process" shown in FIG. 28 (corresponding to the step S1810 in FIG. 18) is then actuated. To shift the recording head 2 to the exchange position, the carrier 1 is driven to travel (step S2801). When reaching the exchange position, a signal carrying this state is transmitted to the host unit 50 (step S2802).

When the host unit 50 detects the reception of such a signal in step S2706, an indication that the carrier has arrived at the exchange position is displayed (step S2707). Then the head lever 23 is operated to display an indication to instruct that the recording head 2 should be removed (step S2708). Following this indication, the user removes the recording head and inputs the completion of this head removal through a given key or others. Then the host unit 50 recognizes such an input (step S2709), and displays an indication to instruct that a recording head 2 should be installed (step S2710).

During this period of time, the printer unit 33 detects the absence of head (step S2803) because the recording head 2 has been removed, thus turning on the no-head flag (step S2804). As far as this flag is turned on, it is interpreted that there is no head installed, and as in the step S2007 for the "exchange termination process" shown in FIG. 20, for example, any recovery process is avoided. The same is also applicable when the no tank flag is turned on in the process which will be shown in FIG. 29 next.

Then, when the user executes the installation of the recording head 2, the presence of head is detected in step S2805. The head presence flag is thus turned on, and an indication that the head has been installed is transmitted to the host unit 50 (steps S2806 and S2807).

When the host unit 50 receives this signal indicating the installation of the recording head (step S2711), an indication to instruct the removal of the head holder attached to the recording head 2 is displayed, and an indication to instruct the installation of an ink tank is displayed. The user executes each of the operations and inputs through the related keys to notify what he has done. Then the host unit transmits the exchange termination commands to the printer unit 33 (steps S2712, S2713, S2714, and S2716). After that, an indication to instruct that the cover should be closed is displayed. The present process procedures on the host unit 50 are completed. In this respect, it may be possible to omit the step S2711, and confirm the installation of the head on the display screen on the next step. The same effect is obtainable in this way.

When the exchange command is transmitted from the host unit 50, the printer unit 33 terminates the head exchange termination process (step S2808). Thus the exchange termination process represented in the step S1812 in FIG. 18 is actuated (the details of this process is shown in FIG. 20).

If it is determined that the exchange operation of ink tanks 3 is selected in the step S2702 for the processes required for the host unit 50 to execute as shown in FIGS. 27A and 27B, the same processes as above are executed in steps S2718 to S2728. Also, in the printer unit 33, the processes shown in FIG. 29 are executed likewise in response to the foregoing processes. These processes are the same as the recording head exchange process described with reference to FIGS. 27A, 27B and FIG. 28. Here, therefore, the description will be omitted.

When it is determined that a cleaning operation for the recording head 2 is selected in the step S2702, the host unit 50 transmits a cleaning command in step S2729, and then, terminates this process procedure.

In the printer unit 33, the "cleaning process" represented in the step S1813 in FIG. 18 is actuated in response to this command (the details of the cleaning process is shown in FIG. 21).

In this respect, the presence or absence (installed or yet to be installed) of the recording head and ink tank is mostly detected by the sensors in the "printer operation processes"

as described above, but it is not necessarily limited to the sensor detection. It may be possible to detect such a state by means of user's key inputs or by the application of the usual period of time required for such operations.

Figures 31, 31A:
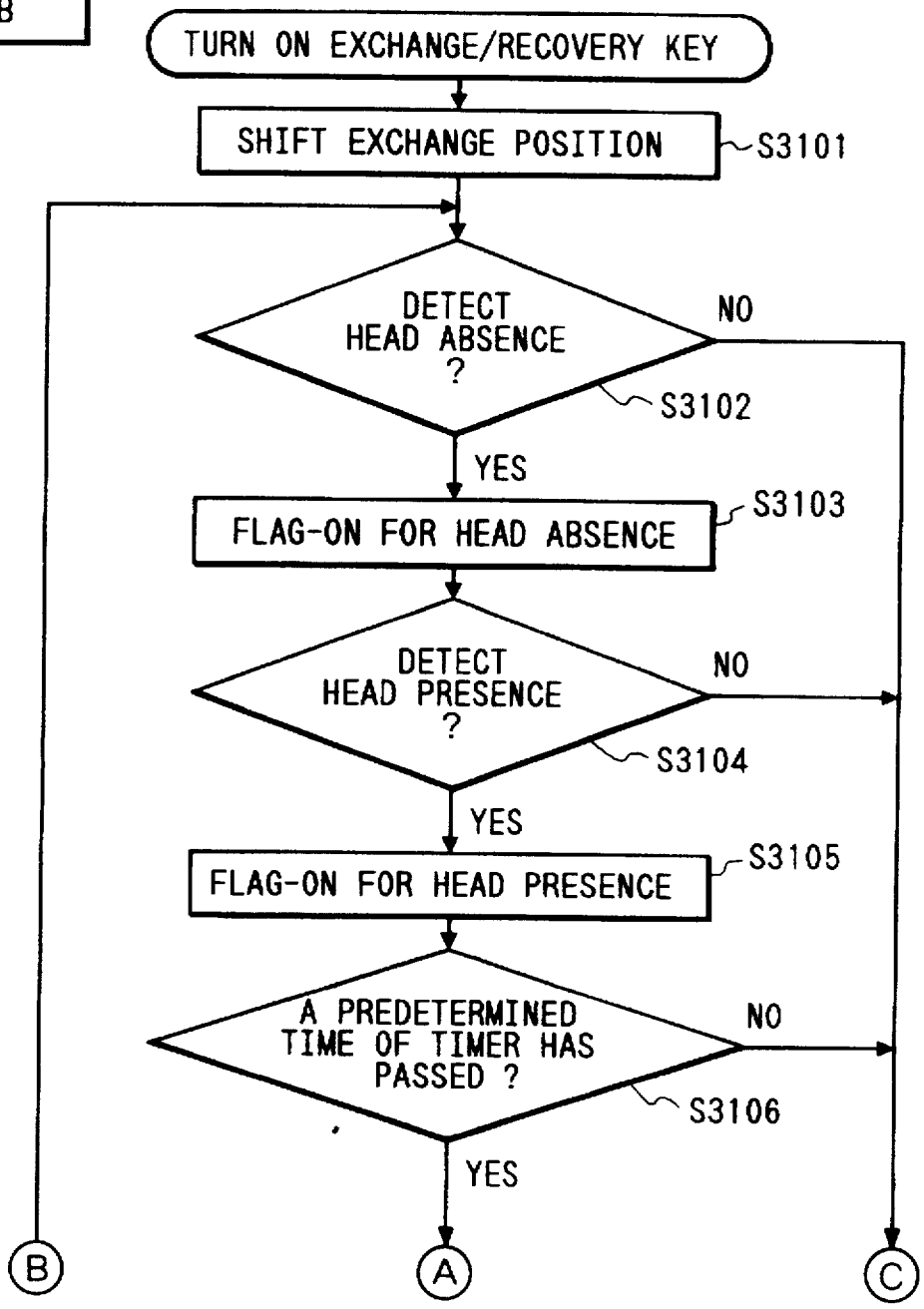
FIG. 31 is comprised of FIGS. 31A and 31B showing flowcharts of the process procedures for the printer unit own according to an embodiment.
Figure 31B:
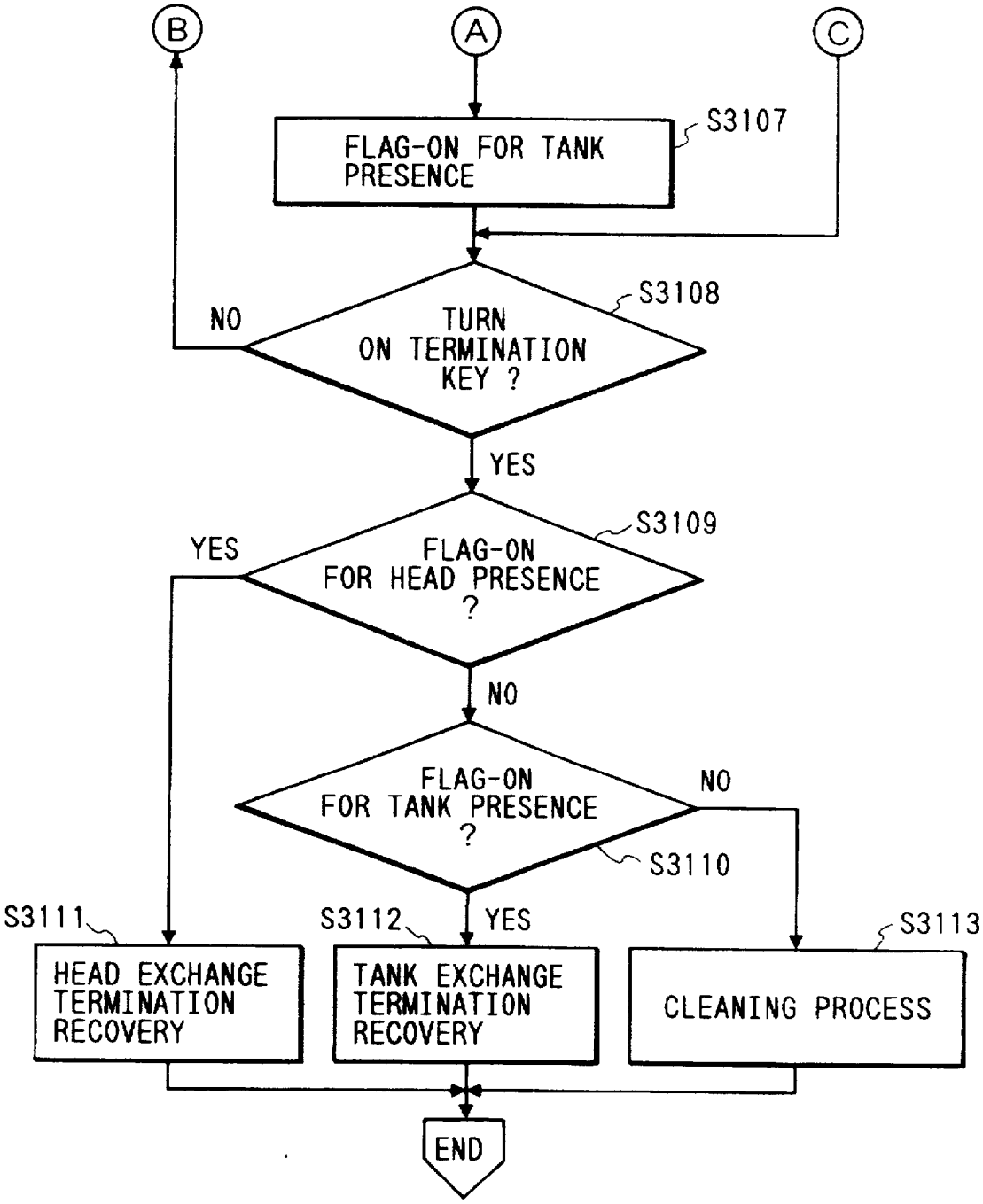

FIGS. 31A and 31B are flowcharts showing the exchange and recovery processes which are executed by the printer unit 33 itself, not interlocked with the operations of the above-mentioned host unit 50. In other words, these are the processes which are actuated when the user operates the keys 332 to 336 provided for the printer unit 33.

When this process is actuated, the carrier 1 is driven to travel to the exchanging position in step S3101. Then, along the head exchange operation by the user, the processes in step S3102 to S3105 are executed in that order. Also, in step S3106, if it is determined that a given time has elapsed since this process is actuated, it is assumed that the exchange of ink tanks is also executed, and the tank presence flag is turned on (step S3107).

If it is found that the user has inputted the termination through its key (in step S3108), either one of the head exchange termination recovery process (step S3111), the tank exchange termination recovery process (step S3112), and the cleaning process (step S3113) is executed depending on the on/off of the head presence flag and tank presence flag (step S3109 and S3110). Here, the processes in the step S3111 and S3112 correspond to the "exchange termination process" (represented in the step S1711) shown in FIG. 17. Also, the cleaning process in the step S3113 corresponds to the "cleaning process" (represented in the step S1712) shown in FIG. 17.

Now, the description will be made of an waste ink tank according to an embodiment of the present invention. The waste ink tank according to the present embodiment is capable of preventing the waste ink from overflowing despite the smaller volume of the tank by controlling the storage more severely than the conventional one.

One of the controls known conventionally is to measure only the amount of exhaust from the recording head by the recovery process. Since no consideration is given to the evaporation of the waste ink in this respect, the storage tends to be designed for a greater volume than necessary. Also, another example is such that a structure is arranged to presume a fixed rate of evaporation together with the measurement of the amount of exhausted ink, but if the recovery process is repeated in a comparatively short period of time, there are some cases that the overflow of the exhausted ink is experienced. Still another example is such that the structure is arranged to know the current storage by detecting changes in the weight of the waste ink tank, but this arrangement cannot meet changes in the posture depending on the installation site of the printer, and others. There is also a problem that the cost becomes higher or the miniaturization is hindered. The waste ink control according to the present embodiment is to solve the structural problems encountered in the conventional art.

Figure 32:
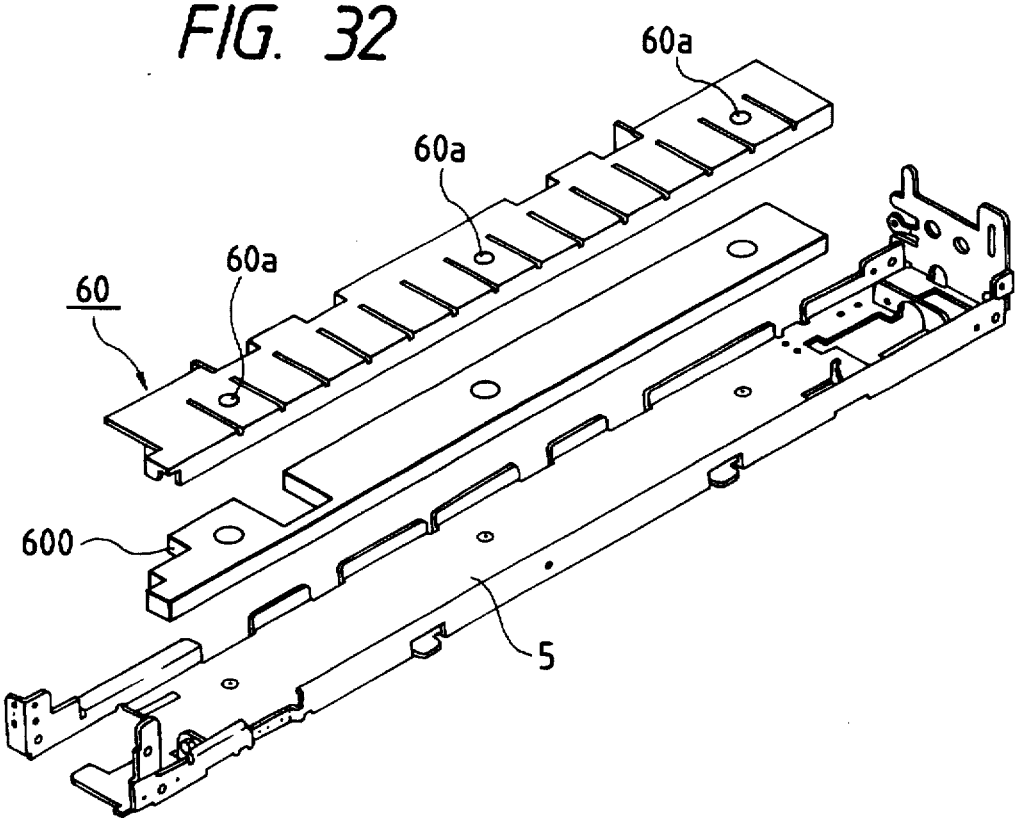
FIG. 32 is an exploded perspective view illustrating the installation of a waste ink absorbent.
Figure 33:
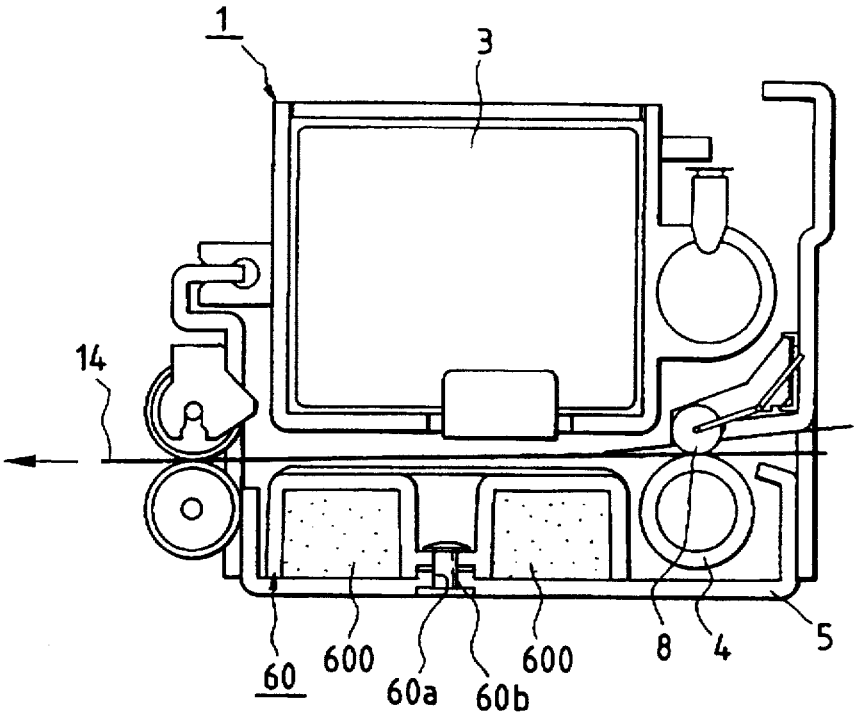
FIG. 33 is a cross-sectional view showing the state of installation of a waste ink absorbent.

FIG. 32 and FIG. 33 are an exploded perspective view and a cross-sectional view showing the waste ink storage structured at the bottom of the ink jet recording apparatus shown in FIG. 1.

As shown in FIG. 32 and FIG. 33, an ink absorbent 600 prepared by laminating ink absorbing sheets is placed on the chassis 5. Then these are covered by a cover 60. The cover 60 is fixed to the chassis 5 by means of vises **6*b* through vis holes 6*a*. The ink absorbent 600 is also fixed in this way. The absorbing capacity of the ink absorbent 600** can be minimized by the waste ink control as described below.

Figure 34:
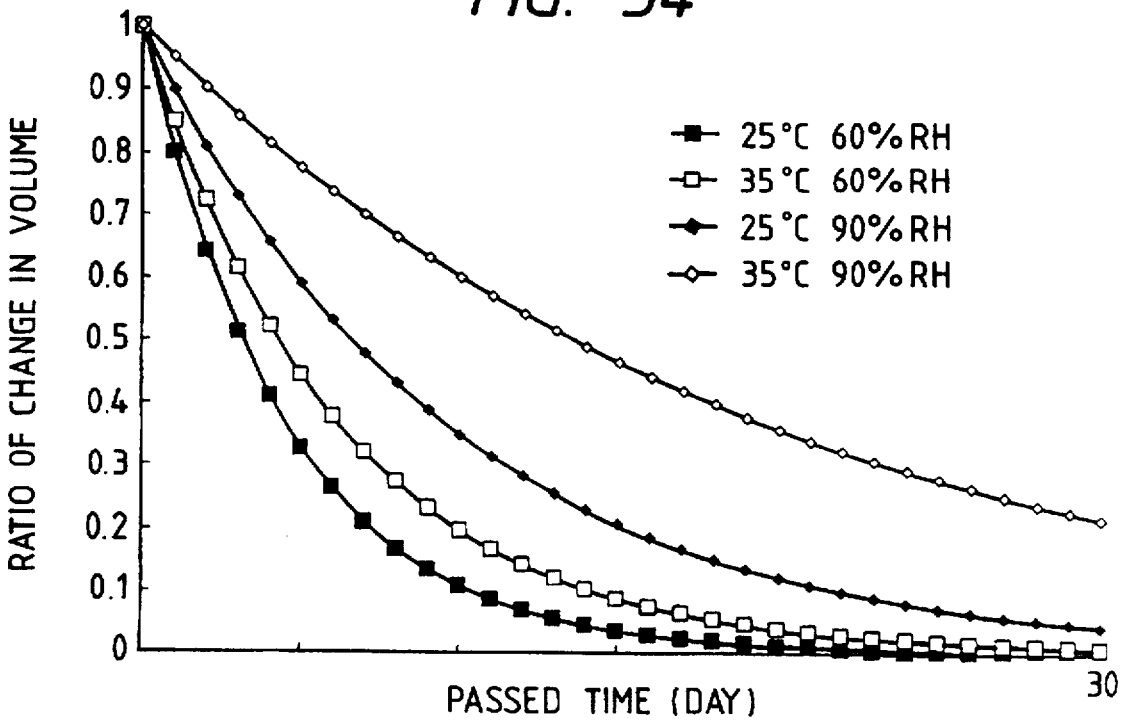
FIG. 34 is a line diagram showing the evaporation characteristics of the volatile component of ink used for an embodiment.
Figure 35:
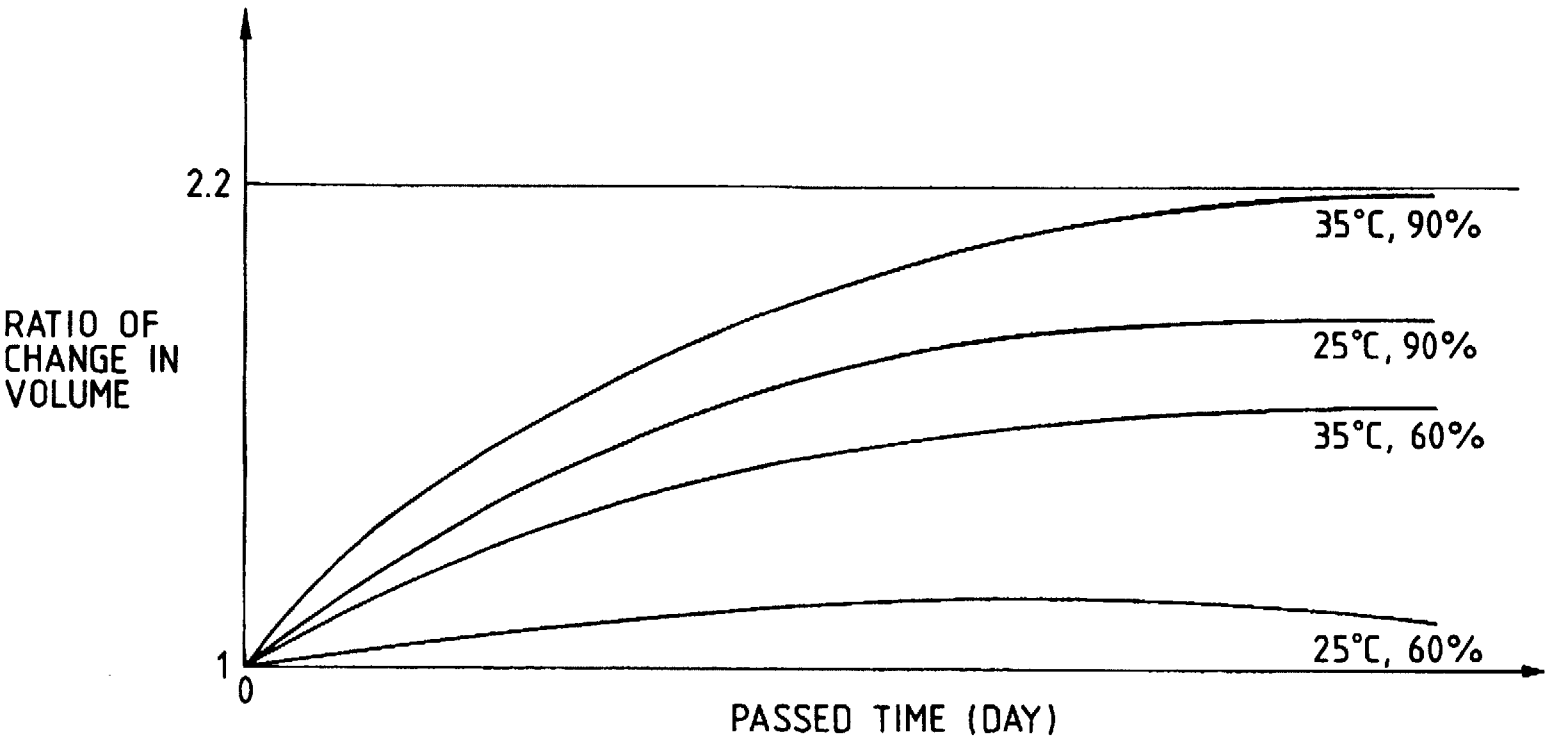
FIG. 35 is a line diagram showing the moisture absorption characteristics of the non-volatile component of the above-mentioned ink.

FIG. 34 is a line diagram showing the evaporating characteristics of the volatile component of ink used for the present embodiment. FIG. 35 is a line diagram showing the moisture absorption characteristics of the non-volatile component of the ink. Both are obtained by experiments. In either experiments, the ambient temperature and moisture are changed variously.

As clear from FIG. 34 and FIG. 35, the severest conditions for the ink absorbent 600 in either characteristics are: the ambient temperature 35° C. and ambient moisture 90%. In the present embodiment, the evaporation coefficient $\eta$ (Tw) is defined under this condition.

Figures 36, 37:
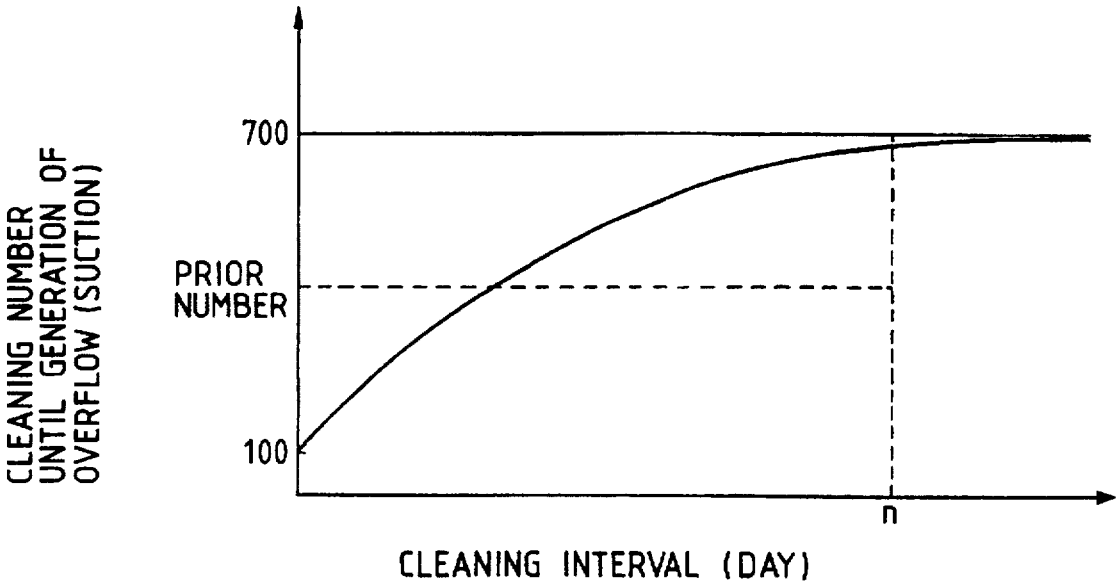
FIG. 36 is a view schematically showing a table to be used for the control of waste ink amount according to an embodiment.
FIG. 37 is a line diagram showing the effect of the above-mentioned control of the waste ink amount.

The evaporation coefficient $\eta$ (Tw) is defined in consideration of the characteristics shown in FIG. 34 as a function of the elapsed time since the last recovery process, and each of the coefficients is stored in the form of table as shown in FIG. 36.

In the present embodiment, the waste ink is controlled as given below in accordance with the coefficient $\eta$. In other words, as described earlier in conjunction with FIG. 25 and FIG. 26, each time the suction or predischarge is executed, the following exhaust is made:

$$W_{current\ exhaust\ amount}=W_{pump}\times n \text{ and/or } W_{heat}\times m$$

Given the last updated waste ink amounts as $W_{volatile\ (old)}$ and $W_{non\text{-}volatile\ (old)}$, the waste ink amounts are updated as shown in the following equation (1):

$$W_{volatile(new)}=W_{current\ exhaust\ amount}\times R_{volatile\ portion\ ratio}+W_{volatile(old)}\times\eta_{(Tw)}$$

$$W_{non\text{-}volatile(new)}=W_{current\ exhaust\ amount}\times R_{non\text{-}volatile\ portion\ ratio}+W_{non\text{-}volatile(old)} \quad (1)$$

The volatile component obtainable from this equation (1), that is, the sum of updated amount of the non-volatile component, $W_{volatile}+W_{nonvolatile(new)}$, can be defined as the waste ink amount currently held by the ink absorbent 600. Also, the waste ink amount after the recovery process can be a product obtainable by multiplying it by $\eta$(Tw) corresponding to the elapsed time Tw. In this way, it is possible to monitor the waste ink amount after the recovery process. For example, if the waste ink amount at a particular time becomes less than the warning value due to the evaporation and others as described later, a process can be arranged to release such a warning condition. In this respect, in the above-mentioned equation, the $R_{volatile\ portion\ ratio}$ and $R_{non\text{-}volatile\ portion\ ratio}$ are the ratios of the volatile component and non-volatile component of ink, and these ratios can be defined as 80% and 20%, for example.

From the result of the above-mentioned calculation of the waste ink amount, a process is possible as given below.

In other words, the above-mentioned expression in the equation (1) can be replaced as follows:

$$W_{volatile(new)} = W_{current\ exhaust\ amount} \times R_{volatile\ component\ ratio} \times \eta_{(0)} + W_{volatile(old)} \times \eta_{(Tw)}$$

This is the function of an exhaust ink amount and an elapsed time.

On the basis of the updated amounts of the volatile component and non-volatile component obtainable from the equation (1), the waste ink amount is examined in the waste ink tank check in the step S1604 shown in FIG. 16 in such a manner as expressed in the following equations (2) and (2'):

$$W=W_{volatile}\times\eta_{(Tw)}+W_{non\text{-}volatile} \quad (2)$$

$$W'=W_{non\text{-}volatile}\times(1+\phi) \quad (2')$$

Here, the $1+\phi$ is 2.2 in the example shown in FIG. 35.

In the above-mentioned equations, if the W or W' is ≧limit 1, a warning is issued. If the W or W' is ≧limit 2, the suction and predischarge are suspended or the printer operation is suspended. In other words, the arrangement is made to generate a suction error, predischarge error, and recording error.

With the above-mentioned control of waste ink amount, it is possible to know the storage of the waste ink more accurately. As shown in FIG. 37, therefore, whereas the limit of the cleaning numbers is set low in the conventional example, the present embodiment makes it possible to set the cleaning numbers almost up to the limit of the absorbent 600 itself.

Also, while the volume which is not necessarily required to hold the waste ink can be curtailed, it is possible to avoid any overflow, thus contributing to miniaturizing the apparatus.

As clear from the above-mentioned description, the operational information required for the user to execute the ink tank exchange and others for an ink jet recording apparatus can be represented on the screen of the display of the information processing systems according to the present invention. Also, at the same time, the ink jet recording apparatus is made capable of executing such operations in accordance with the operational instructions thus issued.

As a result, the user can easily and appropriately operate the ink tank in the ink jet recording apparatus (Second Embodiment)

Figure 39:
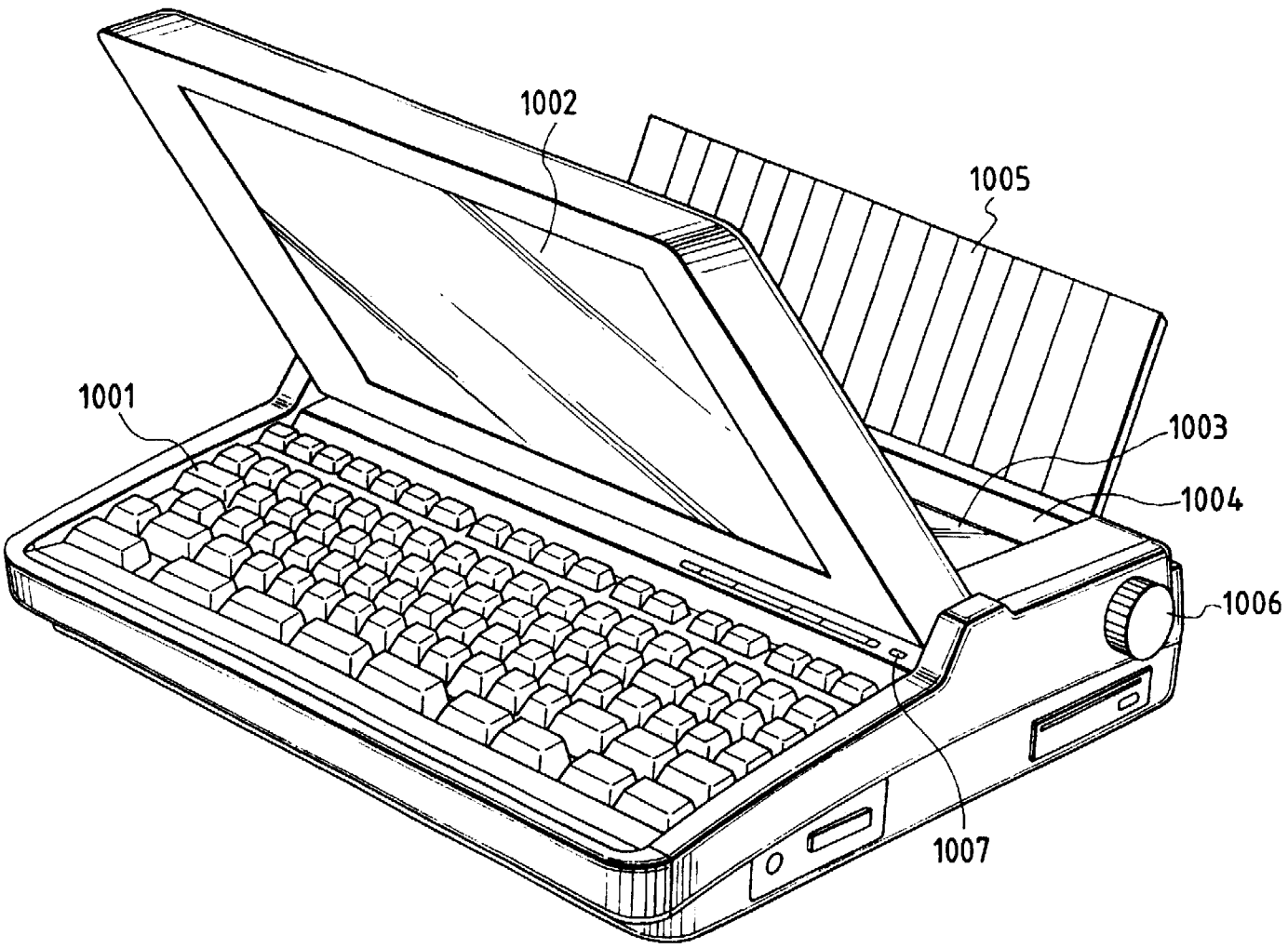
FIG. 39 is a perspective view showing the external appearance of the ink jet recording apparatus to which the present invention is applicable.

FIG. 39 is a view showing a structural example of the external appearance of a document producing apparatus (hereinafter referred to as "word processor") in which an ink jet recording apparatus is incorporated as an apparatus to which the present invention is applicable.

Here, a reference numeral 1001 designates a key board unit serving as an input device; 1002, a display unit displaying the inputted document and others, which is rotatively supported, and can be held over the key board unit 1001 when the apparatus is not in use; 1003, a transparent or semi-transparent protection cover provided for the observation aperture, which can be opened or closed for confirming the operational state of the aforesaid recording head; 1004, a spur cover for holding spurs; 1005, a sheet supporter supporting recording sheets in feeding them; 1006, a knob for feeding or exhausting a recording sheet manually; and 1007, a cleaning button serving as a switch to actuate the cleaning operation in order to recover the discharge of the aforesaid recording head to its normal condition.

Figure 40:
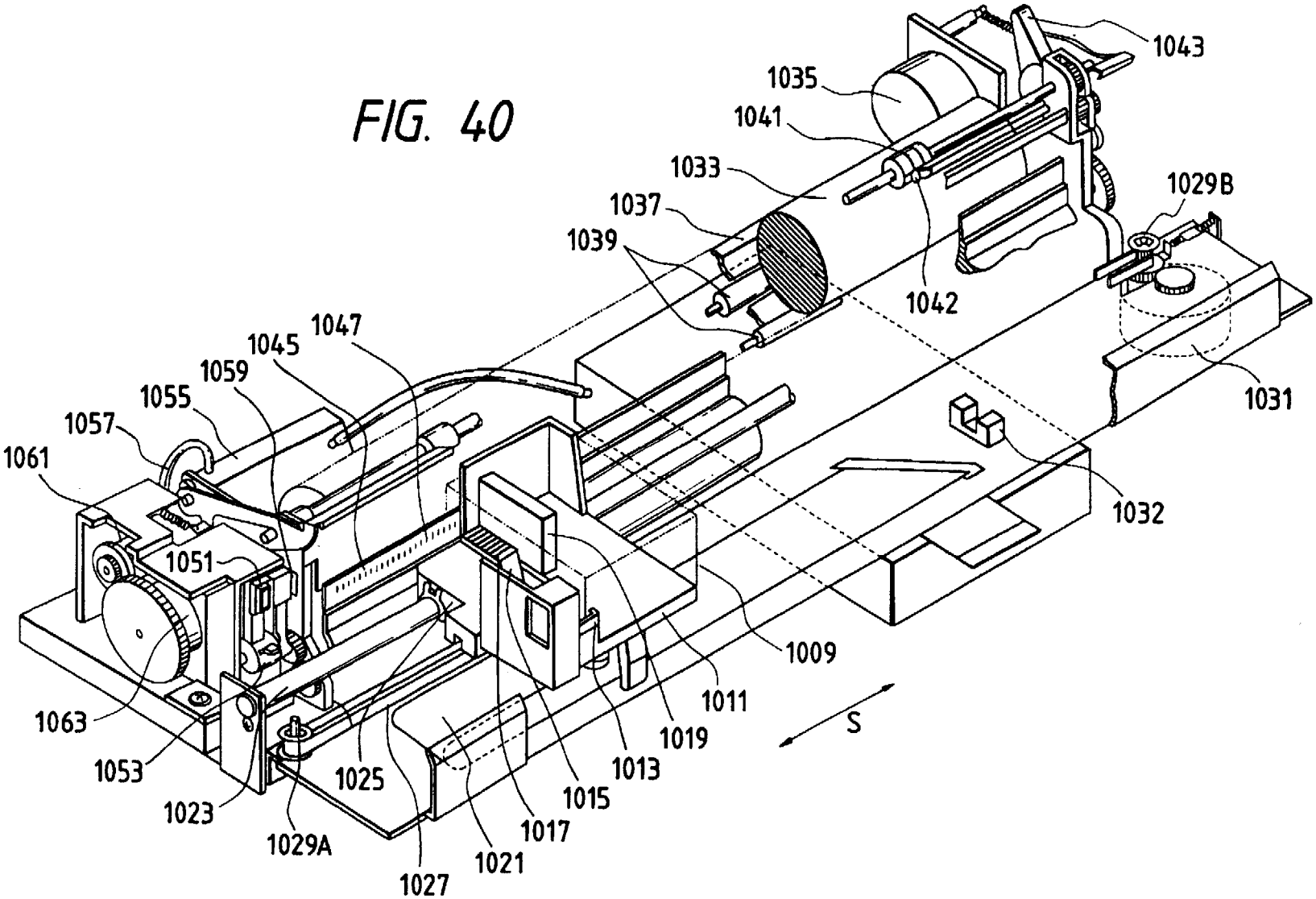
FIG. 40 is a perspective view showing the external appearance of the printer unit of an ink jet recording apparatus to which the present invention is applicable.

FIG. 40 is a view showing an structural example of the printer unit of an ink jet recording apparatus according to the present invention.

Here, a reference numeral 1009 designates a head cartridge having an ink jet recording head; 1011, a carriage for scanning in the directions S with the head cartridge being installed on it; 1013, a hook to fix the head cartridge 1009 to the carriage 1011; and 1015, a lever with which to handle the hook 1013: for this lever 1015, a marker 1017 is provided to read the printing position, the set position, and others of the recording head of the cartridge 1009 by pointing such a position at the calibration on the cover which will be described later; 1019, a supporting board to support the electrical contacting unit for the head cartridge 1009; 1021, a flexible cable to connect the electrical contacting unit with the main body controller; 1023, a guide shaft to guide the carriage 1011 in the directions S, which penetrates through the bearing 1025 of the carriage 1011; and 1027, a timing belt to transmit the driving force to the carriage 1011 which is fixed to the belt so that the carriage can travel in the directions S, and is tensioned around the pulleys 1029A and 1029B arranged respectively on both side ends of the apparatus.

To one of the pulleys 1029B, a driving force is transmitted from a carriage motor 1031 through a transmission mechanism formed by gears and others. A reference numeral 1032 designates a carriage home sensor to detect the carriage position; 1033, a platen roller to regulate the recording surface of a sheet or other recording medium (hereinafter also referred to as "recording sheet"), and at the same time, to feed the recording medium in recording or the like, which is driven by a feed motor 1035; 1037, a sheet pan to guide the recording medium from the sheet supporter 1005 side to the recording position; 1039, a feed roller arranged on the way of feed path of the recording medium in order to press the recording medium to the platen roller 1033 to convey it; 1041, an exhaust roller arranged on the downstream side of the recording position when observed from the feeding direction of the recording medium in order to exhaust the recording medium to the exhaust sheet outlet which is not shown; 1042, a spur arranged against the exhaust roller 1041 to press the exhaust roller 1041 through the recording medium, thus creating the force to feed the recording medium in cooperation with the exhaust roller 1041; 1043, a release lever to release the biasing forces given to the feed roller 1039, pressure board 1045, and spur 1042, respectively, when the recording medium is set; 1045, the pressure board which suppresses the floating of the recording medium near the recording position in order to secure the close contact of the recording medium to the platen roller 1033.

In the present embodiment, an ink jet recording head is employed as its recording head to record by discharging ink. Therefore, the distance between the ink discharge port formation surface of the recording head and the recording surface is comparatively short while the space between the discharge port formation surface and the recording surface must be controlled severely so as to avoid any contact between them. In this respect, the arrangement of the pressure board 1045 is effective. A reference numeral 1047 designates the calibration which is provided for the pressure board 1045; 1049, the marker provided for the carriage 1011 in relation to the calibration so that the printing position and setting position of the recording head can be read according to the marker; and 1051, a cap made of rubber or other resilient material which faces the ink discharge port formation surface of the recording head at its home position, and is supported to abut on or retract from the recording head. The cap 1051 is used as a protective member for the recording head when it is out of recording operation, and also, as a receptacle which receives ink when a discharge recovery is processed for the recording head.

Here, in the present embodiment, the "ink receptacle" is not necessarily confined to the above-mentioned cap. If only such a receptacle can receive ink exhausted from the recording head, any modes will do.

In the present embodiment, the "discharge recovery process" means a process to remove any causes of defective discharge, such as air bubbles, dust particles, and an overly viscous ink which is no longer suitable for recording, by discharging ink from the entire discharge ports by driving the energy generating elements arranged in the interior of the ink discharge ports for discharging ink or by activating a suction force while the discharge port formation surface is covered with the cap.

A reference numeral 1053 designates a pump which activates a suction force to exhaust ink forcibly and also serves as withdrawing means used for sucking ink from the cap 1501 which has received it when a discharge recovery is processed by such a forcible exhaust or by predischarge; 1055, a waste ink storage to store the waste ink which is sucked by the pump 1053; 1057, a tube which conductively connects the pump 1053 and the waste ink storage 1055; 1059, a blade for wiping the discharge port formation surface of the recording head, which is supported movably to the position where it extrudes to the recording head side for wiping while the head travels, and to the position where the blade retracts so that it does not engage with the discharge port formation surface; 1061, a motor; and 1063, a cam mechanism which receives the transmitted force from the motor 1061 to drive the pump 1053, and also, to drive the cap 1051 and the blade 1059 to move, respectively.

Now, the description will be made of the above-mentioned head cartridge 1009 in detail.

Figure 41:
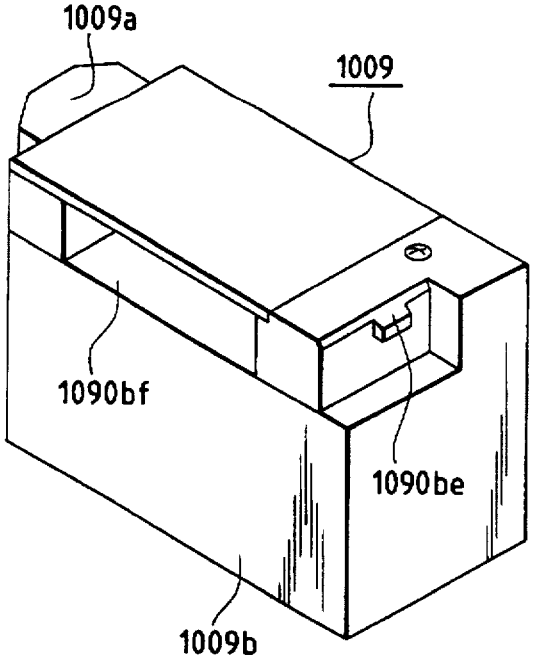
FIG. 41 is a perspective view showing the external appearance of a head cartridge.

FIG. 41 is a perspective view showing the external appearance of the head cartridge 1009 formed integrally by the discharge unit 1009*a* and ink tank 1009*b*, which constitute an ink jet recording head main body. In FIG. 41, a reference numeral 1090*be* designates a nail which couples to the hook 1013 provided for the carriage 1011 when the head cartridge 1009 is installed. As clear from FIG. 41, the nail 1090*be* is arranged on the inner side of the entire extension of the recording head. Also, in the vicinity of the discharge unit 1009*a* in the front part of the head cartridge 1009, an abutting portion for positioning is arranged, although not shown in FIG. 41. A reference numeral 1090*bf* designates a head aperture into which is inserted a supporting board planted on the carriage 1011 to support a flexible base board (electrical contacting unit) and a rubber pad.

Figure 42:
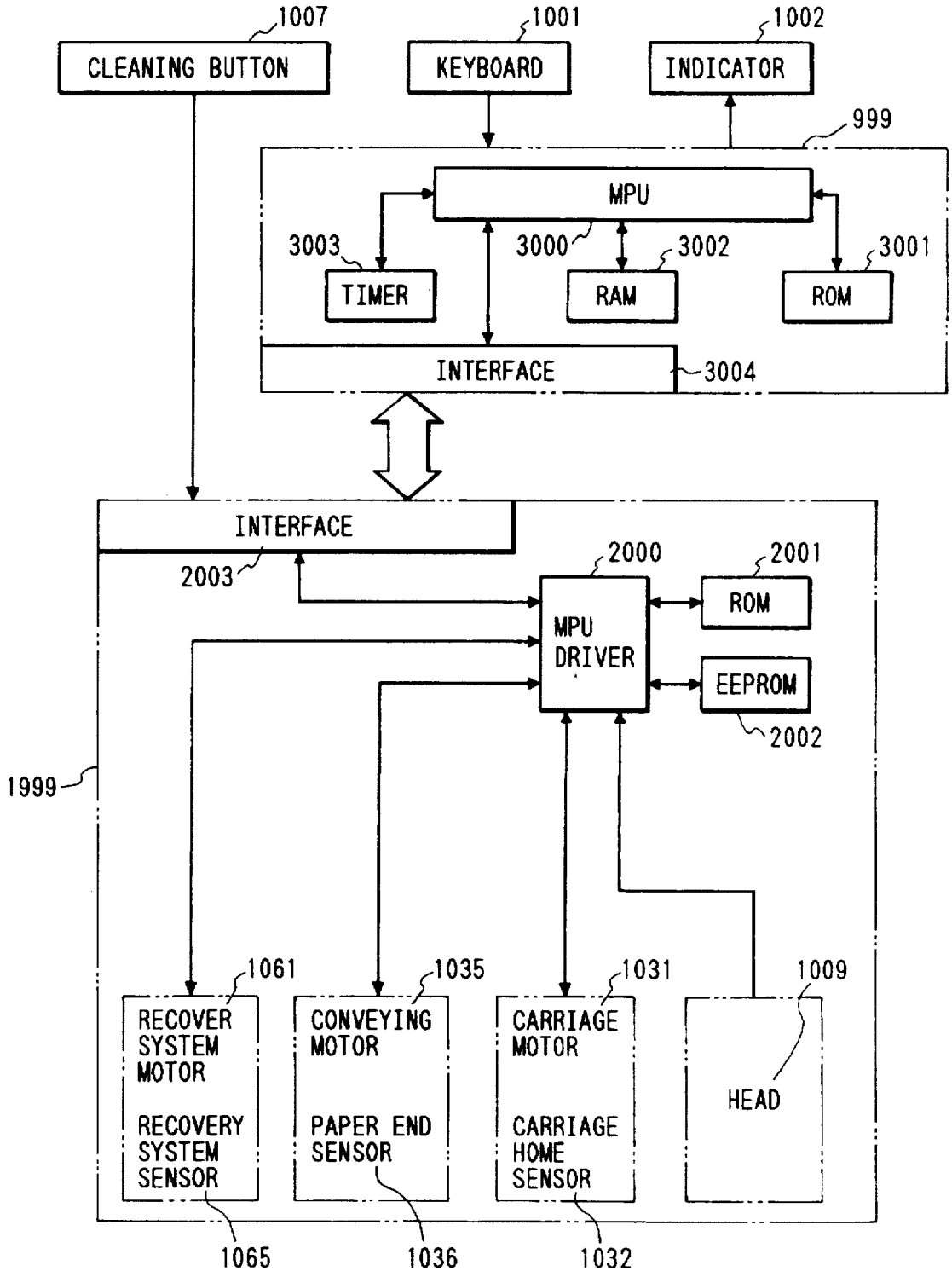
FIG. 42 is a block diagram showing another example of the ink jet recording apparatus to which the present invention is applicable.

FIG. 42 is a block diagram showing a structural example of the control system of the word processor shown in FIG. 40 in which the ink jet recording apparatus is incorporated as an apparatus to which the present invention is applicable.

The region indicated by a reference numeral 999 represents a microcomputer for the word processor main body. A reference numeral 3000 designates a microprocessor unit; 3001, a ROM storing a program for the word processor; 3002, a RAM used as a work area when producing documents; 3003, a timer prepared for controlling the data and others for the word processor.

The user inputs information to the above-mentioned microcomputer by use of the key board 1 while observing the display 2 to confirm the contents of work.

The region indicated by a reference numeral 1999 represents the built-in ink jet recording apparatus. A reference numeral 2000 designates a microprocessor unit; 2001, a ROM storing a program for controlling the recording apparatus which will be described later in conjunction with FIGS. 43B, 43C and 43D and FIG. 44; and 2002, an EEPROM storing the counted number of cleaning operations according to the present invention. The microprocessor 2000 controls the recording apparatus by giving driving pulses to a recovery system motor 1061, a feed motor 1035, and a carriage motor 1031 while confirming the state of the recovery system unit, the presence or absence of a recording sheet, and the position of the carriage 1011 by use of a recovery system sensor 1065, a sheet end sensor 1036, and a carriage home sensor 1032.

The printing command signals are transmitted from the microcomputer 999 to the ink jet recording apparatus 1999 through an interface 3004. Also, from the ink jet recording apparatus 1999, signals such as to inform an erroneous conditions or the like are transmitted to the microcomputer 999 through an interface 2003.

The user, having found that the printing condition is abnormal (such as disabled discharges, or scratchy recording), depresses a cleaning button 1007. Its signal is transmitted to the ink jet recording apparatus 1999 directly to actuate the cleaning operation (which will be described later in detail). A cleaning of this type is called "manual cleaning".

Also, aside from the manual cleaning, an "auto cleaning" is prepared.

The auto cleaning is actuated by the microprocessor unit 3000 of the word processor. The data of the last auto cleaning is stored in the RAM 3002 (although not shown, a battery backs it up to keep the data in memory). When the printing key is depressed through the key board 1001, the current data and the stored data are compared, and then, if the difference is more than three days, a command is issued to enable the ink jet recording apparatus 1999 to actuate a cleaning operation before executing the required printing. This is a mechanism prepared in an anticipation that the state of ink in the vicinity of the discharge ports is deteriorated as the time elapses even in the capped head cartridge 1009 or that the air may enter the ink passages between the ink tank 1009*b* and the discharge ports and result in disabled discharges. With this mechanism, it is possible to automatically assure prints of a good quality.

Figures 43A, 43C:
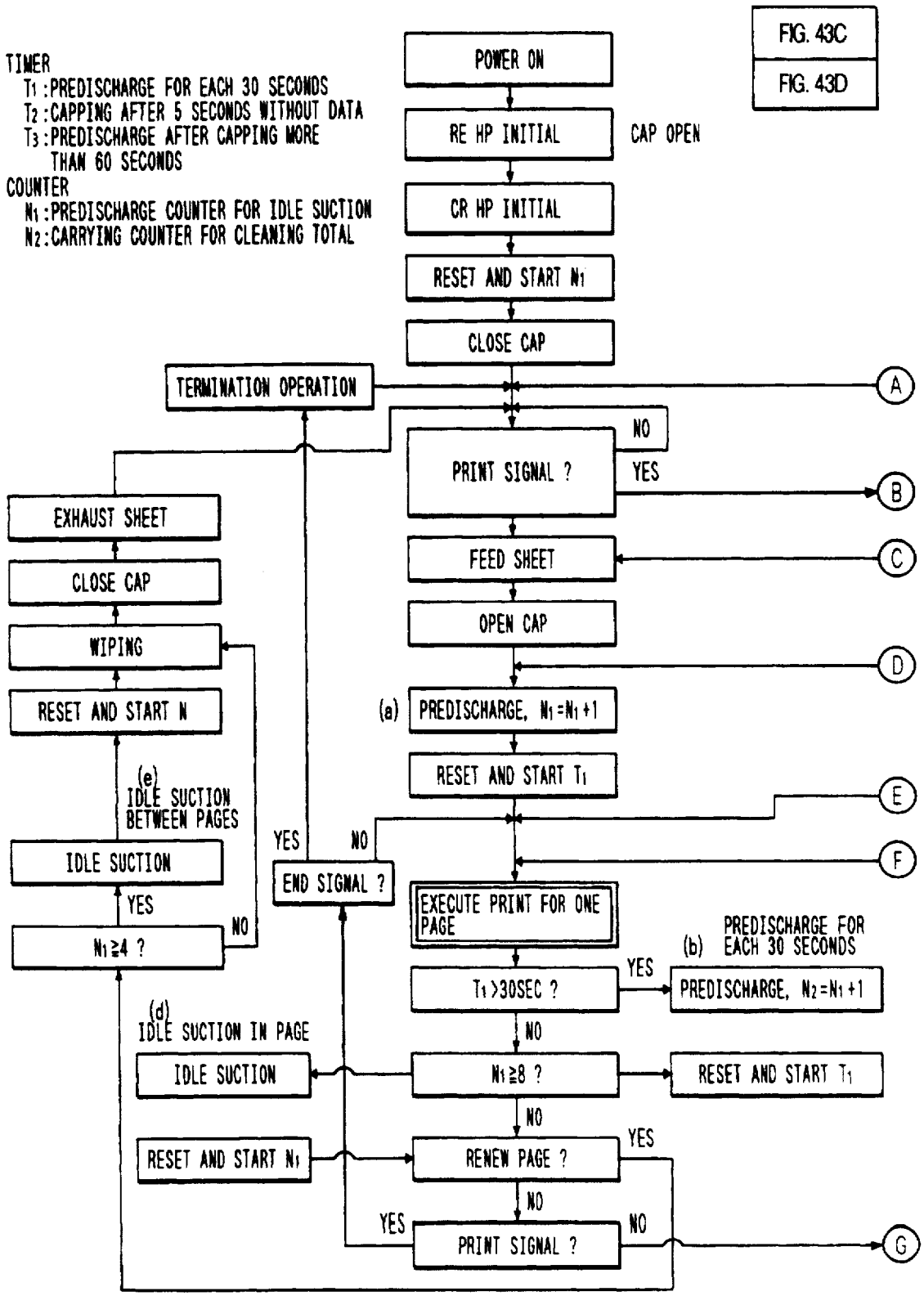
FIG. 43A is a block diagram showing that FIGS. 43C and 43D are to be read as connected flowcharts.
FIGS. 43B, 43C and 43D are flowcharts showing the printing control procedures of an ink jet recording apparatus to which the present invention is applicable.
Figure 43D:
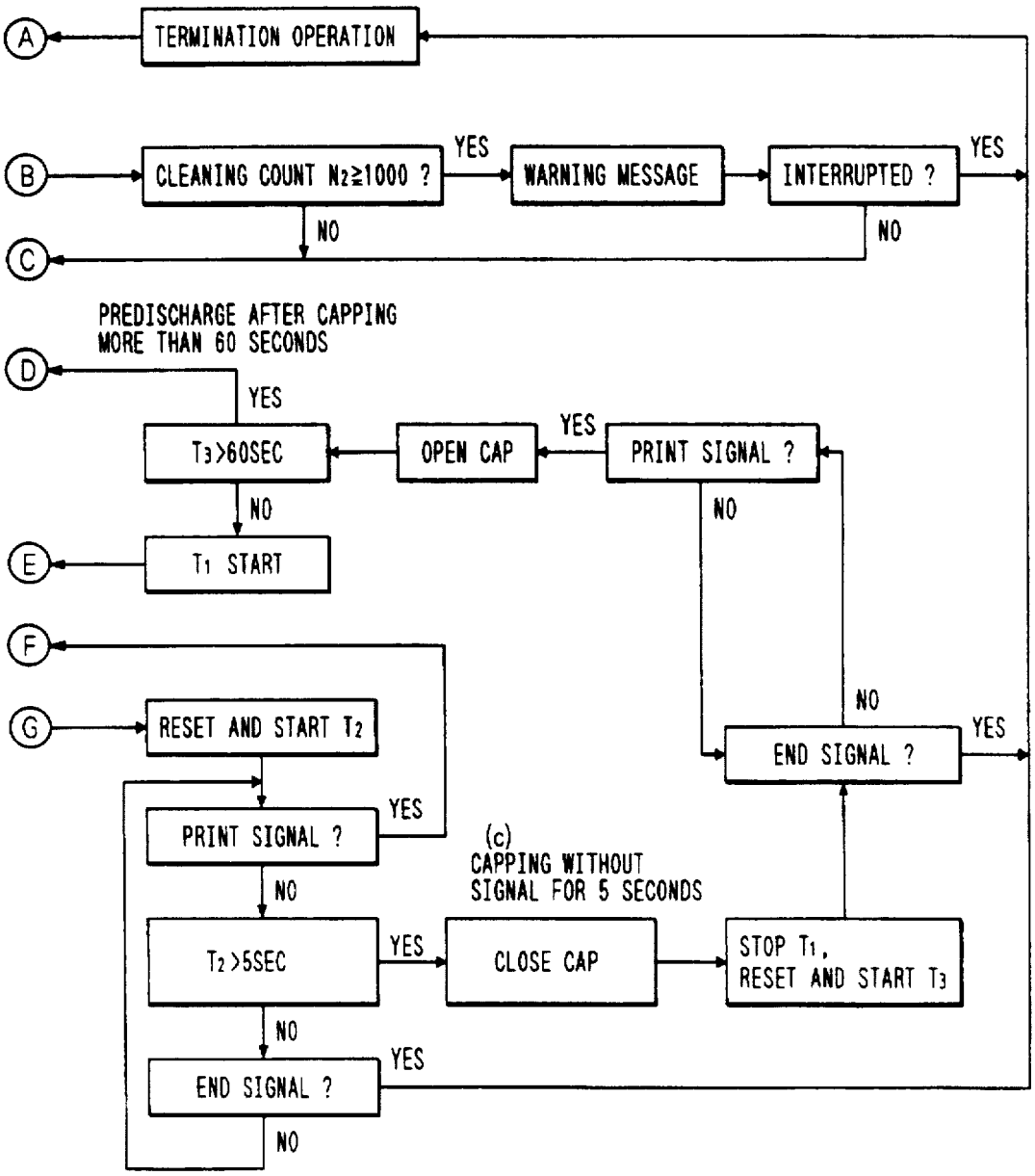
Figure 43B:
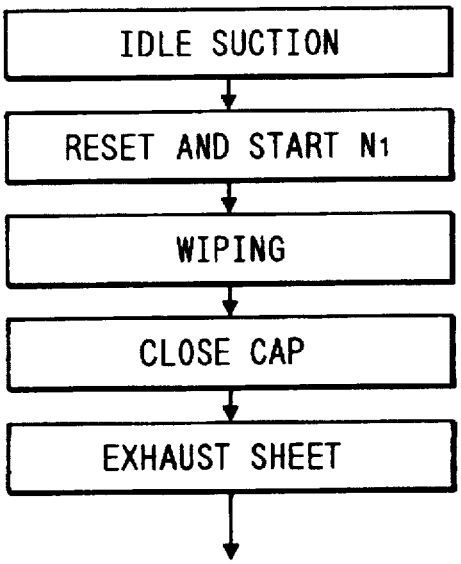

FIGS. 43B, 43C and 43D are flowcharts showing the printing control procedures in the present embodiment. As its main operation, there is a predischarge. The predischarge according to the present embodiment is to discharge 100 shots of ink droplets into the cap from the entire 64 nozzles of the recording head. Here, one shot of the ink droplet is 90 ng. Therefore, the ink exhausted into the cap is 0.000576 g by the 100-shot predischarge, which is transferred to the waste ink storage 1055. In this respect, FIG. 43B represents the execution of the idle suction in the flowchart shown in FIGS. 43C and 43D.

Immediately before a printing, a predischarge (a) is executed as shown in FIGS. 43C and 43D. Thereafter, a predischarge (b) is executed every 30 seconds. Also, a timer $T_1$ is used for accumulating this 30-second intervals. The timer $T_1$ is suspended when entering the capping (c) after no printing signal for more than five seconds. Therefore, any period of time during the capping is not included in the 30-second intervals. Also, if the capping (c) takes more than 60 seconds, the control procedures return to the predischarge (a), and a predischarge is executed before printing subsequent to opening the cap. The predischarge is given to the interior of the cap. As a result, when the predischarge is repeated, the ink is accumulated in the cap. Thus, in order to withdraw the ink to the waste ink tank side, an idle suction must be given. Fundamentally, the idle suction is conducted when no printing is executed between pages. If the predischarge counter $N_1$ indicates more than four after the completion of one page, an idle suction (d) is executed. However, if the $N_1$ indicates more than eight during printing on one page, that is, if it takes a long time to print a document, an idle suction (e) is executed. Also, an idle suction is executed without fail when a printing is terminated.

Now, the description will be made of wiping. This is to clean the head face which is still wet with ink after the completion of a printing. The wiping is operated when a page and the entire pages are printed.

Figure 44:
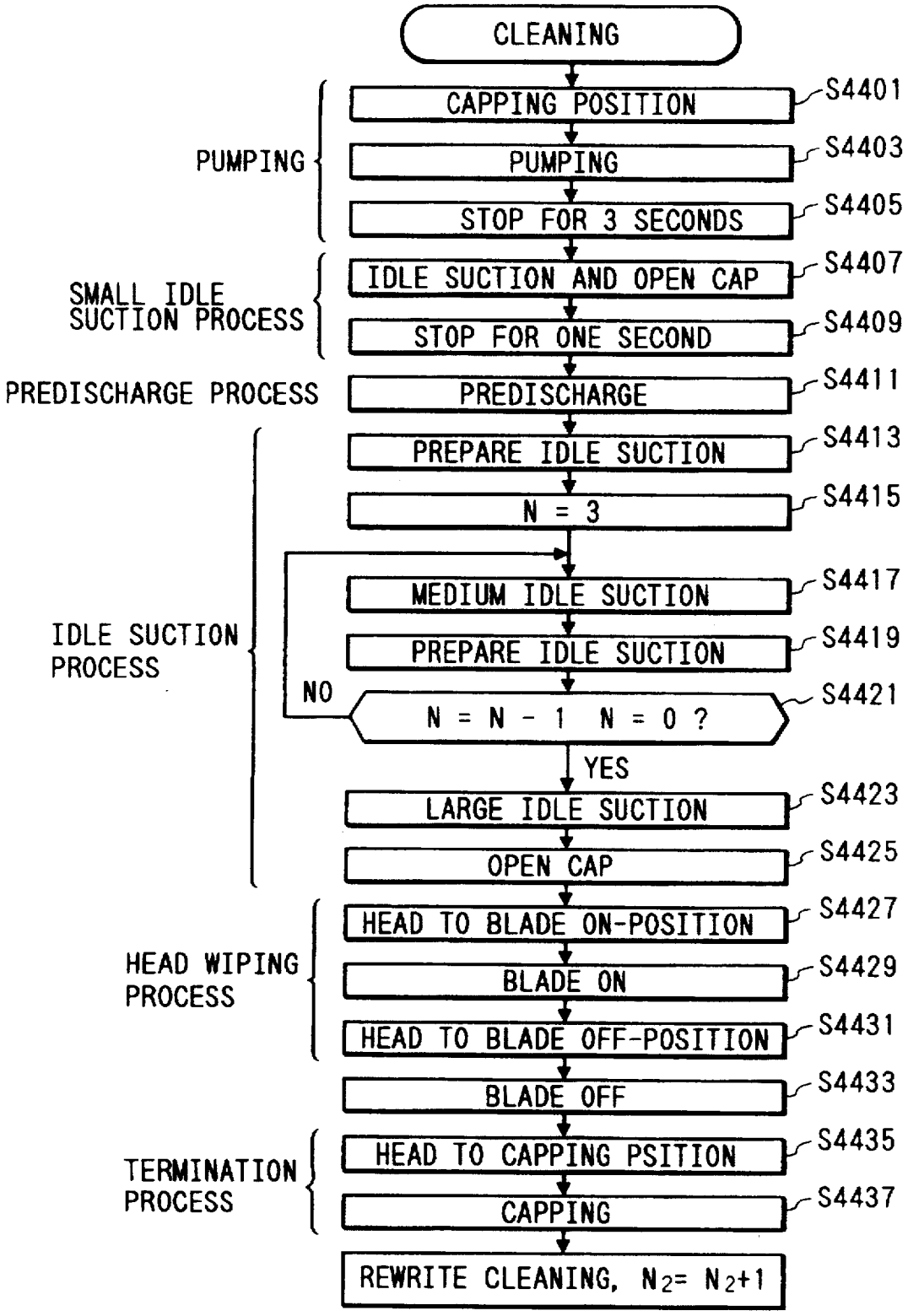
FIG. 44 is a flowchart showing the cleaning operation procedures for an ink jet recording apparatus to which the present invention is applicable.

FIG. 44 is a flowchart showing an example of the operational procedures of cleaning to be executed by the recovery system unit under control of the MPU 2000 shown in FIG. 42.

The present procedures begin at first with the capping state in step S4401. Then, in the next step S4403, the piston is actuated to execute the pumping. In the next step S4405, a three-second suspension is given to suck ink sufficiently in such a state. In the present example, the amount of ink sucked from the recording head is approximately 0.11 g. Then, at the same time that the cap is opened in step S4407, a small-scale idle suction is executed. In step S4409, a one-second suspension is given in order to withdraw ink from the cap and cap lever. Then, in step S4411, a predischarge is executed. This predischarge is exactly the same as the one to be executed during printing.

Subsequently, an idle suction is executed in order to exhaust the ink which has filled in the pump. At first, in step S4413, the piston shifts to the position of the idle suction. The piston is reciprocated three times between the idle suction position and the suspension position of the medium-scale suction as represented in steps S4415 to S4421. Then the piston shifts fully to execute a large-scale idle suction in step S4423. Thus the ink in the pump is sufficiently exhausted by pressure toward the waste ink storage side. In succession, the piston shifts to the idle suction preparation position in step S4425. In the next step S4427, the recording head shifts to the blade-on position. Continuously in step S4429, the blade abuts on to execute a wiping in step S4431 while shifting the recording head to the blade-off position. In step S4433, the blade leaves off, and the recording head is returned to the capping position in step S4435 for its capping in step S4437. Lastly, the cleaning number counter is updated by one.

Figure 38:
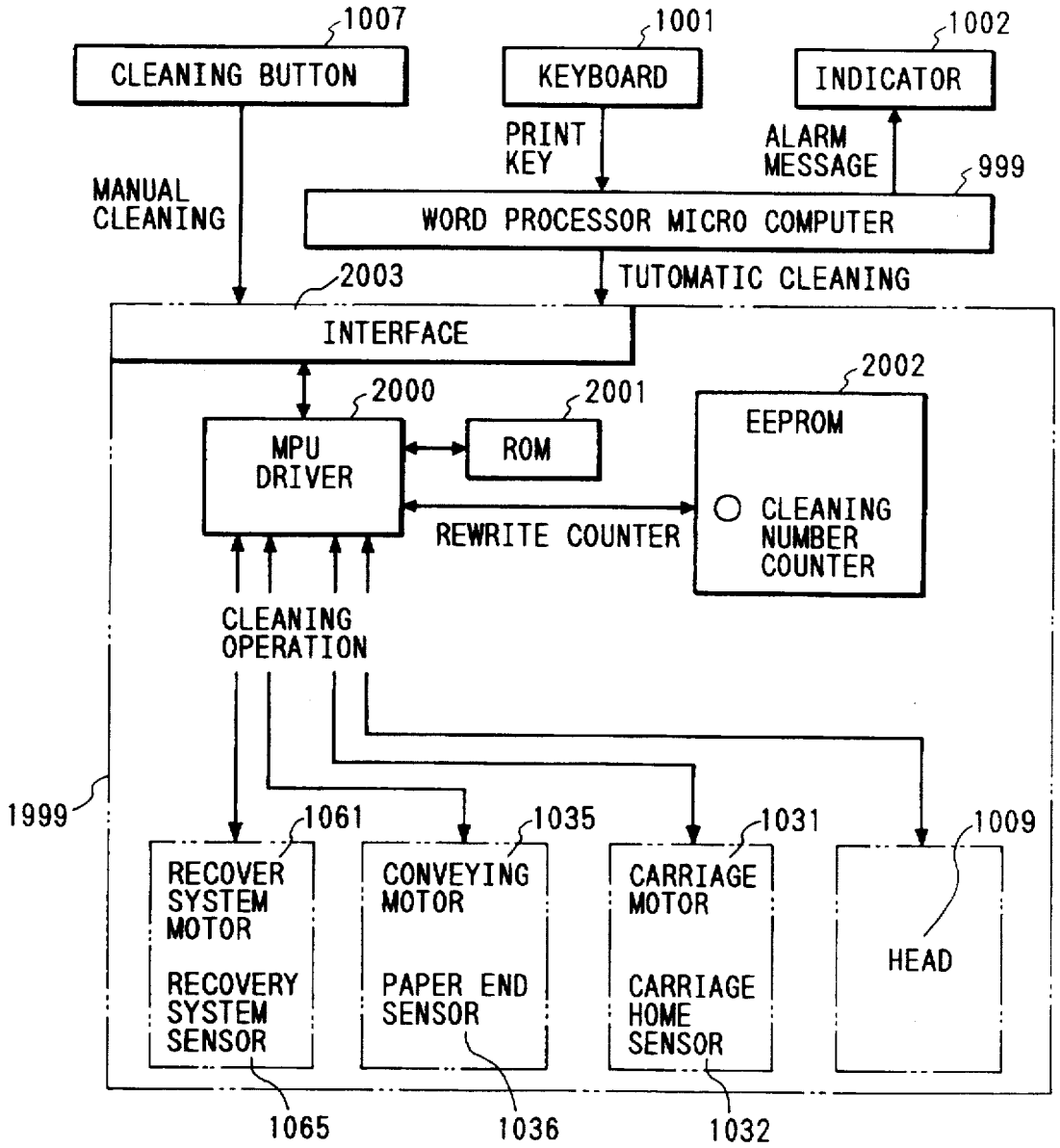
FIG. 38 is a block diagram showing an example of the recording apparatus to which the present invention is applicable.

In conjunction with FIG. 38, the description will be made of a method for "setting a limit to the cleaning numbers" according to the present invention. As already described, there are two types of cleaning, a "manual cleaning" and an "auto cleaning". The "manual cleaning" is actuated by depressing the cleaning button 1007 to give command directly to the ink jet printer. The "auto cleaning" is actuated by a command issued by the microcomputer 999 according to its judgment based on the date when the printing key is depressed through the key board 1001.

In either case, the microprocessor 2000 in the printer drives the respective parts to execute the cleaning operation ultimately.

The cleaning counter is prepared in the EEPROM 2002, which is set at zero, when it is assembled in the product. The EEPROM is a memory electrically erasable and writable, and written information is held in it even when no voltage is applied. The counted numbers of cleaning are thus held in it when the power-supply is turned off.

As described above, in either case of the two types of cleaning, the microprocessor 2000 in the printer is used, and each time the cleaning operation is executed according to the program stored in the ROM 2001, the cleaning count in the EEPROM 2002 is updated by one.

Now, a method for issuing a warning message will be described. When the user inputs the printing key through the key board, a printing command and printing data are transmitted from the microcomputer 999 to the recording apparatus 1999. The microprocessor 2000, having received the printing command, confirms the value of the cleaning number counter in the EEPROM 2002 at first. If the number is less than 1,000, the printing is executed immediately. If it is 1,000 or more, the microprocessor returns an error code signal to the microcomputer 999. The microcomputer 999, having received the error code signal, indicates on the display 1002 a message to the extend that "The waste ink tank full. Replacement is required". At the same time, the printing is suspended, and a message is displayed to request the user that the printing should be "resumed" or "suspended". It is desirable for the user to suspend the printing immediately and request a service man to replace parts, but it is also possible for him to resume the printing if he desires to continue the printing for a while (see FIGS. 43C and 43D).

Also, after replacement of the waste ink tanks, the cleaning number counter in the EEPROM 2002 is reset to zero by use of a writing software prepared for the maintenance service. Thus the normal use becomes possible again from the very beginning. In the present embodiment, the allowable capacity of the waste ink storage 1055 is set at 60 g.

The volume of ink is reduced by drying to a 20% of the initial weight in the environment of the relative moisture 50 RH % to 60 RH %, and also, to a 40% of the initial weight in the environment of 35° C. at 85%.

Therefore, the total weight of ink containable in the waste ink storage 1055 should be as given below in consideration of enabling it to withstand the environment of 35° C. at 85%:

$$60/0.4=150 \text{ g}$$

The ink transferred to the waste ink storage 1055 is the ink exhausted each by the predischarge during printing, the auto cleaning, and the manual cleaning.

Also, as described above, the exhausted ink of 0.000576 g is created by a predischarge. In cleaning, 0.11 g of ink is sucked out per pumping and one predischarge is executed together. Therefore, an ink of 0.110576 g is exhausted in total in this respect.

Here, as a standard condition of use, twelve sheets are printed per day approximately with an estimated predischarge numbers of 30, and also, the auto cleaning is anticipated twice per week and user's cleaning once per week. Then the predischarge during printing is:

per day: $30\times0.000576=0.01728$ g in five years: $5\times52\times5\times0.01728=22.46$ g The number of printed sheets is:

$$5\times52\times5\times12=15{,}600$$

This number of sheets is defined as an assured number of printed sheets for the recording apparatus according to the present embodiment (five years being the standard usable period of the apparatus).

Meanwhile, the cleaning requires:

$5\times52\times3\times0.110576\cong86.25$ g in five years.

The number of cleaning is $5\times52\times3=780$. The sum of the amounts of exhausted ink by the "predischarge during printing" and "cleaning" is 108.71 g which is transferred to the storage in five years.

Five years are the standard useable period, and according to the above-mentioned calculation, there is no possibility that the total amount of exhausted ink exceeds 150 g. The number of cleaning does not reach a limited number of 1,000, either.

If the apparatus is continuously used at the above-mentioned pace (printing frequency and cleaning frequency), the number of cleaning reaches 1,000 as in the following expression, and a warning message is issued in 6.4 years accordingly:

$$5\times1{,}000/780\cong6.4 \text{ (years)}$$

The total amount of exhausted ink which is transferred to the waste ink storage 1055 until then is:

$$108.71\times6.4/5=139.15 \text{ g}$$

This is still within the containable range.

Also, the number of printed sheets at this time is 15,600×6.4/5=19,968 (sheets), which is far above the assured number of printed sheets of 15,600.

Here, a warning is issued, and if the user requests the sales representative or the manufacturer for the required maintenance, the waste ink storage 1055 is exchangeable, and further, it is possible to replace each of the parts which can no longer assure its performance after a long period of use or the recording apparatus can be replaced entirely.

In this respect, according to the present embodiment, while the description has been made to the effect that when the user operates the printing key, it is determined whether or not a warning is issued by comparing the cleaning number count with the set number, the purport of the present invention is not limited to this description. For example, there will be no problem at all even if the arrangement is modified so that when the user operates the cleaning key, the cleaning number count is compared with the set number and it is determined whether or not a warning is issued or the warning is issued immediately after the cleaning count reaches 1,000 as a result of the execution of the user's cleaning and auto cleaning.

Further, according to the present embodiment, the description has been made to the effect that a warning message is indicated on the display as a process after the cleaning numbers reach a specific number, but the purport of the present invention is not limited to this description. For example, the following process may be included:

A warning is issued by means of buzzer or LED.

The operation of the recording apparatus is totally suspended at the same time that a warning is issued.

The user's cleaning function is suspended at the same time that a warning is issued.

The auto cleaning function is suspended at the same time that a warning is issued.

All the cleaning functions are suspended at the same time that a warning is issued.

Also, according to the present embodiment, the description has been made to the effect that the count of cleaning numbers is held in the EEPROM of the microcomputer for the printer control, but the purport of the present invention is not limited to this description. There will be no problem at all this arrangement is modified as follows among some others:

The count of cleaning numbers is held by the RAM which is backed up by a battery in the microcomputer for the printer control.

The count of cleaning numbers is held by the RAM which is backed up by a battery in the microcomputer provided for the word process.

Furthermore, according to the present embodiment, the description has been made to the effect that only the cleaning numbers are counted, and when such numbers arrive at a specific number, the full-up timing of the waste ink storage 1055 is estimated, but the purport of the present invention is not limited to this description. For example, it may be possible to include the following:

The accumulated numbers of predischarge during printing are also counted in the same manner so that the timing of full-up storage can be determined comprehensively by the counted values both for the above-mentioned cleaning and the predischarge.

Figure 45B:
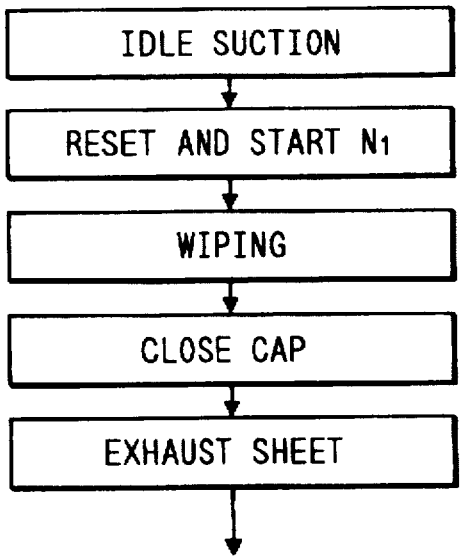
FIGS. 45B, 45C and 45D are flowcharts showing the printing control procedures of the ink jet recording apparatus according to another embodiment.
Figures 45A, 45C:
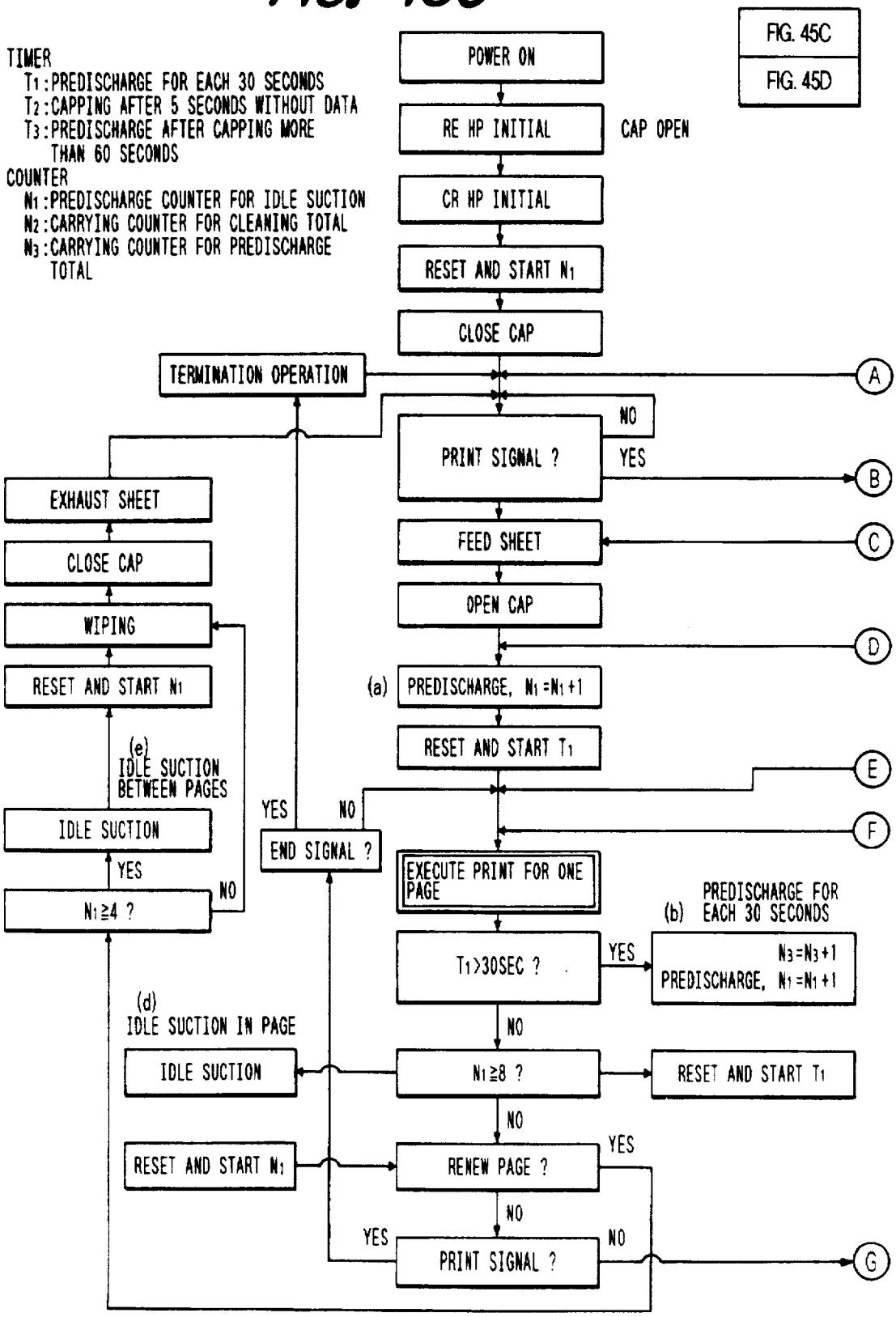
FIG. 45A is a block diagram showing that FIGS. 45C and 45D are to be read as connected flowcharts.
Figure 45D:
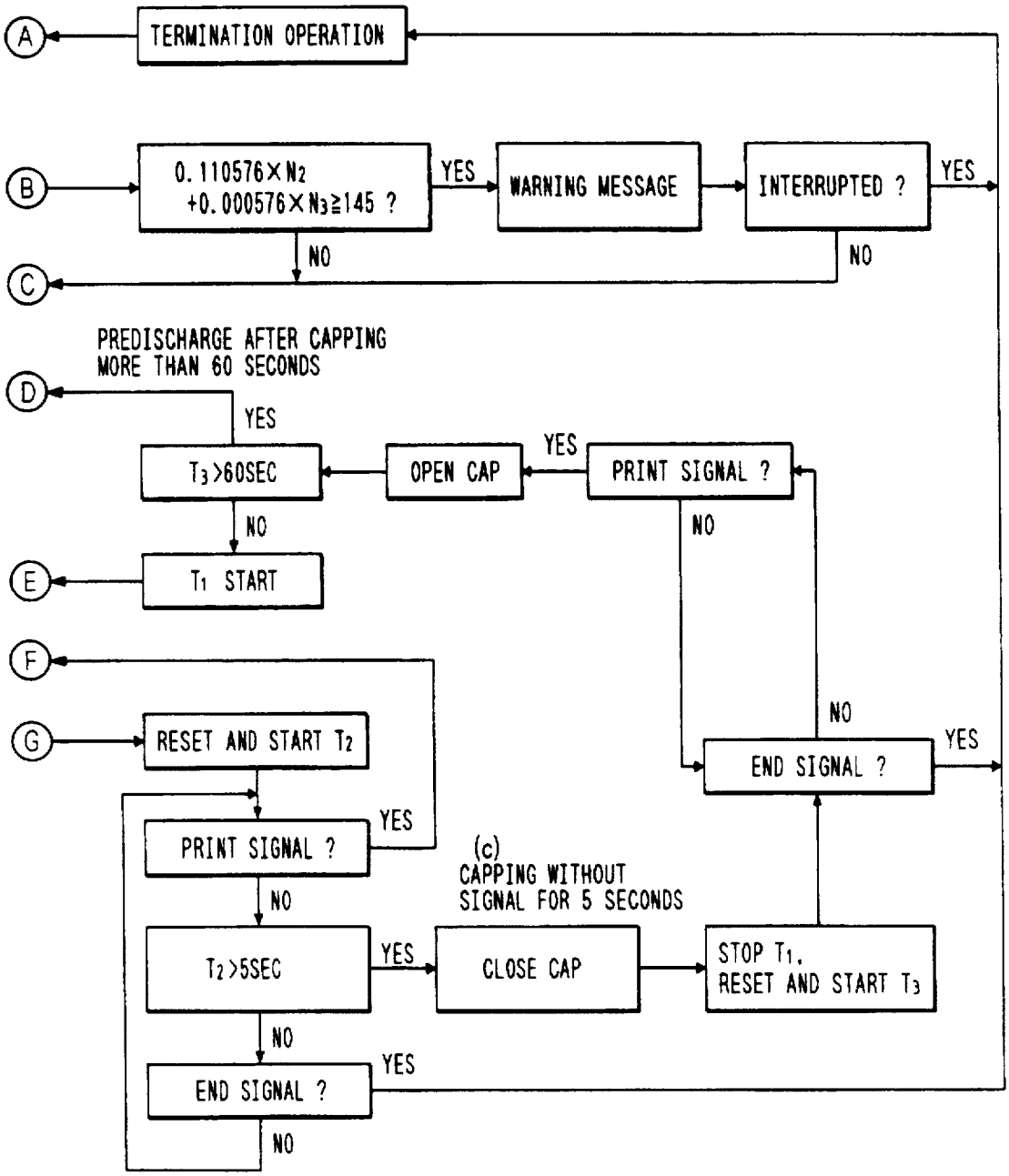

This will be described more precisely in conjunction with FIGS. 45B, 45C and 45D. Now, given the value of the counter for the accumulated cleaning numbers as $N_2$, and the value of the counter for the accumulated predischarge numbers as $N_3$, the total amount of waste ink G (g) transferred to the waste ink storage so far will be:

$$0.110576 \text{ (g)}\times N_2+0.000576 \text{ (g)}\times N_3$$

Immediately before the value thus obtained arrives at 150 g (145 g, for example), it is determined that the storage is filled up.

Each time the predischarge is executed, the values of $N_1$ and $N_3$ are incremented by one, respectively. The $N_1$ is reset when the idle suction is given, but the $N_3$ is left intact and is continuously counted one after another.

After receiving a printing signal, the total amount of waste ink up to that time is calculated in accordance with the $N_2$ and $N_3$. Then, when the result of such calculation presents 145 g or more, the required warning is issued.

Figure 46:
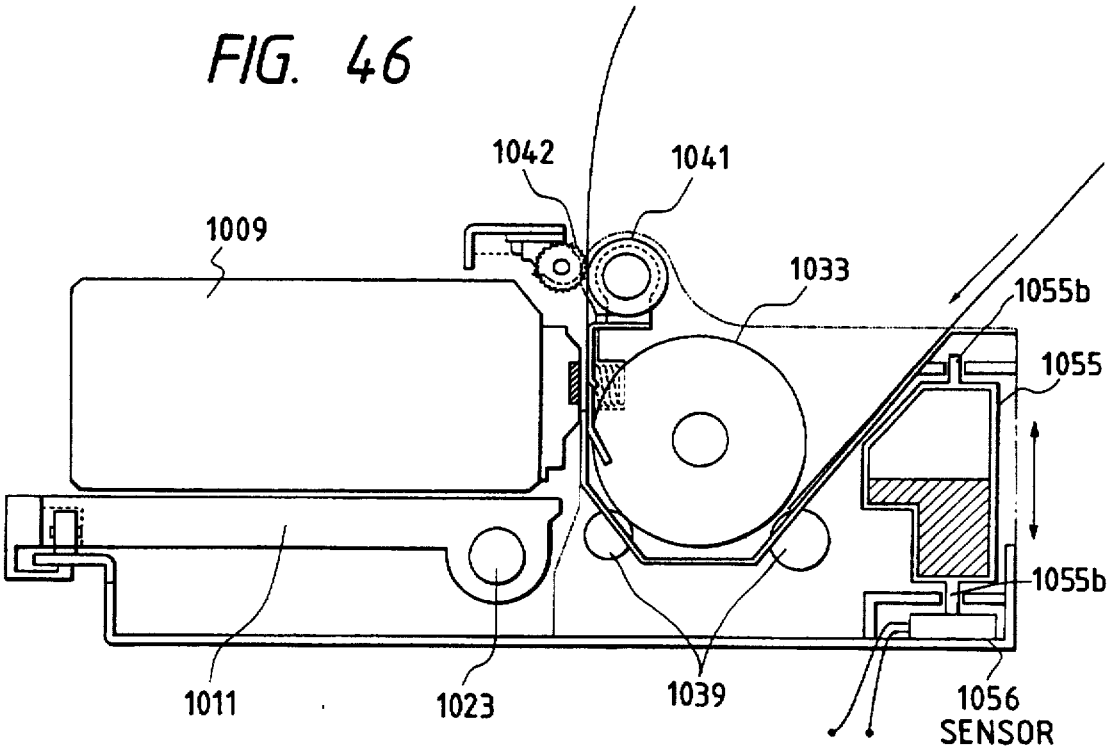
FIG. 46 is a cross-sectional view showing an ink jet recording apparatus according to another embodiment.

Also, according to the present embodiment, the description has been made to the effect that cleaning numbers are counted, and when such numbers arrive at a specific number, it is determined that the waste ink storage 1055 is filled up, but the purport of the present invention is not limited to this description. It may be possible to determine the timing of the full-up storage by a sensor structured as shown in FIG. 46.

In conjunction with FIG. 46, this arrangement will be described more in detail. In the waste ink storage 1055, smoothly slidable ribs **1055*a* and 1055*b* are formed. These ribs are slidably supported by the structural members of the recording apparatus. Below the rib 1055*b*, a piezoelectric sensor 1056 is arranged. In this way, since the waste ink storage 1055 is movably arranged in the vertical direction as indicated by arrows, a pressure is given to the sensor 1056 corresponding to the weight of the storage. The sensor 1056 provides in turn an output corresponding to the given pressure. Thus, by such an output, a weight is calculated to know exactly the amount of stored ink in the waste ink storage 1055**. Also, in the present embodiment, a piezoelectric element is used for the sensor to detect the storage condition, but it may be possible to use any other sensors. For example, using a photosensor, the condition can be determined by discriminating the colors of ink, using a sensor which utilizes the conductivity of ink, the condition can be determined by detecting the voltage, among some other methods.

Figure 47:
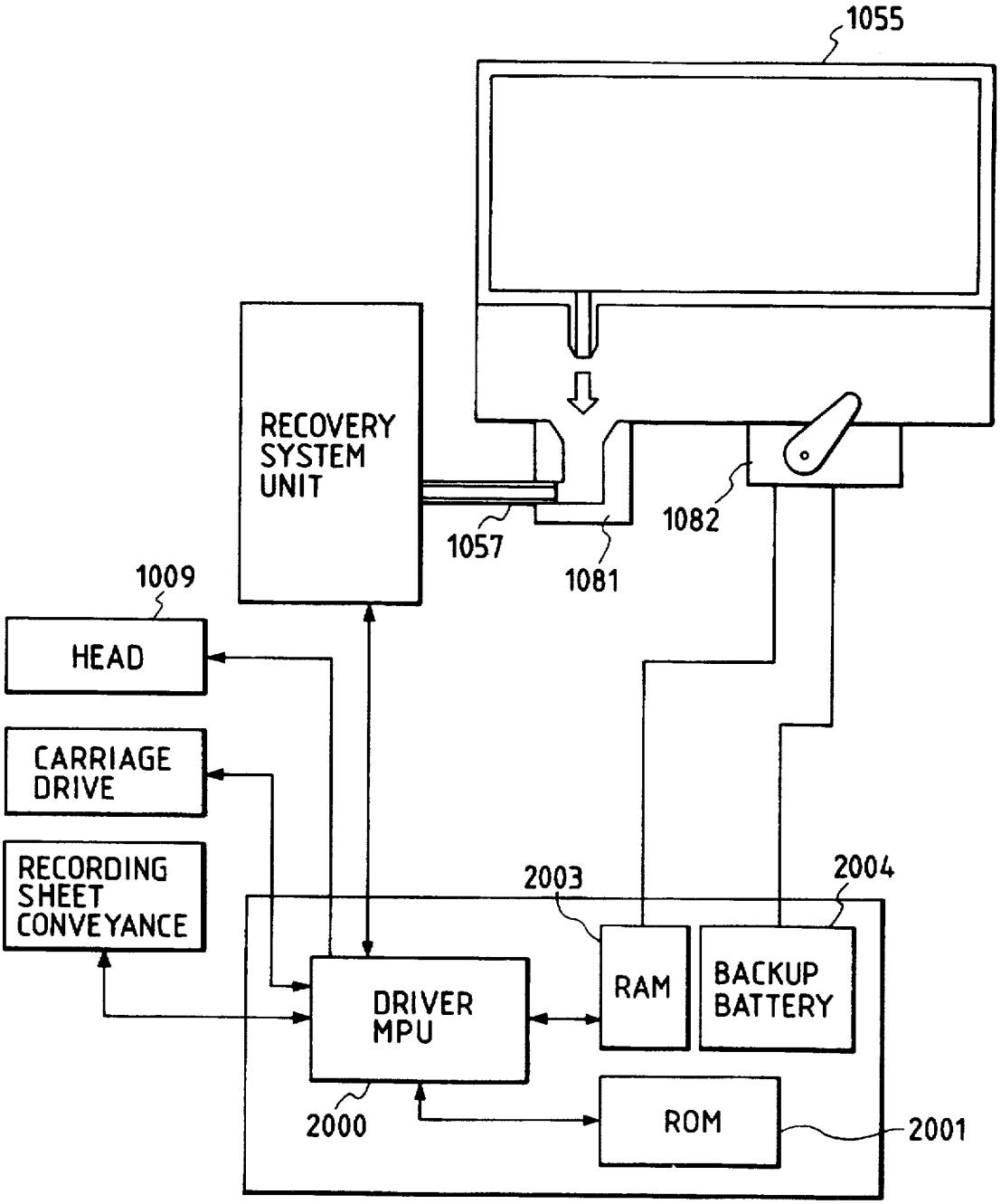
FIG. 47 is a block diagram showing an ink jet recording apparatus according to another embodiment.

Furthermore, in the present embodiment, the description has been made to the effect that as a process after the warning message is issued, the user should request the maker for the replacement of the waste ink tanks, and the count of the cleaning numbers is reset to zero simultaneously, but the purport of the present invention is not limited to this description. As shown in FIG. 47, there is no problem at all that an arrangement is made to enable the user himself to replace waste ink tanks, and that the count of cleaning numbers is automatically reset to zero when the tanks are replaced.

Now, in conjunction with FIG. 47, this arrangement will be described further in detail. The waste ink storage 1055 is structured so that it can be simply mounted or demounted, and is connected to the recovery system unit through a tube 1057 when it is inserted into a joint 1081. Two-dotted chain line in FIG. 47 indicates the position where the tank is set to be usable. In such a position, the lever of a microswitch is placed at 1082 so that the circuit is connected. In the present embodiment, the counted value of the accumulated cleaning numbers is stored in a RAM 2003 which is backed up by a back-up battery 2004 to keep the number in memory even after the power-supply to the apparatus is turned off. When the waste ink storage 1055 is in the given position, the counted value is kept in the memory as far as the RAM 2003 and the battery 2004 are connected by means of the microswitch 1082.

When the tank-full warning is issued, and the user exchanges the waste ink storage 1055, the back up to the RAM 2003 is released. Thus the memory is lost. When the use is resumed, the MPU 2000 calls the accumulated count of cleanings up to that time when the cleaning is executed next, but recognizing that the count is no longer kept in the memory, the MPU writes the count of the cleaning numbers to zero. After that, the counting of the cleaning number is resumed.

As has been described above, by warning the full-tank timing of the waste ink storage according to the present invention, it is possible to prevent a recording apparatus and an apparatus in which the recording apparatus is incorporated from being brought into such a state that these apparatuses cannot be reusable because of the waste ink which flows out when its amount becomes more than the allowable amount of its storage.

There is a case that even when the performance of the apparatus is normal, the full-tank timing of the waste ink storage is reached earlier if the user operates the recording apparatus in an extremely higher frequency than the standard frequency of use. Even such a user can effectively use the apparatus continuously by replacing the parts or units of the recording apparatus when the warning is issued. Also, there is no possibility at all that the waste ink flows out of the apparatus so that the furniture and carpet around the recording apparatus may be stained.

There is also an effect that the warning to be issued according to the present invention may serve as an indication of the maintenance timing for the respective parts of the recording apparatus. In other words, at the same time that the waste ink storage is replaced due to the warning, the other parts than the storage can also be cleaned or the parts are replaced if necessary.

Furthermore, although an ink jet recording system is advantageous in making the apparatus smaller, the required volume of the waste ink storage stands in the way of the miniaturization which is materialized only by making each part in the apparatus smaller. Also, according to the concept of the present invention, the waste ink storage can be replaced within the span of the usable life of the apparatus. In other words, it is possible to make the volume of the waste ink storage several times smaller than that of the conventional storage, thus effectively contributing to the miniaturization of the apparatus.

What is claimed is:

1. A calculating apparatus for calculating an amount of waste ink in an ink jet recording apparatus which uses a recording head to discharge ink for recording by discharging ink to a recording medium, said recording apparatus being provided with recovery means for executing a recovery operation of the recording head by exhausting ink from said recording head and waste ink storage means to store the ink exhausted by said recovery means, said calculating apparatus comprising:

memory means to keep in memory the amount of waste ink stored in said waste ink storage means; and time measuring means to measure an elapsed time from a last recovery operation by said recovery means to the present; and calculating means for calculating the amount of waste ink currently stored in said waste ink storage means in accordance with an exhaust amount exhausted up to the last recovery operation by said recovery means, the elapsed time measured by said time measuring means since the last recovery operation, and the amount of ink exhausted by a current recovery operation by the recovery means.

2. A calculating apparatus according to claim 1, wherein the amount of ink currently stored in said waste ink storage means is the sum of said exhaust amount at the time of exhaust by said recovery means, the amount of ink stored at the time of the last recovery operation by the recovery means, and the amount of ink calculated in accordance with the elapsed time since said last recovery operation, and is, after said exhaust is executed, the amount of ink calculated in accordance with said sum and the elapsed time subsequent to said exhaust.

3. A calculating apparatus according to claim 2, wherein the amount of ink currently stored in said ink storage means is calculated in accordance with evaporation characteristics of the ink.

4. A calculating apparatus according to claim 1, further comprising information means for supplying information to a user and control means for controlling said information means to supply information when the amount of waste ink stored in said waste ink storage means exceeds a predetermined amount.

5. A calculating apparatus according to claim 4, wherein said information means supplies information with sound.

6. A calculating apparatus according to claim 4, wherein said information means supplies information with an alarm light.

7. An apparatus according to claim 1, wherein said memory means stores an amount of the waste ink in said waste ink storage means calculated by said calculating means.

8. An ink jet recording apparatus which uses a recording head to discharge ink for recording by discharging ink from said recording head to a recording medium, said apparatus comprising:

recovery means to execute a discharge recovery of said recording head by exhausting ink from said recording head;

waste ink storage means to store the ink exhausted by said recovery means; and means for calculating an amount of waste ink currently stored in said waste ink storage means in accordance with an exhaust amount exhausted by said recovery means up to a present time, and an elapsed time from a beginning of exhaust by said recovery means up to the present time.

9. An ink jet recording apparatus according to claim 8, further comprising information means for supplying information to a user and control means for controlling said information means to supply information when the amount of waste ink stored in said waste ink storage means exceeds a predetermined amount.

10. An ink jet recording apparatus according to claim 9, wherein said information means supplies information with sound.

11. An ink jet recording apparatus according to claim 9, wherein said information means supplies information with an alarm light.

12. An ink jet recording apparatus according to claim 8, wherein said means for calculating the amount of waste ink makes the amount of ink currently stored in said waste ink storage means the sum of said exhaust amount at the time of exhaust executed by said recovery means, and the amount of ink calculated in accordance with the elapsed time since said exhaust, and after said exhaust is executed, the amount of ink calculated in accordance with said sum and the elapsed time subsequent to said exhaust.

13. An ink jet recording apparatus according to claim 8, wherein said means for calculating the amount of waste ink makes the amount of ink currently stored in said waste ink storage means the sum of said exhaust amount at the time of exhaust executed by said recovery means, and the amount of ink calculated in accordance with the elapsed time since said exhaust, and after said exhaust is executed, the amount of ink calculated in accordance with said sum and the elapsed time subsequent to said exhaust, and the evaporation characteristics of ink.

14. An ink jet recording apparatus according to claim 8, further comprising:

prohibiting means to prohibit said exhaust by said recovery means when the result of calculation by said means for calculating the amount of waste ink exceeds a given value.

15. An ink jet recording apparatus according to claim 8, wherein said recording head utilizes thermal energy for generating air bubbles in ink, and discharges ink based on the generation and development of said air bubbles.

16. An information processing system having an ink jet recording apparatus which uses a recording head to discharge ink for recording by discharging ink from said recording head to a recording medium, said system comprising:

recovery means to execute a discharge recovery of said recording head by exhausting ink from said recording head;

waste ink storage means to store ink exhausted by said recovery means; and means for calculating an amount of waste ink currently stored in said waste ink storage means in accordance with an exhaust amount exhausted by said recovery means up to a present time, and an elapsed time from a beginning of exhaust by said recovery means up to the present time; and prohibiting means to prohibit exhaust by said recovery means, irrespective of instructions in said information processing system, when a result of calculation by said means for calculating the amount of waste ink exceeds a given value.

17. An information processing system according to claim 16, further comprising information means for supplying information to a user and control means for controlling said information means to supply information when the amount of waste ink stored in said waste ink storage means exceeds a predetermined amount.

18. An information processing system according to claim 17, wherein said information means supplies information with sound.

19. An information processing system according to claim 17, wherein said information means supplies information with an alarm light.

20. An information processing system according to claim 16, wherein said means for calculating the amount of waste ink makes the amount of ink currently stored in said waste ink storage means the sum of said exhaust amount at the time of exhaust executed by said recovery means, and the amount of ink calculated in accordance with the elapsed time since said exhaust, and after said exhaust is executed, the amount of ink calculated in accordance with said sum and the elapsed time subsequent to said exhaust.

21. An information processing system according to claim 16, wherein said means for calculating the amount of waste ink makes the amount of ink currently stored in said waste ink storage means the sum of said exhaust amount at the time of exhaust executed by said recovery means, and the amount of ink calculated in accordance with the elapsed time since said exhaust, and after said exhaust is executed, the amount of ink calculated in accordance with said sum and the elapsed time subsequent to said exhaust, and the evaporation characteristics of ink.

22. An information processing system according to claim 16, wherein said recording head utilizes thermal energy for generating air bubbles in ink, and discharges ink based on the generation and development of said air bubbles.

23. An ink jet recording method using a recording head for discharging ink and recording by discharging ink from said recording head to a recording medium, comprising the steps of:

memorizing an amount of ink stored in a waste ink storage means;

instructing a recovery of a discharge condition of said recording head by exhausting ink from said recording head;

measuring an elapsed time from a previous recovery operation when a recovery operation is instructed; and calculating an amount of ink stored in said waste ink storage means in accordance with an amount of ink exhausted at said instructing step, the elapsed time measured at said measuring step and an amount of ink exhausted by a present recovery operation.

24. An ink jet recording method according to claim 23, wherein in said calculating step the amount of waste ink is calculated in accordance with the amount of ink exhausted up to the present and the elapsed time since the beginning of the exhaustion of ink in said recovery operation up to the present.

25. An ink jet recording method according to claim 23, further comprising the following step:

prohibiting exhaustion of ink in said recovery operation when a result of calculation in said calculating step exceeds a given value.

26. An ink jet recording method according to claim 23, wherein said recording head utilizes thermal energy to generate air bubbles in ink, and discharges ink based on the generation and development of said air bubbles.

27. An ink jet recording method according to claim 23, further comprising the steps of:

supplying information to a user by an information means; and controlling said information means to supply information when the amount of waste ink stored in said waste ink storage means exceeds a predetermined amount.

28. An ink jet recording method according to claim 27, wherein said information means supplies information with sound.

29. An ink jet recording method according to claim 27, wherein said information means supplies information with an alarm light.

30. A calculating method for an ink jet recording apparatus using a recording head for discharging ink and recording by discharging ink from said recording head to a recording medium, said apparatus including recovery means for performing a recovery operation of said recording head by discharging ink from said recording head and waste ink storage means for storing ink exhausted by said recovery means, said method comprising the steps of:

performing the recovery operation by said recovery means;

counting an elapsed time from a previous recovery operation by said recovery means to the present; and calculating an amount of ink currently stored in said waste ink storage means in accordance with an amount of waste ink stored in said waste ink storage means up to the previous recovery operation, said counted elapsed time from the previous recovery operation and an amount of ink exhausted by a present recovery operation.

* * * * *

UNITED STATES PATENT AND TRADEMARK OFFICE

CERTIFICATE OF CORRECTION

PATENT NO. : 5,764,253

DATED : June 9, 1998

INVENTOR(S): YOSHIO UCHIKATA ET AL.

It is certified that error appears in the above-identified patent and that said Letters Patent is hereby corrected as shown below:

In the Drawings:

SHEET 13

Figure 17, "ONLLNE/" should read --ONLINE/--.

SHEET 18

Figure 25, "SOCK" should read --SUCK--.

COLUMN 1

Line 23, "one of" should read --one of the--;
Line 33, "the" should read --this--;
Line 59, "of" should read --of the--.

COLUMN 2

Line 46, "floor" should read --floor,--;
Line 56, "tank," should read --tank--.

COLUMN 4

Line 30, "own" should be deleted.

COLUMN 5

Line 60, "are the" should read --is--;
Line 65, "wave" should read --waves--.

UNITED STATES PATENT AND TRADEMARK OFFICE

CERTIFICATE OF CORRECTION

PATENT NO. : 5,764,253

DATED : June 9, 1998

INVENTOR(S): YOSHIO UCHIKATA ET AL.

It is certified that error appears in the above-identified patent and that said Letters Patent is hereby corrected as shown below:

COLUMN 6

Line 46, "hole" should read --hold--;
Line 55, "boared" should read --board--.

COLUMN 9

Line 30, "and" should be deleted.

COLUMN 11

Line 32, "In" should read --in--.

COLUMN 12

Line 27, "check" should read --checks--;
Line 63, "include" should read --includes--.

COLUMN 13

Line 5, "command" should read --commands--;
Line 10, "command" should read --commands--;
Line 11, "command" should read --commands--;
Line 13, "carrier" should read --carried--;
Line 14, "command" should read --commands--;
Line 19, "command" should read --commands--;
Line 23, "command" should read --commands--;
Line 27, "command" should read --commands--.

UNITED STATES PATENT AND TRADEMARK OFFICE

CERTIFICATE OF CORRECTION

PATENT NO. : 5,764,253

DATED : June 9, 1998

INVENTOR(S): YOSHIO UCHIKATA ET AL.

It is certified that error appears in the above-identified patent and that said Letters Patent is hereby corrected as shown below:

COLUMN 14

Line 48, "in" should read --in the--.

COLUMN 15

Line 8, "form" should read --from--;
Line 34, "precess" should read --process--.

COLUMN 16

Line 15, "As for as" should read --when--;
Line 62, "is" should read --are--.

COLUMN 17

Line 23, "and" should read --or--.

COLUMN 18

Line 16, "of" should read --of a--;
Line 31, "$+W_{volatil}$" should read --$+W_{volatile}$--;
Line 32, "e(old)" should read --(old)--;
Line 36, "of" (first occurrence) should read --of the--;
Line 37, "$+W_{nonvolatile\ (new)}$," should read --$+W_{non\text{-}volatile\ (new)}$,--.

COLUMN 19

Line 55, "an" should read --a--.

UNITED STATES PATENT AND TRADEMARK OFFICE

CERTIFICATE OF CORRECTION

PATENT NO. : 5,764,253

DATED : June 9, 1998

INVENTOR(S): YOSHIO UCHIKATA ET AL.

It is certified that error appears in the above-identified patent and that said Letters Patent is hereby corrected as shown below:

COLUMN 21

Line 32, "As" should read --As is--.

COLUMN 22

Line 7, "an" should read --of an--;
Line 27, "an" should be deleted;
Line 48, "this" should read --these--.

COLUMN 24

Line 8, "extend" should read --extent--;
Line 25, "a" should be deleted;
Line 34, "each" should be deleted;
Line 47, =22.46g" should read --≃22.46g--;
Line 58, "≃ 86.25g" should read --≃ 86.25g--.

COLUMN 25

Line 8, "≃ 6.4 (years)" should read --≃ 6.4 (years)--;
Line 58, "at all this" should read --at all if this--.

UNITED STATES PATENT AND TRADEMARK OFFICE

CERTIFICATE OF CORRECTION

PATENT NO. : 5,764,253

DATED : June 9, 1998

INVENTOR(S): YOSHIO UCHIKATA ET AL.

It is certified that error appears in the above-identified patent and that said Letters Patent is hereby corrected as shown below:

COLUMN 28

Line 6, "and" should be deleted;
Line 42, "An" should read --A calculating--.

COLUMN 29

Line 43, "and" should be deleted.

Signed and Sealed this
First Day of February, 2000

*Attest:*

Q. TODD DICKINSON

*Attesting Officer*

*Acting Commissioner of Patents and Trademarks*